US009845652B2

(12) United States Patent
Wolfe et al.

(10) Patent No.: US 9,845,652 B2
(45) **Date of Patent: *Dec. 19, 2017**

(54) REDUCED MECHANICAL ENERGY WELL CONTROL SYSTEMS AND METHODS OF USE

(71) Applicants: FORO ENERGY, INC., Houston, TX (US); CHEVRON U.S.A. INC., Houston, TX (US)

(72) Inventors: Daniel L. Wolfe, Houston, TX (US); Andyle G. Bailey, Kingwood, TX (US); Daryl L. Grubb, Houston, TX (US); Sharath K. Kolachalam, Highlands Ranch, CO (US); Mark S. Zediker, Castle Rock, CO (US); Paul D. Deutch, Houston, TX (US)

(73) Assignee: Foro Energy, Inc., Houston, TX (US)

( * ) Notice: Subject to any disclaimer, the term of this patent is extended or adjusted under 35 U.S.C. 154(b) by 580 days.

This patent is subject to a terminal disclaimer.

(21) Appl. No.: 14/015,003

(22) Filed: Aug. 30, 2013

(65) Prior Publication Data

US 2014/0000902 A1 Jan. 2, 2014

Related U.S. Application Data

(63) Continuation-in-part of application No. 13/034,175, filed on Feb. 24, 2011, now Pat. No. 8,783,361, and (Continued)

(51) Int. Cl.
*E21B 29/12* (2006.01)
*E21B 43/116* (2006.01)
(Continued)

(52) U.S. Cl.
CPC ..... *E21B 29/00* (2013.01); *E21B 29/02* (2013.01); *E21B 33/063* (2013.01)

(58) Field of Classification Search
CPC ..... E21B 29/12; E21B 33/064; E21B 29/00; E21B 29/002; E21B 29/005;
(Continued)

(56) References Cited

U.S. PATENT DOCUMENTS 914,636 A 3/1909 Case
2,548,463 A 4/1951 Blood
(Continued)

FOREIGN PATENT DOCUMENTS

EP 0 565 287 A1 10/1993
EP 0 950 170 B1 9/2002
(Continued)

OTHER PUBLICATIONS

International Search Report PCT/US2013/057569 dated Apr. 16, 2014.
(Continued)

*Primary Examiner* — Matthew R Buck
*Assistant Examiner* — Edwin Toledo-Duran
(74) *Attorney, Agent, or Firm* — Glen P. Belvis; Belvis Law, LLC

(57) ABSTRACT

There is provided systems, methods and apparatus for the use of directed energy, including high power laser energy, in conjunction with mechanical shearing, sealing and closing devices to provide reduced mechanical energy well control systems and techniques.

97 Claims, 29 Drawing Sheets

Related U.S. Application Data a continuation-in-part of application No. 13/034,183, filed on Feb. 24, 2011, now Pat. No. 8,684,088, and a continuation-in-part of application No. 13/034,017, filed on Feb. 24, 2011, now Pat. No. 8,783,360, and a continuation-in-part of application No. 13/034,037, filed on Feb. 24, 2011, now Pat. No. 8,720,584.

(60) Provisional application No. 61/696,142, filed on Sep. 1, 2012.

(51) Int. Cl.

| | |
|---|---|
| ***E21B 43/119*** | (2006.01) |
| ***E21B 29/06*** | (2006.01) |
| ***E21B 29/08*** | (2006.01) |
| ***E21B 34/04*** | (2006.01) |
| ***E21B 29/00*** | (2006.01) |
| ***E21B 33/06*** | (2006.01) |
| ***E21B 29/02*** | (2006.01) |

(58) Field of Classification Search

CPC ..... E21B 29/007; E21B 29/02; E21B 29/04; E21B 29/06; E21B 29/08; E21B 43/11; E21B 33/06; E21B 33/061; E21B 33/062; E21B 33/063

USPC ..... 166/361, 363, 364, 297, 298, 55, 55.6, 166/85.4; 137/315.02; 251/1.1, 1.2, 1.3; 219/121.67, 121.72

See application file for complete search history.

(56) References Cited

U.S. PATENT DOCUMENTS 2,742,555 A 4/1956 Murray
3,122,212 A 2/1964 Karlovitz
3,168,334 A 2/1965 Johnson
3,461,964 A * 8/1969 Venghiattis ..... E21B 7/15 166/297
3,493,060 A 2/1970 Van Dyk
3,539,221 A 11/1970 Gladstone
3,544,165 A 12/1970 Snedden
3,556,600 A 1/1971 Shoupp et al.
3,561,526 A 2/1971 Williams et al.
3,574,357 A 4/1971 Alexandru et al.
3,652,447 A 3/1972 Yant
3,693,718 A 9/1972 Stout
3,820,605 A 6/1974 Barber et al.
3,821,510 A 6/1974 Muncheryan
3,871,485 A 3/1975 Keenan, Jr.
3,882,945 A 5/1975 Keenan, Jr.
3,913,668 A 10/1975 Todd et al.
3,938,599 A 2/1976 Horn
3,960,448 A 6/1976 Schmidt et al.
3,977,478 A 8/1976 Shuck
3,981,369 A 9/1976 Bokenkamp
3,992,095 A 11/1976 Jacoby et al.
3,998,281 A 12/1976 Salisbury et al.
4,019,331 A 4/1977 Rom et al.
4,025,091 A 5/1977 Zeile, Jr.
4,026,356 A 5/1977 Shuck
4,043,575 A 8/1977 Roth
4,046,191 A * 9/1977 Neath ..... E21B 21/001 166/352
4,061,190 A 12/1977 Bloomfield
4,066,138 A 1/1978 Salisbury et al.
4,081,027 A * 3/1978 Nguyen ..... E21B 29/08 116/55
4,086,971 A 5/1978 Hall et al.
4,090,572 A 5/1978 Welch
4,113,036 A 9/1978 Stout
4,189,705 A 2/1980 Pitts, Jr.
4,194,536 A 3/1980 Stine et al.
4,199,034 A 4/1980 Salisbury et al.
4,227,582 A * 10/1980 Price ..... E21B 7/15 166/297
4,228,856 A 10/1980 Reale
4,252,015 A 2/1981 Harbon et al.
4,256,146 A 3/1981 Genini et al.
4,266,609 A 5/1981 Rom et al.
4,280,535 A 7/1981 Willis
4,282,940 A 8/1981 Salisbury et al.
4,332,401 A 6/1982 Stephenson et al.
4,336,415 A 6/1982 Walling
4,340,245 A 7/1982 Stalder
4,370,886 A 2/1983 Smith, Jr. et al.
4,374,530 A 2/1983 Walling
4,375,164 A 3/1983 Dodge et al.
4,415,184 A 11/1983 Stephenson et al.
4,417,603 A 11/1983 Argy
4,444,420 A 4/1984 McStravick et al.
4,453,570 A 6/1984 Hutchison
4,459,731 A 7/1984 Hutchison
4,477,106 A 10/1984 Hutchison
4,531,552 A 7/1985 Kim
4,533,814 A * 8/1985 Ward ..... B23K 26/282 219/121.63
4,565,351 A 1/1986 Conti et al.
4,662,437 A 5/1987 Renfro
4,694,865 A 9/1987 Tauschmann
4,741,405 A 5/1988 Moeny et al.
4,744,420 A 5/1988 Patterson et al.
4,770,493 A 9/1988 Ara et al.
4,774,393 A 9/1988 Tarumoto
4,793,383 A 12/1988 Gyory et al.
4,830,113 A 5/1989 Geyer
4,860,654 A 8/1989 Chawla et al.
4,860,655 A 8/1989 Chawla
4,872,520 A 10/1989 Nelson
4,923,008 A * 5/1990 Wachowicz ..... E21B 29/08 137/14
4,989,236 A 1/1991 Myllymäki
4,997,250 A 3/1991 Ortiz, Jr.
5,003,144 A 3/1991 Lindroth et al.
5,004,166 A 4/1991 Sellar
5,033,545 A 7/1991 Sudol
5,049,738 A 9/1991 Gergely et al.
5,070,904 A 12/1991 McMahon et al.
5,078,546 A * 1/1992 Fisk ..... E21B 7/205 138/97
5,084,617 A 1/1992 Gergely
5,086,842 A 2/1992 Cholet
5,107,936 A 4/1992 Foppe
5,121,872 A 6/1992 Legget
5,125,061 A 6/1992 Marlier et al.
5,140,664 A 8/1992 Bosisio et al.
5,163,321 A 11/1992 Perales
5,172,112 A 12/1992 Jennings
5,212,755 A 5/1993 Holmberg
5,285,204 A 2/1994 Sas-Jaworsky
5,348,097 A 9/1994 Giannesini et al.
5,351,533 A 10/1994 Macadam et al.
5,353,875 A 10/1994 Schultz et al.
5,396,805 A 3/1995 Surjaatmadja
5,400,857 A 3/1995 Whitby et al.
5,411,081 A 5/1995 Moore et al.
5,411,085 A 5/1995 Moore et al.
5,411,105 A 5/1995 Gray
5,413,045 A 5/1995 Miszewski
5,413,170 A 5/1995 Moore
5,423,383 A 6/1995 Pringle
5,425,420 A 6/1995 Pringle
5,435,351 A 7/1995 Head
5,435,395 A 7/1995 Connell
5,463,711 A 10/1995 Chu
5,465,793 A 11/1995 Pringle
5,469,878 A 11/1995 Pringle
5,479,860 A 1/1996 Ellis
5,483,988 A 1/1996 Pringle
5,488,992 A 2/1996 Pringle
5,500,768 A 3/1996 Doggett et al.
5,503,014 A 4/1996 Griffith
5,503,370 A 4/1996 Newman et al.

(56) References Cited

U.S. PATENT DOCUMENTS 5,505,259 A 4/1996 Wittrisch et al.
5,515,926 A 5/1996 Boychuk
5,561,516 A 10/1996 Noble et al.
5,566,764 A 10/1996 Elliston
5,573,225 A 11/1996 Boyle et al.
5,577,560 A 11/1996 Coronado et al.
5,599,004 A 2/1997 Newman et al.
5,615,052 A 3/1997 Doggett
RE35,542 E * 6/1997 Fisk ..... E21B 7/205 138/97
5,638,904 A 6/1997 Misselbrook et al.
5,655,745 A 8/1997 Morrill
5,657,823 A * 8/1997 Kogure ..... E21B 7/128 166/340
5,694,408 A 12/1997 Bott et al.
5,735,502 A 4/1998 Levett et al.
5,757,484 A 5/1998 Miles et al.
5,771,974 A * 6/1998 Stewart ..... E21B 34/045 166/322
5,771,984 A 6/1998 Potter et al.
5,773,791 A 6/1998 Kuykendal
5,813,465 A 9/1998 Terrell et al.
5,847,825 A 12/1998 Alexander
5,862,273 A 1/1999 Pelletier
5,862,862 A 1/1999 Terrel
5,864,113 A 1/1999 Cossi
5,896,482 A 4/1999 Blee et al.
5,896,938 A 4/1999 Moeny et al.
5,902,499 A 5/1999 Richerzhagen
5,909,306 A 6/1999 Goldberg et al.
5,924,489 A 7/1999 Hatcher
5,929,986 A 7/1999 Slater et al.
5,938,954 A 8/1999 Onuma et al.
5,986,236 A 11/1999 Gainand et al.
5,986,756 A 11/1999 Slater et al.
RE36,525 E 1/2000 Pringle
6,015,015 A 1/2000 Luft et al.
6,026,905 A * 2/2000 Garcia-Soule ..... E21B 34/045 166/336
6,032,742 A 3/2000 Tomlin et al.
6,038,363 A 3/2000 Slater et al.
6,047,781 A 4/2000 Scott et al.
RE36,723 E 6/2000 Moore et al.
6,084,203 A 7/2000 Bonigen
6,104,022 A 8/2000 Young et al.
RE36,880 E 9/2000 Pringle
6,116,344 A * 9/2000 Longbottom ..... E21B 29/06 166/298
6,147,754 A 11/2000 Theriault et al.
6,166,546 A 12/2000 Scheihing et al.
6,173,770 B1 1/2001 Morrill
6,202,753 B1 * 3/2001 Baugh ..... E21B 33/0355 166/364
6,215,734 B1 4/2001 Moeny et al.
6,227,300 B1 5/2001 Cunningham et al.
6,250,391 B1 6/2001 Proudfoot
6,273,193 B1 8/2001 Hermann et al.
6,301,423 B1 10/2001 Olson
6,321,839 B1 11/2001 Vereecken et al.
6,325,159 B1 12/2001 Peterman et al.
6,328,343 B1 12/2001 Hosie et al.
6,352,114 B1 3/2002 Toalson et al.
6,355,928 B1 3/2002 Skinner et al.
6,356,683 B1 3/2002 Hu et al.
6,384,738 B1 5/2002 Carstensen et al.
6,386,300 B1 5/2002 Curlett et al.
6,401,825 B1 6/2002 Woodrow
6,426,479 B1 7/2002 Bischof
6,437,326 B1 8/2002 Yamate et al.
6,450,257 B1 9/2002 Douglas
6,497,290 B1 12/2002 Misselbrook et al.
6,543,538 B2 * 4/2003 Tolman ..... E21B 33/124 166/278
6,561,289 B2 5/2003 Portman et al.
6,564,046 B1 5/2003 Chateau
6,591,046 B2 7/2003 Stottlemyer
6,615,922 B2 9/2003 Deul et al.
6,626,249 B2 9/2003 Rosa
6,644,848 B1 11/2003 Clayton et al.
6,661,815 B1 12/2003 Kozlovsky et al.
6,710,720 B2 3/2004 Carstensen et al.
6,712,150 B1 3/2004 Misselbrook et al.
6,719,042 B2 4/2004 Johnson et al.
6,725,924 B2 * 4/2004 Davidson ..... E21B 33/0355 166/250.01
6,737,605 B1 5/2004 Kern
6,746,182 B2 6/2004 Munk et al.
6,747,743 B2 6/2004 Skinner et al.
6,755,262 B2 6/2004 Parker
6,808,023 B2 10/2004 Smith et al.
6,820,702 B2 11/2004 Niedermayr et al.
6,832,654 B2 12/2004 Ravensbergen et al.
6,847,034 B2 1/2005 Shah et al.
6,851,488 B2 2/2005 Batarseh
6,860,525 B2 3/2005 Parks
6,867,858 B2 3/2005 Owen et al.
6,870,128 B2 3/2005 Kobayashi et al.
6,874,361 B1 4/2005 Meltz et al.
6,880,646 B2 4/2005 Batarseh
6,885,784 B2 4/2005 Bohnert
6,888,097 B2 5/2005 Batarseh
6,888,127 B2 5/2005 Jones et al.
6,912,898 B2 7/2005 Jones et al.
6,913,079 B2 7/2005 Tubel
6,920,395 B2 7/2005 Brown
6,920,946 B2 7/2005 Oglesby
6,957,576 B2 10/2005 Skinner et al.
6,967,322 B2 11/2005 Jones et al.
6,978,832 B2 12/2005 Gardner et al.
6,994,162 B2 2/2006 Robison
7,040,746 B2 5/2006 McCain et al.
7,055,604 B2 6/2006 Jee et al.
7,055,629 B2 6/2006 Oglesby
7,072,044 B2 7/2006 Kringlebotn et al.
7,072,588 B2 7/2006 Skinner
7,086,467 B2 8/2006 Schlegelmilch et al.
7,086,484 B2 8/2006 Smith, Jr.
7,087,865 B2 8/2006 Lerner
7,126,332 B2 10/2006 Blanz et al.
7,134,488 B2 11/2006 Tudor et al.
7,147,064 B2 12/2006 Batarseh et al.
7,172,026 B2 2/2007 Misselbrook
7,195,731 B2 3/2007 Jones
7,199,869 B2 4/2007 MacDougall
7,210,343 B2 5/2007 Shammai et al.
7,212,283 B2 5/2007 Hother et al.
7,249,633 B2 7/2007 Ravensbergen et al.
7,264,057 B2 9/2007 Rytlewski et al.
7,270,195 B2 9/2007 MacGregor et al.
7,273,108 B2 9/2007 Misselbrook
7,334,637 B2 * 2/2008 Smith, Jr. ..... E21B 7/14 166/287
7,337,660 B2 3/2008 Ibrahim et al.
7,362,422 B2 4/2008 DiFoggio et al.
7,367,396 B2 5/2008 Springett et al.
7,395,696 B2 7/2008 Bissonnette et al.
7,395,866 B2 7/2008 Milberger et al.
7,416,032 B2 8/2008 Moeny et al.
7,416,258 B2 8/2008 Reed et al.
7,471,831 B2 12/2008 Bearman et al.
7,487,834 B2 2/2009 Reed et al.
7,490,664 B2 2/2009 Skinner et al.
7,503,404 B2 3/2009 McDaniel et al.
7,516,802 B2 4/2009 Smith, Jr.
7,518,722 B2 4/2009 Julian et al.
7,527,108 B2 5/2009 Moeny
7,530,406 B2 5/2009 Moeny et al.
7,559,378 B2 7/2009 Moeny
7,587,111 B2 9/2009 De Monmorillon et al.
7,591,315 B2 9/2009 Dore et al.
7,600,564 B2 10/2009 Shampine et al.
7,671,983 B2 3/2010 Shammai et al.
7,779,917 B2 8/2010 Kotrla et al.

(56) References Cited

U.S. PATENT DOCUMENTS 7,802,384 B2 9/2010 Kobayashi et al.
7,832,477 B2 * 11/2010 Cavender ..... E21B 43/103 166/206
7,938,175 B2 5/2011 Skinner et al.
7,980,306 B2 * 7/2011 Lovell ..... E21B 17/206 166/250.01
8,025,371 B1 9/2011 Dean, Jr.
8,056,633 B2 * 11/2011 Barra ..... E21B 19/002 166/298
8,322,441 B2 12/2012 Fenton
2002/0039465 A1 4/2002 Skinner
2002/0189806 A1 12/2002 Davidson et al.
2003/0000741 A1 1/2003 Rosa
2003/0021634 A1 1/2003 Munk et al.
2003/0053783 A1 3/2003 Shirasaki
2003/0056990 A1 3/2003 Oglesby
2003/0085040 A1 5/2003 Hemphill et al.
2003/0094281 A1 5/2003 Tubel
2003/0132029 A1 7/2003 Parker
2003/0136927 A1 7/2003 Baugh
2003/0145991 A1 8/2003 Olsen
2003/0174942 A1 9/2003 Murshid et al.
2003/0226826 A1 12/2003 Kobayashi et al.
2004/0006429 A1 1/2004 Brown
2004/0016295 A1 1/2004 Skinner et al.
2004/0020643 A1 2/2004 Thomeer et al.
2004/0026382 A1 2/2004 Richerzhagen
2004/0033017 A1 2/2004 Kringlebotn et al.
2004/0074979 A1 4/2004 McGuire
2004/0093950 A1 5/2004 Bohnert
2004/0112642 A1 6/2004 Krueger et al.
2004/0119471 A1 6/2004 Blanz et al.
2004/0129418 A1 7/2004 Jee et al.
2004/0195003 A1 10/2004 Batarseh
2004/0206505 A1 10/2004 Batarseh
2004/0207731 A1 10/2004 Bearman et al.
2004/0211894 A1 10/2004 Hother et al.
2004/0218176 A1 11/2004 Shammal et al.
2004/0244970 A1 12/2004 Smith, Jr.
2004/0252748 A1 12/2004 Gleitman
2004/0256103 A1 12/2004 Batarseh
2005/0007583 A1 1/2005 DiFoggio
2005/0012244 A1 1/2005 Jones
2005/0024743 A1 2/2005 Camy-Peyret
2005/0034857 A1 2/2005 Defretin et al.
2005/0094129 A1 5/2005 MacDougall
2005/0099618 A1 5/2005 DiFoggio et al.
2005/0115741 A1 6/2005 Terry et al.
2005/0121235 A1 6/2005 Larsen et al.
2005/0189146 A1 9/2005 Oglesby
2005/0201652 A1 9/2005 Ellwood, Jr.
2005/0212284 A1 9/2005 Dole
2005/0230107 A1 10/2005 McDaniel et al.
2005/0252286 A1 11/2005 Ibrahim et al.
2005/0263281 A1 12/2005 Lovell et al.
2005/0268704 A1 12/2005 Bissonnette et al.
2005/0269132 A1 12/2005 Batarseh et al.
2005/0272512 A1 12/2005 Bissonnette et al.
2005/0272513 A1 12/2005 Bissonnette et al.
2005/0272514 A1 12/2005 Bissonnette et al.
2005/0282645 A1 12/2005 Bissonnette et al.
2006/0038997 A1 2/2006 Julian et al.
2006/0065815 A1 3/2006 Jurca
2006/0070770 A1 4/2006 Marsh
2006/0102343 A1 5/2006 Skinner et al.
2006/0118303 A1 6/2006 Schultz et al.
2006/0185843 A1 8/2006 Smith, Jr.
2006/0191684 A1 8/2006 Smith, Jr.
2006/0201682 A1 9/2006 Reynolds
2006/0204188 A1 9/2006 Clarkson et al.
2006/0207799 A1 9/2006 Yu
2006/0231257 A1 10/2006 Reed et al.
2006/0237233 A1 10/2006 Reed et al.
2006/0260832 A1 11/2006 McKay
2006/0289724 A1 12/2006 Skinner et al.
2007/0034409 A1 2/2007 Dale et al.
2007/0125163 A1 6/2007 Dria et al.
2007/0193990 A1 8/2007 Richerzhagen et al.
2007/0217736 A1 9/2007 Zhang et al.
2007/0227741 A1 10/2007 Lovell et al.
2007/0247701 A1 10/2007 Akasaka et al.
2007/0267220 A1 11/2007 Magiawala et al.
2007/0278195 A1 12/2007 Richerzhagen et al.
2007/0280615 A1 12/2007 de Montmorillon et al.
2008/0053702 A1 3/2008 Smith
2008/0073077 A1 3/2008 Tunc et al.
2008/0078081 A1 4/2008 Huff et al.
2008/0093125 A1 4/2008 Potter et al.
2008/0099701 A1 5/2008 Whitby et al.
2008/0138022 A1 6/2008 Tassone
2008/0166132 A1 7/2008 Lynde
2008/0180787 A1 7/2008 DiGiovanni et al.
2008/0245568 A1 10/2008 Jeffryes
2008/0273852 A1 11/2008 Parker et al.
2009/0050371 A1 2/2009 Moeny
2009/0078467 A1 3/2009 Castillo
2009/0126235 A1 5/2009 Kobayashi et al.
2009/0133871 A1 5/2009 Skinner et al.
2009/0133929 A1 5/2009 Rodland
2009/0139768 A1 6/2009 Castillo
2009/0166042 A1 7/2009 Skinner
2009/0194292 A1 8/2009 Oglesby
2009/0205675 A1 8/2009 Sarker et al.
2009/0260829 A1 10/2009 Mathis
2009/0272424 A1 11/2009 Ortabasi
2009/0279835 A1 11/2009 de Montmorillon et al.
2009/0294050 A1 12/2009 Traggis et al.
2010/0000790 A1 1/2010 Moeny
2010/0001179 A1 1/2010 Kobayashi et al.
2010/0013663 A1 1/2010 Cavender et al.
2010/0018703 A1 1/2010 Lovell et al.
2010/0032207 A1 2/2010 Potter et al.
2010/0044102 A1 2/2010 Rinzler et al.
2010/0044103 A1 * 2/2010 Moxley ..... E21B 7/14 175/16
2010/0044104 A1 2/2010 Zediker et al.
2010/0044105 A1 2/2010 Faircloth et al.
2010/0044106 A1 2/2010 Zediker et al.
2010/0051847 A1 3/2010 Mailand et al.
2010/0071794 A1 3/2010 Homan
2010/0078414 A1 4/2010 Perry et al.
2010/0084132 A1 4/2010 Noya et al.
2010/0089574 A1 4/2010 Wideman et al.
2010/0089576 A1 4/2010 Wideman et al.
2010/0089577 A1 4/2010 Wideman et al.
2010/0147528 A1 6/2010 Baugh
2010/0164223 A1 7/2010 Curtiss, III et al.
2010/0187010 A1 7/2010 Abbasi et al.
2010/0197116 A1 8/2010 Shah et al.
2010/0215326 A1 8/2010 Zediker et al.
2010/0218955 A1 9/2010 Hart
2010/0218993 A1 9/2010 Wideman et al.
2010/0224408 A1 9/2010 Kocis et al.
2010/0236785 A1 * 9/2010 Collis ..... B08B 9/0436 166/339
2010/0301027 A1 12/2010 Sercel
2010/0326659 A1 12/2010 Schultz et al.
2010/0326665 A1 12/2010 Redlinger et al.
2011/0030367 A1 2/2011 Dadd
2011/0079437 A1 4/2011 Hopkins et al.
2011/0174537 A1 7/2011 Potter et al.
2012/0000646 A1 1/2012 Liotta et al.
2012/0020631 A1 1/2012 Rinzler et al.
2012/0061091 A1 3/2012 Radi
2012/0067643 A1 3/2012 DeWitt et al.
2012/0068086 A1 3/2012 DeWitt et al.
2012/0074110 A1 3/2012 Zediker et al.
2012/0217015 A1 8/2012 Zediker et al.
2012/0217017 A1 8/2012 Zediker
2012/0217018 A1 8/2012 Zediker et al.
2012/0217019 A1 8/2012 Zediker et al.
2012/0248078 A1 10/2012 Zediker et al.
2012/0255774 A1 10/2012 Grubb et al.
2012/0255933 A1 10/2012 McKay et al.

(56) References Cited

U.S. PATENT DOCUMENTS

| | | | | |
|---|---|---|---|---|
| 2012/0261188 | A1 | 10/2012 | Zediker et al. | |
| 2012/0266803 | A1 | 10/2012 | Zediker et al. | |
| 2012/0267168 | A1 | 10/2012 | Grubb et al. | |
| 2012/1267168 | | 10/2012 | Grubb | |
| 2012/0273269 | A1 | 11/2012 | Rinzler et al. | |
| 2012/0273470 | A1 | 11/2012 | Zediker et al. | |
| 2012/0275159 | A1 | 11/2012 | Fraze et al. | |
| 2013/0011102 | A1 | 1/2013 | Rinzler et al. | |
| 2013/0161007 | A1* | 6/2013 | Wolfe | E21B 43/11857 166/297 |
| 2013/0168081 | A1* | 7/2013 | Yang | E21B 47/12 166/247 |
| 2013/0175090 | A1 | 7/2013 | Zediker | |
| 2013/0192893 | A1 | 8/2013 | Zediker | |
| 2013/0192894 | A1 | 8/2013 | Zediker | |
| 2013/0220626 | A1 | 8/2013 | Zediker et al. | |
| 2013/0228372 | A1 | 9/2013 | Linyaev | |
| 2013/0228557 | A1 | 9/2013 | Zediker | |
| 2013/0266031 | A1 | 10/2013 | Norton | |
| 2013/0319984 | A1 | 12/2013 | Linyaev et al. | |
| 2014/0000902 | A1 | 1/2014 | Wolfe | |
| 2014/0060802 | A1 | 3/2014 | Zediker | |
| 2014/0060930 | A1 | 3/2014 | Zediker | |
| 2014/0069896 | A1 | 3/2014 | Deutch | |
| 2014/0090846 | A1 | 4/2014 | Deutch | |
| 2014/0190949 | A1 | 7/2014 | Zediker | |
| 2014/0231085 | A1 | 8/2014 | Zediker | |
| 2014/0231398 | A1 | 8/2014 | Land | |
| 2014/0248025 | A1 | 9/2014 | Rinzler | |
| 2014/0345872 | A1 | 11/2014 | Zediker | |

FOREIGN PATENT DOCUMENTS

| | | | |
|---|---|---|---|
| FR | 2 716 924 | A1 | 9/1995 |
| GB | 1284454 | | 8/1972 |
| JP | 09072738 | A | 3/1997 |
| JP | 63242483 | A | 10/1998 |
| WO | WO 97/49893 | A1 | 12/1997 |
| WO | WO 98/50673 | A1 | 11/1998 |
| WO | WO 02/057805 | A2 | 7/2002 |
| WO | WO 2004/009958 | A1 | 1/2004 |
| WO | WO 2006/008155 | A1 | 1/2006 |
| WO | WO 2006/054079 | A1 | 5/2006 |
| WO | WO 2010/060177 | A1 | 6/2010 |
| WO | 2011/041390 | | 4/2011 |

OTHER PUBLICATIONS

U.S. Appl. No. 12/543,968, filed Aug. 19, 2009, Rinzler et al.
U.S. Appl. No. 12/543,986, filed Aug. 19, 2009, Moxley et al.
U.S. Appl. No. 12/544,038, filed Aug. 19, 2009, Zediker et al.
U.S. Appl. No. 12/544,094, filed Aug. 19, 2009, Faircloth et al.
U.S. Appl. No. 12/544,136, filed Aug. 19, 2009, Zediker et al.
U.S. Appl. No. 12/706,576, filed Feb. 16, 2010, Zediker et al.
U.S. Appl. No. 12/840,978, filed Jul. 21, 2010, Rinzler et al.
U.S. Appl. No. 12/896,021, filed Oct. 1, 2010, Underwood et al.
U.S. Appl. No. 13/034,017, filed Feb. 24, 2011, Zediker et al.
U.S. Appl. No. 13/034,175, filed Feb. 24, 2011, Zediker et al.
U.S. Appl. No. 13/034,183, filed Feb. 24, 2011, Zediker et al.
U.S. Appl. No. 13/210,581, filed Aug. 16, 2011, DeWitt et al.
U.S. Appl. No. 13/211,729, filed Aug. 17, 2011, DeWitt et al.
U.S. Appl. No. 13/222,931, filed Aug. 31, 2011, Zediker et al.
U.S. Appl. No. 13/347,445, filed Jan. 10, 2012, Zediker et al.
U.S. Appl. No. 13/366,882, filed Feb. 6, 2012, McKay et al.
U.S. Appl. No. 13/403,132, filed Feb. 23, 2012, Zediker et al.
U.S. Appl. No. 13/403,287, filed Feb. 23, 2012, Grubb et al.
U.S. Appl. No. 13/403,509, filed Feb. 23, 2012, Fraze et al.
U.S. Appl. No. 13/403,615, filed Feb. 23, 2012, Grubb et al.
U.S. Appl. No. 13/403,692, filed Feb. 23, 2012, Zediker et al.
U.S. Appl. No. 13/403,723, filed Feb. 23, 2012, Rinzler et al.
U.S. Appl. No. 13/403,741, filed Feb. 23, 2012, Zediker et al.
U.S. Appl. No. 13/486,795, filed Jun. 1, 2012, Rinzler et al.
U.S. Appl. No. 13/565,345, filed Aug. 2, 2012, Zediker et al.
U.S. Appl. No. 13/777,650, filed Feb. 26, 2013, Zediker et al.
U.S. Appl. No. 13/800,559, filed Mar. 13, 2013, Zediker et al.
U.S. Appl. No. 13/800,820, filed Mar. 13, 2013, Zediker et al.
U.S. Appl. No. 13/800,879, filed Mar. 13, 2013, Zediker et al.
U.S. Appl. No. 13/800,933, filed Mar. 13, 2013, Zediker et al.
Related utility application assigned U.S. Appl. No. 13/565,345, filed Aug. 2, 2012, 112 pages.
International Search Report for PCT Application No. PCT/US09/54295, dated Apr. 26, 2010, 16 pgs.
International Search Report and Written Opinion for PCT App. No. PCT/US10/24368, dated Nov. 2, 2010, 16 pgs.
International Search Report for PCT Application No. PCT/US2012/026471, dated May 30, 2012, 13 pgs.
International Search Report for PCT Application No. PCT/US2012/026494, dated May 31, 2012, 12 pgs.
International Search Report for PCT Application No. PCT/US2012/026525, dated May 31, 2012, 8 pgs.
International Search Report for PCT Application No. PCT/US2012/026526, dated May 31, 2012, 10 pgs.
Agrawal Dinesh et al., Report on "Development of Advanced Drill Components for BHA Using Mircowave Technology Incorporating Carbide Diamond Composites and Functionally Graded Materials", believed to be published by Microwave Processing and Engineering Center, Material Research Institute, The Pennsylvania State University, 2003, 10 pgs.
Agrawal Dinesh et al., Report on "Graded Steel-Tungsten Cardide/Cobalt-Diamond Systems Using Microwave Heating", *Proceedings of the 2002 International Conference on Functionally Graded Materials*, 2002, pp. 50-58.
Agrawal Dinesh et al., "Microstructural Examination by TEM of WC/Co composites Prepared by Conventional and Microwave Processes", *15th International Plansee Seminar*, vol. 2, , 2001, pp. 677-684.
Agrawal, Govind P., "Nonlinear Fiber Optics", Chap. 9, Fourth Edition, believed to be published by Academic Press copyright 2007, pp. 334-337.
Ai, H.A. et al., "Simulation of dynamic response of granite: A numerical approach of shock-induced damage beneath impact craters", *International Journal of Impact Engineering*, vol. 33, 2006, pp. 1-10.
Anton, Richard J. et al., "Dynamic Vickers indentation of brittle materials", *Wear*, vol. 239, 2000, pp. 27-35.
Ashby, M. F. et al., "The Failure of Brittle Solids Containing Small Cracks Under Compressive Stress States", *Acta Metall.*, vol. 34, No. 3,1986, pp. 497-510.
Aydin, A. et al., "The Schmidt hammer in rock material characterization", *Engineering Geology*, vol. 81, 2005, pp. 1-14.
Baflon, Jean-Paul et al., "On the Relationship Between the Parameters of Paris' Law for Fatigue Crack Growth in Aluminium Alloys", *Scripta Metallurgica*, vol. 11, No. 12, 1977, pp. 1101-1106.
Bailo, El Tahir et al., "Spectral signatures and optic coefficients of surface and reservoir shales and limestones at COIL, $CO_2$ and Nd:YAG laser wavelengths", believed to be published by *Petroleum Engineering Department, Colorado School of Mines*, 2004, 13 pgs.
Baird, J. A. "GEODYN: A Geological Formation/Drillstring Dynamics Computer Program", *Society of Petroleum Engineers of AIME*, 1964, 9 pgs.
Baird, Jerold et al., Phase 1 Theoretical Description, A Geological Formation Drill String Dynamic Interaction Finite Element Program (GEODYN), *Sandia National Laboratories*, Report No. Sand-84-7101, 1984, 196 pgs.
Batarseh, S. et al. "Well Perforation Using High-Power Lasers", *Society of Petroleum Engineers*, SPE 84418, 2003, pp. 1-10.
Author Unknown, "Geothermal Completion Technology Life-Cycle Cost Model (GEOCOM)", believed to be published by BDM Corporation, *Sandia National Laboratories*, for the U.S. Dept. of Energy, vols. 1 and 2, 1982, 222 pgs.
Beste, U. et al., "Micro-scratch evaluation of rock types—a means to comprehend rock drill wear", *Tribology International*, vol. 37, 2004, pp. 203-210.

(56) References Cited

OTHER PUBLICATIONS

Blackwell, B. F., "Temperature Profile in Semi-infinite Body With Exponential Source and Convective Boundary Condition", *Journal of Heat Transfer, Transactions of the ASME*, vol. 112, 1990, pp. 567-571.
Britz, Dieter, "Digital Simulation in Electrochemistry", *Lect. Notes Phys.*, vol. 666, 2005, pp. 103-117.
Browning, J. A. et al., "Recent Advances in Flame Jet Working of Minerals", *7th Symposium on Rock Mechanics*, 1965, pp. 281-313.
Cardenas, R., "Protected Polycrystalline Diamond Compact Bits for Hard Rock Drilling", Report No. DOE-99049-1381, believed to be published by U.S. Department of Energy, 2000, pp. 1-79.
Carstens, Jeffrey et al., "Heat-Assisted Tunnel Boring Machines", *Federal Railroad Administration and Urban Mass Transportation Administration*, believed to be published by U.S. Dept. of Transportation, Report No. FRA-RT-71-63, 1970, 340 pgs.
Clegg, John et al., "Improved Optimisation of Bit Selection Using Mathematically Modelled Bit-Performance Indices", *IADC/SPE International 102287*, 2006, pp. 1-10.
Close, F. et al., "Successful Drilling of Basalt in a West of Shetland Deepwater Discovery", *SPE International 96575*, Society of Petroleum Engineers, 2006, pp. 1-10.
Cobern, Martin E., "Downhole Vibration Monitoring & Control System Quarterly Technical Report #1", *APS Technology, Inc.*, Quarterly Technical Report #1, DVMCS, 2003, pp. 1-15.
Cogotsi, G. A. et al., "Use of Nondestructive Testing Methods in Evaluation of Thermal Damage for Ceramics Under Conditions of Nonstationary Thermal Effects", *Institute of Strength Problems, Academy of Sciences of the Ukrainian SSR*, 1985, pp. 52-56.
Cook, Troy, "Chapter 23, Calculation of Estimated Ultimate Recovery (EUR) for Wells in Continuous-Type Oil and Gas Accumulations", *U.S. Geological Survey Digital Data Series DDS-69-D*, Denver, Colorado: Version 1, 2005, pp. 1-9.
Dahl, Filip et al., "Development of a new direct test method for estimating cutter life, based on the Sievers J miniature drill test", *Tunnelling and Underground Space Technology*, vol. 22, 2007, pp. 106-116.
Damzen, M. J. et al., "Stimulated Brillion Scattering", Chapter 8—SBS in Optical Fibres, OP Publishing Ltd, Published by Institute of Physics, London, England, 2003, pp. 137-153.
Das, A. C. et al., "Acousto-ultrasonic study of thermal shock damage in castable refractory", *Journal of Materials Science Letters*, vol. 10, 1991, pp. 173-175.
De Guire, Mark R., "Thermal Expansion Coefficient (start)", *EMSE 201—Introduction to Materials Science & Engineering*, 2003, pp. 15.1-15.15.
Dinçer, Ismail et al., "Correlation between Schmidt hardness, uniaxial compressive strength and Young's modulus for andesites, basalts and tuffs", *Bull Eng Geol Env*, vol. 63, 2004, pp. 141-148.
Dunn, James C., "Geothermal Technology Development at Sandia", believed to be published by *Geothermal Research Division, Sandia National Laboratories*, 1987, pp. 1-6.
Eichler, H.J. et al., "Stimulated Brillouin Scattering in Multimode Fibers for Optical Phase Conjugation", *Optics Communications*, vol. 208, 2002, pp. 427-431.
Eighmy, T. T. et al., "Microfracture Surface Charaterizations: Implications for In Situ Remedial Methods in Fractured Rock", believed to be published by *U.S. Environmental Protection Agency*, EPA/600/R-05/121, 2006, pp. 1-99.
Elsayed, M.A. et al., "Measurement and analysis of Chatter in a Compliant Model of a Drillstring Equipped With a PDC Bit", *Mechanical Engineering Dept.*, believed to be published by *University of Southwestern Louisiana and Sandia National Laboratories*, 2000, pp. 1-10.
Ferro, D. et al., "Vickers and Knoop hardness of electron beam deposited ZrC and HfC thin films on titanium", *Surface & Coatings Technology*, vol. 200, 2006, pp. 4701-4707.
Figueroa, H. et al., "Rock removal using high power lasers for petroleum exploitation purposes", believed to be published by *Gas Technology Institute, Colorado School of Mines, Halliburton Energy Services, Argonne National Laboratory*, 2002, pp. 1-13.
Finger, John T. et al., "PDC Bit Research at Sandia National Laboratories", believed to be published by *Sandia National Laboratories*, SAND89-0079—UC-253, 1989, pp. 1-88.
Gahan, Brian C. et al. "Analysis of Efficient High-Power Fiber Lasers for Well Perforation", *Society of Petroleum Engineers*, SPE 90661, 2004, pp. 1-9.
Gahan, Brian C. et al. "Effect of Downhole Pressure Conditions on High-Power Laser Perforation", *Society of Petroleum Engineers*, SPE 97093, 2005, pp. 1-7.
Gahan, B. C. et al., "Laser Drilling: Determination of Energy Required to Remove Rock", *Society of Petroleum Engineers International*, SPE 71466, 2001, pp. 1-11.
Gahan, Brian C. et al., "Laser Drilling: Drilling with the Power of Light, Phase 1: Feasibility Study", *Topical Report*, Cooperative Agreement No. DE-FC26-00NT40917, 2000-2001, pp. 1-148.
Glowka, David A., "Design Considerations for a Hard-Rock PDC Drill Bit", believed to be published by *Sandia National Laboratories*, SAND-85-0666C, DE85 008313, 1985, pp. 1-23.
Glowka, David A., "Development of a Method for Predicting the Performance and Wear of PDC Drill Bits", believed to be published by *Sandia National Laboratories*, SAND86-1745-UC-66c, 1987, pp. 1-206.
Glowka, David A. et al., "Program Plan for the Development of Advanced Synthetic-Diamond Drill Bits for Hard-Rock Drilling", believed to be published by *Sandia National Laboratories*, SAND 93-1953, 1993, pp. 1-50.
Glowka, David A. et al., "Progress in the Advanced Synthetic-Diamond Drill Bit Program", believed to be published by *Sandia National Laboratories*, SAND95-2617C, 1994, pp. 1-9.
Glowka, David A., "The Use of Single—Cutter Data in the Analysis of PDC Bit Designs", *61st Annual Technical Conference and Exhibition of Society of Petroleum Engineers*, 1986, pp. 1-37.
Graves, Ramona M. et al., "Application of High Power Laser Technology to Laser/Rock Destruction: Where Have We Been? Where Are We Now?", *SW AAPG Convention*, 2002, pp. 213-224.
Graves, Ramona M. et al., "Laser Parameters That Effect Laser-Rock Interaction: Determining the Benefits of Applying Star Wars Laser Technology for Drilling and Completing Oil and Natural Gas Wells", Topical Report, believed to be published by *Petroleum Engineering Department, Colorado School of Mines*, 2001, pp. 1-157.
Gurarie, V. N., "Stress resistance parameters of brittle solids under laser/plasma pulse heating", *Materials Science and Engineering*, vol. A288, 2000, pp. 168-172.
Habib, P. et al., "The Influence of Residual Stresses on Rock Hardness", *Rock Mechanics*, vol. 6, 1974, pp. 15-24.
Hall, Kevin, "The role of thermal stress fatigue in the breakdown of rock in cold regions", *Geomorphology*, vol. 31, 1999, pp. 47-63.
Han, Wei, "Computational and experimental investigations of laser drilling and welding for microelectronic packaging", *Dorchester Polytechnic Institute*, A Dissertation submitted in May 2004, pp. 1-242.
Hareland, G. et al., "Cutting Efficiency of a Single PDC Cutter on Hard Rock", *Journal of Canadian Petroleum Technology*, vol. 48, No. 6, 2009, pp. 1-6.
Hashida, T. et al., "Numerical simulation with experimental verification of the fracture behavior in granite under confining pressures based on the tension-softening model", *International Journal of Fracture*, vol. 59, 1993, pp. 227-244.
Healy, Thomas E., "Fatigue Crack Growth in Lithium Hydride", believed to be published by *Lawrence Livermore National Laboratory*, 1993, pp. 1-32.
Hettema, M. H. H. et al., "The Influence of Steam Pressure on Thermal Spalling of Sedimentary Rock: Theory and Experiments", *Int. J. Rock Mech. Min. Sci.*, vol. 35, No. 1, 1998, pp. 3-15.
Hibbs, Louis E. et al., "Wear Mechanisms for Polycrystalline-Diamond Compacts as Utilized for Drilling in Geothermal Environments", believed to be published by *Sandia National Laboratories*, for The United States Government, Report No. SAND-82-7213, 1983, 287 pgs.

(56) References Cited

OTHER PUBLICATIONS

Hoek, E., "Fracture of Anisotropic Rock", *Journal of the South African Institute of Mining and Metallurgy*, vol. 64, No. 10, 1964, pp. 501-523.
Hoover, Ed R. et al., "Failure Mechanisms of Polycrystalline-Diamond Compact Drill Bits in Geothermal Environments", Sandia Report, believed to be published by *Sandia National Laboratories*, SAND81-1404, 1981, pp. 1-35.
Huff, C. F. et al., "Recent Developments in Polycrystalline Diamond-Drill-Bit Design", believed to be published by *Sandia National Laboratories*, 1980, pp. 1-29.
Jimeno, Carlos Lopez et al., Drilling and Blasting of Rocks, *a. a. Balkema* Publishers, 1995, 30 pgs.
Kahraman, S. et al., "Dominant rock properties affecting the penetration rate of percussive drills", *International Journal of Rock Mechanics and Mining Sciences*, 2003, vol. 40, pp. 711-723.
Kelsey, James R., "Drilling Technology/GDO", believed to be published by *Sandia National Laboratories*, SAND-85-1866c, DE85 017231, 1985, pp. 1-7.
Kerr, Callin Joe, "PDC Drill Bit Design and Field Application Evolution", *Journal of Petroleum Technology*, 1988, pp. 327-332.
Ketata, C. et al., "Knowledge Selection for Laser Drilling in the Oil and Gas Industry", *Computer Society*, 2005, pp. 1-6.
Khan, Ovais U. et al., "Laser heating of sheet metal and thermal stress development", *Journal of Materials Processing Technology*, vol. 155-156, 2004, pp. 2045-2050.
Kim, K. R. et al., "$CO_2$ laser-plume interaction in materials processing", *Journal of Applied Physics*, vol. 89, No. 1, 2001, pp. 681-688.
Klotz, K. et al., "Coatings with intrinsic stress profile: Refined creep analysis of (Ti,A1)N and cracking due to cyclic laser heating", *Thin Solid Films*, vol. 496, 2006, pp. 469-474.
Kobayashi, Toshio et al., "Drilling a 2-inch in Diameter Hole in Granites Submerged in Water by $CO_2$ Lasers", *SPE International, IADC 119914 Drilling Conference and Exhibition*, 2009, pp. 1-11.
Kubacki, Emily et al., "Optics for Fiber Laser Applications", believed to be published by *CVI Laser, LLC*, Technical Reference Document #20050415, 2005, 5 pgs.
Kujawski, Daniel, "A fatigue crack driving force parameter with load ratio effects", *International Journal of Fatigue*, vol. 23, 2001, pp. S239-S246.
Labuz, J. F. et al., "Microrack-dependent fracture of damaged rock", *International Journal of Fracture*, vol. 51, 1991, pp. 231-240.
Lacy, Lewis L., "Dynamic Rock Mechanics Testing for Optimized Fracture Designs", *Society of Petroleum Engineers International, Annual Technical Conference and Exhibition*, 1997, pp. 23-36.
Lally, Evan M., "A Narrow-Linewidth Laser at 1550 nm Using the Pound-Drever-Hall Stabilization Technique", *Thesis*, submitted to Virginia Polytechnic Institute and State University, Blacksburg, Virginia, 2006, 92 pgs.
Lau, John H., "Thermal Fatigue Life Prediction of Flip Chip Solder Joints by Fracture Mechanics Method", *Engineering Fracture Mechanics*, vol. 45, No. 5, 1993, pp. 643-654.
Leong, K. H. et al., "Lasers and Beam Delivery for Rock Drilling", believed to be published by *Argonne National Laboratory*, ANL/TD/TM03-01, 2003, pp. 1-35.
Leung, M. et al., "Theoretical study of heat transfer with moving phase-change interface in thawing of frozen food", *Journal of Physics D: Applied Physics*, vol. 38, 2005, pp. 477-482.
Lima, R. S. et al., "Elastic Modulus Measurements via Laser-Ultrasonic and Knoop Indentation Techniques in Thermally Sprayed Coatings", *Journal of Thermal Spray Technology*, vol. 14(1), 2005, pp. 52-60.
Lin, Y. T., "The Impact of Bit Performance on Geothermal-Well Cost", believed to be published by *Sandia National Laboratories*, SAND-81-1470C, 1981, pp. 1-6.
Lomov, I. N. et al., "Explosion in the Granite Field: Hardening and Softening Behavior in Rocks".
Long, S. G. et al., "Thermal fatigue of particle reinforced metal-matrix composite induced by laser heating and mechanical load", *Composites Science and Technology*, vol. 65, 2005, pp. 1391-1400.
Lyons, K. David et al., "NETL Extreme Drilling Laboratory Studies High Pressure High Temperature Drilling Phenomena", believed to be published by *National Energy Technology Laboratory*, 2007, pp. 1-6.
McElhenny, John E. et al., "Unique Characteristic Features of Stimulated Brillouin Scattering in Small-Core Photonic Crystal Fibers", *J. Opt. Soc. Am. B*, vol. 25, No. 4, 2008, pp. 582-593.
Marshall, David B. et al., "Indentation of Brittle Materials", *Microindentation Techniques in Materials Science and Engineering, ASTM STP 889; American Society for Testing and Materials*, 1986, pp. 26-46.
Maurer, William C., "Advanced Drilling Techniques", published by Petroleum Publishing Co., copyright 1980, 26 pgs.
Maurer, William C., "Novel Drilling Techniques", published by Pergamon Press, UK, copyright 1968, pp. 1-64.
Mazerov, Katie, "Bigger coil sizes, hybrid rigs, rotary steerable advances push coiled tubing drilling to next level", *Drilling Contractor*, 2008, pp. 54-60.
Medvedev, I. F. et al., "Optimum Force Characteristics of Rotary-Percussive Machines for Drilling Blast Holes", Moscow, Translated from *Fiziko-Tekhnicheskie Problemy Razrabotki Poleznykh Iskopaemykh*, No. 1, 1967, pp. 77-80.
Mensa-Wilmot, Graham et al., "Advanced Cutting Structure Improves PDC Bit Performance in Hard and Abrasive Drilling Environments", *Society of Petroleum Engineers International*, 2003, pp. 1-13.
Messaoud, Louafi, "Influence of Fluids on the Essential Parameters of Rotary Percussive Drilling", *Laboratoire d'Environnement (Tébessa)*, vol. 14, 2009, pp. 1-8.
Mocofanescu, A. et al., "SBS threshold for single mode and multimode GRIN fibers in an all fiber configuration", *Optics Express*, vol. 13, No. 6, 2005, pp. 2019-2024.
Moradian, Z. A. et al., "Predicting the Uniaxial Compressive Strength and Static Young's Modulus of Intact Sedimentary Rocks Using the Ultrasonic Test", *International Journal of Geomechanics*, vol. 9, No. 1, 2009, pp. 14-19.
Muto, Shigeki et al., "Laser cutting for thick concrete by multi-pass technique", *Chinese Optics Letters*, vol. 5 Supplement, 2007, pp. S39-S41.
Naqavi, I. Z. et al., "Laser heating of multilayer assembly and stress levels: elasto-plastic consideration", *Heat and Mass Transfer*, vol. 40, 2003, pp. 25-32.
Nara, Y. et al., "Sub-critical crack growth in anisotropic rock", *International Journal of Rock Mechanics and Mining Sciences*, vol. 43, 2006, pp. 437-453.
Nemat-Nasser, S. et al., "Compression-Induced Nonplanar Crack Extension With Application to Splitting, Exfoliation, and Rockburst", *Journal of Geophysical Research*, vol. 87, No. B8, 1982, pp. 6805-6821.
O'Hare, Jim et al., "Design Index: A Systematic Method of PDC Drill-Bit Selection", *Society of Petroleum Engineers International*, IADC/SPE Drilling Conference, 2000, pp. 1-15.
Okon, P. et al., "Laser Welding of Aluminium Alloy 5083", *21st International Congress on Applications of Lasers and Electro-Optics*, 2002, pp. 1-9.
Ortega, Alfonso et al., "Frictional Heating and Convective Cooling of Polycrystalline Diamond Drag Tools During Rock Cutting", Report No. SAND 82-0675c, believed to be published by *Sandia National Laboratories*, 1982, 23 pgs.
Ortega, Alfonso et al., "Studies of the Frictional Heating of Polycrystalline Diamond Compact Drag Tools During Rock Cutting", believed to be published by *Sandia National Laboratories*, SAND-80-2677, 1982, pp. 1-151.
Ortiz, Blas et al., Improved Bit Stability Reduces Downhole Harmonics (Vibrations), *International Association of Drilling Contractors/Society of Petroleum Engineers Inc.*, 1996, pp. 379-389.
Palashchenko, Yuri A., "Pure Rolling of Bit Cones Doubles Performance", *I & Gas Journal*, vol. 106, 2008, 8 pgs.

(56) References Cited

OTHER PUBLICATIONS

Pardoen, T. et al., "An extended model for void growth and Coalescence", *Journal of the Mechanics and Physics of Solids*, vol. 48, 2000, pp. 2467-2512.
Park, Un-Chul et al., "Thermal Analysis of Laser Drilling Processes", *IEEE Journal of Quantum Electronics*, 1972, vol. QK-8, No. 2, 1972, pp. 112-119.
Parker, Richard A. et al., "Laser Drilling Effects of Beam Application Methods on Improving Rock Removal", *Society of Petroleum Engineers*, SPE 84353, 2003, pp. 1-7.
Pavlina, E. J. et al., "Correlation of Yield Strength and Tensile Strength with Hardness for Steels", *Journals of Materials Engineering and Performance*, vol. 17, No. 6, 2008, pp. 888-893.
Ping, Cao et al., "Testing study of subcritical crack growth rate and fracture toughness in different rocks", *Transactions of Nonferrous Metals Society of China*, vol. 16, 2006, pp. 709-714.
Plinninger, Ralf J. et al., "Predicting Tool Wear in Drill and Blast", *Tunnels & Tunneling International Magazine*, 2002, pp. 1-5.
Plinninger, Dr. Ralf J. et al., "Wear Prediction in Hardrock Excavation Using the CERCHAR Abrasiveness Index (CAI)", *EUROCK 2004 & 53rd Geomechanics Colloquium. Schubert* (ed.), VGE, 2004, pp. 1-6.
Polsky, Yarom et al., "Enhanced Geothermal Systems (EGS) Well Construction Technology Evaluation Report", believed to be published by *Sandia National Laboratories*, Sandia Report, SAND2008-7866, 2008, pp. 1-108.
Pooniwala, Shahvir, "Lasers: The Next Bit", *Society of Petroleum Engineers*, No. SPE 104223, 2006, pp. 1-10.
Potyondy, D. O. et al., "A Bonded-particle model for rock", *International Journal of Rock Mechanics and Mining Sciences*, vol. 41, 2004, pp. 1329-1364.
Qixian, Luo et al., "Using compression wave ultrasonic transducers to measure the velocity of surface waves and hence determine dynamic modulus of elasticity for concrete", *Construction and Building Materials*, vol. 10, No. 4, 1996, pp. 237-242.
Radkte, Robert, "New High Strength and faster Drilling TSP Diamond Cutters", Report by *Technology International, Inc.*, DOE Award No. DE-FC26-97FT34368, 2006, 97 pgs.
Rauenzahn, R. M., "Analysis of Rock Mechanics and Gas Dynamics of Flame-Jet Thermal Spallation Drilling", believed to be published by *Massachusetts Institute of Technology*, submitted in partial fulfillment of doctorate degree, 1986, pp. 1-583.
Rauenzahn, R. M. et al., "Rock Failure Mechanisms of Flame-Jet Thermal Spallation Drilling-Theory and Experimental Testing", *Int. J. Rock Merch. Min. Sci. & Geomech. Abstr.*, vol. 26, No. 5, 1989, pp. 381-399.
Raymond, David W., "PDC Bit Testing at Sandia Reveals Influence of Chatter in Hard-Rock Drilling", *Geothermal Resources Council Monthly Bulletin*, SAND99-2655J, 1999, 7 pgs.
Rossmanith, H. P. et al., "Wave Propagation, Damage Evolution, and Dynamic Fracture Extension. Part I. Percussion Drilling", *Materials Science*, vol. 32, No. 3, 1996, pp. 350-358.
Sachpazis, C. I, M. Sc., Ph. D., "Correlating Schmidt Hardness With Compressive Strength and Young's Modulus of Carbonate Rocks", *International Association of Engineering Geology*, Bulletin, No. 42, 1990, pp. 75-83.
Sano, Osam et al., "Acoustic Emission During Slow Crack Growth", believed to be published by *Department Mining and Mineral Engineering, NII-Electronic Library Service*, 1980, pp. 381-388.
Schormair, Nik et al., "The influence of anisotropy on hard rock drilling and cutting", *The Geological Society of London, IAEG*, Paper No. 491, 2006, pp. 1-11.
Shannon, G. J. et al., "High power laser welding in hyperbaric gas and water environments", *Journal of Laser Applications*, vol. 9, 1997, pp. 129-136.
Shuja, S. Z. et al., "Laser heating of semi-infinite solid with consecutive pulses: Influence of materaial properties on temperature field", *Optics & Laser Technology*, vol. 40, 2008, pp. 472-480.
Smith, E., "Crack Propagation at a Constant Crack Tip Stress Intensity Factor", *Int. Journal of Fracture*, vol. 16, 1980, pp. R215-R218.
Solomon, A. D. et al., "Moving Boundary Problems in Phase Change Models Current Research Questions", *Engineering Physics and Mathematics Division*, ACM Signum Newsletter, vol. 20, Issue 2, 1985, pp. 8-12.
Sousa, Luis M. O. et al., "Influence of microfractures and porosity on the physico-mechanical properties and weathering of ornamental granites", *Engineering Geology*, vol. 77, 2005, pp. 153-168.
Stone, Charles M. et al., "Qualification of a Computer Program for Drill String Dynamics", believed to be published by *Sandia National Laboratories*, SAND-85-0633C, 1985, pp. 1-20.
Takarli, Mokhfi et al., "Damage in granite under heating/cooling cycles and water freeze-thaw condition", *International Journal of Rock Mechanics and Mining Sciences*, vol. 45, 2008, pp. 1164-1175.
Tanaka, K. et al., "The Generalized Relationship Between the Parameters C and m of Paris' Law for Fatigue Crack Growth", *Scripta Metallurgica*, vol. 15, No. 3, 1981, pp. 259-264.
Tang, C. A. et al., "Coupled analysis of flow, stress and damage (FSD) in rock failure", *International Journal of Rock Mechanics and Mining Sciences*, vol. 39, 2002, pp. 477-489.
Thorsteinsson, Hildigunnur et al., "The Impacts of Drilling and Reservoir Technology Advances on EGS Exploitation", *Proceedings, Thirty-Third Workshop on Geothermal Reservoir Engineering, Institute for Sustainable Energy, Environment, and Economy* (*ISEEE*), 2008, pp. 1-14.
Author unknown, "Chapter 6—Drilling Technology and Costs, from Report for the Future of Geothermal Energy", believed to be published by the U.S. Dept. of Energy, 2005, 53 pgs.
Varnado, S. G. et al., "The Design and Use of Polycrystalline Diamond Compact Drag Bits in The Geothermal Environment", *Society of Petroleum Engineers of AIME*, SPE 8378, 1979, pp. 1-11.
Wen-gui, Cao et al., "Damage constituitive model for strain-softening rock based on normal distribution and its parameter determination", *J. Cent. South Univ. Technol.*, vol. 14, No. 5, 2007, pp. 719-724.
Wiercigroch, M., "Dynamics of ultrasonic percussive drilling of hard rocks", *Journal of Sound and Vibration*, vol. 280, 2005, pp. 739-757.
Williams, R. E. et al., "Experiments in Thermal Spallation of Various Rocks", *Transactions of the ASME*, vol. 118, 1996, pp. 2-8.
Willis, David A. et al., "Heat transfer and phase change during picosecond laser ablation of nickel", *International Journal of Heat and Mass Transfer*, vol. 45, 2002, pp. 3911-3918.
Wong, Teng-fong et al., "Microcrack statistics, Weibull distribution and micromechanical modeling of compressive failure in rock", *Mechanics of Materials*, vol. 38, 2006, pp. 664-681.
Wood, Tom, "Dual Purpose COTD™ Rigs Establish New Operational Records", believed to be published by *Treme Coil Drilling Corp., Drilling Technology Without Borders*, 2009, pp. 1-18.
Xia, K. et al., "Effects of microstructures on dynamic compression of Barre granite", *International Journal of Rock Mechanics and Mining Sciences*, vol. 45, 2008. pp. 879-887, available at: www.sciencedirect.com.
Xu, Zhiyue et al., "Laser Spallation of Rocks for Oil Well Drilling", *Proceedings of the 23rd International Congress on Applications of Lasers and Electro-Optics*, 2004, pp. 1-6.
Xu, Z et al. "Modeling of Laser Spallation Drilling of Rocks fro gas- and Oilwell Drilling", *Society of Petroleum Engineers*, SPE 95746, 2005, pp. 1-6.
Xu, Z. et al., "Specific Energy for Laser Removal of Rocks", *Proceedings of the 20th International Congress on Applications of Lasers & Electro-Optics*, 2001, pp. 1-8.
Xu, Z. et al., "Specific energy for pulsed laser rock drilling", *Journal of Laser Applications*, vol. 15, No. 1, 2003, pp. 25-30.
Yamshchikov, V. S. et al., "An Evaluation of the Microcrack Density of Rocks by Ultrasonic Velocimetric Method", believed to be published by Moscow Mining Institute. (*Translated from Fiziko-Tekhnicheskie Problemy Razrabotki Poleznykh Iskopaemykh*), 1985, pp. 363-366.

(56) References Cited

OTHER PUBLICATIONS

Yilbas, B. S. et al., "Laser short pulse heating: Influence of pulse intensity on temperature and stress fields", *Applied Surface Science*, vol. 252, 2006, pp. 8428-8437.
Yilbas, B. S. et al., "Laser treatment of aluminum surface: Analysis of thermal stress field in the irradiated region", *Journal of Materials Processing Technology*, vol. 209, 2009, pp. 77-88.
Yilbas, B. S. et al., "Nano-second laser pulse heating and assisting gas jet considerations", *International Journal of Machine Tools & Manufacture*, vol. 40, 2000, pp. 1023-1038.
Yilbas, B. S. et al., "Repetitive laser pulse heating with a convective boundary condition at the surface", *Journal of Physics D: Applied Physics*, vol. 34, 2001, pp. 222-231.
Yun, Yingwei et al., "Thermal Stress Distribution in Thick Wall Cylinder Under Thermal Shock", *Journal of Pressure Vessel Technology, Transactions of the ASME*, 2009, vol. 131, pp. 1-6.
Zeuch, D.H. et al., "Rock Breakage Mechanism Wirt a PDC Cutter", *Society of Petroleum Engineers, 60th Annual Technical Conference*, Las Vegas, Sep. 22-25, 1985, 11 pgs.
Zhai, Yue et al., "Dynamic failure analysis on granite under uniaxial impact compressive load", *Front. Archit. Civ. Eng. China*, vol. 2, No. 3, 2008, pp. 253-260.
Zhou, X.P., "Microcrack Interaction Brittle Rock Subjected to Uniaxial Tensile Loads, *Theoretical and Applied Fracture Mechanics*", vol. 47, 2007, pp. 68-76.
Zhou, Zehua et al., "A New Thermal-Shock-Resistance Model for Ceramics: Establishment and validation, *Materials Science and Engineering*", A 405, 2005, pp. 272-276.
Zhu, Dongming et al., "Influence of High Cycle Thermal Loads on Thermal Fatigue Behavior of Thick Thermal Barrier Coatings", believed to be published by *National Aeronautics and Space Administration, Army Research Laboratory*, Technical Report ARL-TR-1341, NASA TP-3676, 1997, pp. 1-50.
Zhu, Dongming et al., "Investigation of thermal fatigue behavior of thermal barrier coating systems", *Surface and Coatings Technology*, vol. 94-95, 1997, pp. 94-101.
Zhu, Dongming et al., "Investigation of Thermal High Cycle and Low Cycle Fatigue Mechanisms of Thick Thermal Barrier Coatings", believed to be published by *National Aeronautics and Space Administration, Lewis Research Center*, NASA/TM-1998-206633, 1998, pp. 1-31.
Zhu, Dongming et al., "Thermophysical and Thermomechanical Properties of Thermal Barrier Coating Systems", believed to be published by *National Aeronautics and Space Administration, Glenn Research Center*, NASA/TM-2000-210237, 2000, pp. 1-22.
Author unknown, "A Built-for-Purpose Coiled Tubing Rig", believed to be published by Schulumberger Wells,No. DE-PS26-03NT15474, 2006, p. 18.
Author unknown, "Diamond-Cutter Drill Bits", believed to be published by Geothermal Energy Program, Office of Geothermal and Wind Technologies, 2000, 2 pages.
Author unknown, "Introducing the XTC200DTR Plus", believed to be published by Extreme Drilling Corporation, 2009, 10 pages.
Author unknown, "IADC Dull Grading System for Fixed Cutter Bits", believed to be published by Hughes Christensen, 1996, 14 pages.
Author unknown, "Percussion Drilling Manual Impax™ Hammer Bit", by Smith Tool, 2002, 67 pages.
Author unknown, "Simple Drilling Methods", believed to be published by WEDC Loughborough University, United Kingdom, 1995, pp. 41-44.
Author unknown, "Capital Drilling Equipment Brochure", believed to be published by GE Oil & Gas Business, 2008, 15 pages.
Chastain, T. et al., "Deep Water Drilling System", *SPE Drilling Engineering*, Aug. 1986, pp. 325-328.
Author unknown, "Drilling Systems: Reliable to the Extremes", believed to be published by GE Oil & Gas (Drilling & Production) Brochure, 2009, 15 pages.
Author unknown, "Forensic Examination of Deepwater Horizon Blowout Preventer", a DNV (Det Norske Veritas) report for US Department of the Interior, Bureau of Ocean Energy Management, Regulation, and Enforcement, Mar. 20, 2011, 200 pages.
Author unknown, "Mini Shear Study", a West Engineering Services, Inc. Case Study for U.S. Minerals Management Services, Dec. 2002, pp. 1-16.
Author unknown, "Shear Ram Blowout Preventer Forces Required", believed to be published by Barringer and Associates, Inc., 2010, 17 pages.
Author unknown, "Shear Ram Capabilities Study", a West Engineering Services Study for US Minerals Management Services, Sep. 2004, 61 pages.
Related utility application assigned U.S. Appl. No. 13/777,650, filed Feb. 26, 2013, 73 pages.
Related utility application assigned U.S. Appl. No. 13/800,559, filed Mar. 13, 2013, 73 pages.
Related utility application assigned U.S. Appl. No. 13/800,820, filed Mar. 13, 2013, 73 pages.
Related utility application assigned U.S. Appl. No. 13/800,879, filed Mar. 13, 2013, 73 pages.
Related utility application assigned U.S. Appl. No. 13/800,933, filed Mar. 13, 2013, 73 pages.
U.S. Appl. No. 14/270,288, filed May 2014, Zediker et al.
International Search Report and the Written Opinion of the International Searching Authority, or the Declaration from PCT/US14/29375, dated Nov. 25, 2014.
U.S. Appl. No. 14/214,112, filed Mar. 14, 2014, Zediker et al.
U.S. Appl. No. 14/213,212, filed Mar. 14, 2014, Zediker et al.
U.S. Appl. No. 14/105,949, filed Dec. 13, 2013, Deutch et al.
Muto, et al., "Laser cutting for thick concrete by multi-pass technique," *Chinese Optics Letters* May 31, 2007, vol. 5, pp. S39-S41.

* cited by examiner

REDUCED MECHANICAL ENERGY WELL CONTROL SYSTEMS AND METHODS OF USE

This application: (i) claims, under 35 U.S.C. §119(e)(1), the benefit of the filing date of Sep. 1, 2012, of provisional application Ser. No. 61/696,142, (ii) is a continuation-in-part of U.S. patent application Ser. No. 13/034,175, filed Feb. 24, 2011; (iii) is a continuation-in-part of U.S. patent application Ser. No. 13/034,183 filed Feb. 24, 2011; (iv) is a continuation-in-part of U.S. patent application Ser. No. 13/034,017 filed Feb. 24, 2011; and, (v) is a continuation-in-part of patent application Ser. No. 13/034,037 filed Feb. 24, 2011, the entire disclosures of each of which is incorporated herein by reference.

BACKGROUND OF THE INVENTION

Field of the Invention

The present inventions relate to the delivery of high power directed energy for use in well control systems.

As used herein, unless specified otherwise "high power laser energy" means a laser beam having at least about 1 kW (kilowatt) of power. As used herein, unless specified otherwise "great distances" means at least about 500 m (meter). As used herein, unless specified otherwise, the term "substantial loss of power," "substantial power loss" and similar such phrases, mean a loss of power of more than about 3.0 dB/km (decibel/kilometer) for a selected wavelength. As used herein the term "substantial power transmission" means at least about 50% transmittance.

As used herein the term "earth" should be given its broadest possible meaning, and includes, the ground, all natural materials, such as rocks, and artificial materials, such as concrete, that are or may be found in the ground, including without limitation rock layer formations, such as, granite, basalt, sandstone, dolomite, sand, salt, limestone, rhyolite, quartzite and shale rock.

As used herein the term "borehole" should be given it broadest possible meaning and includes any opening that is created in a material, a work piece, a surface, the earth, a structure (e.g., building, protected military installation, nuclear plant, offshore platform, or ship), or in a structure in the ground, (e.g., foundation, roadway, airstrip, cave or subterranean structure) that is substantially longer than it is wide, such as a well, a well bore, a well hole, a micro hole, slimhole and other terms commonly used or known in the arts to define these types of narrow long passages. Wells would further include exploratory, production, abandoned, reentered, reworked, and injection wells.

As used herein the term "drill pipe" is to be given its broadest possible meaning and includes all forms of pipe used for drilling activities; and refers to a single section or piece of pipe. As used herein the terms "stand of drill pipe," "drill pipe stand," "stand of pipe," "stand" and similar type terms should be given their broadest possible meaning and include two, three or four sections of drill pipe that have been connected, e.g., joined together, typically by joints having threaded connections. As used herein the terms "drill string," "string," "string of drill pipe," string of pipe" and similar type terms should be given their broadest definition and would include a stand or stands joined together for the purpose of being employed in a borehole. Thus, a drill string could include many stands and many hundreds of sections of drill pipe.

As used herein the term "tubular" is to be given its broadest possible meaning and includes drill pipe, casing, riser, coiled tube, composite tube, vacuum insulated tubing ("VIT), production tubing and any similar structures having at least one channel therein that are, or could be used, in the drilling industry. As used herein the term "joint" is to be given its broadest possible meaning and includes all types of devices, systems, methods, structures and components used to connect tubulars together, such as for example, threaded pipe joints and bolted flanges. For drill pipe joints, the joint section typically has a thicker wall than the rest of the drill pipe. As used herein the thickness of the wall of tubular is the thickness of the material between the internal diameter of the tubular and the external diameter of the tubular.

As used herein, unless specified otherwise the terms "blowout preventer," "BOP," and "BOP stack" should be given their broadest possible meaning, and include: (i) devices positioned at or near the borehole surface, e.g., the surface of the earth including dry land or the seafloor, which are used to contain or manage pressures or flows associated with a borehole; (ii) devices for containing or managing pressures or flows in a borehole that are associated with a subsea riser or a connector; (iii) devices having any number and combination of gates, valves or elastomeric packers for controlling or managing borehole pressures or flows; (iv) a subsea BOP stack, which stack could contain, for example, ram shears, pipe rams, blind rams and annular preventers; and, (v) other such similar combinations and assemblies of flow and pressure management devices to control borehole pressures, flows or both and, in particular, to control or manage emergency flow or pressure situations.

As used herein, unless specified otherwise "offshore" and "offshore drilling activities" and similar such terms are used in their broadest sense and would include drilling activities on, or in, any body of water, whether fresh or salt water, whether manmade or naturally occurring, such as for example rivers, lakes, canals, inland seas, oceans, seas, bays and gulfs, such as the Gulf of Mexico. As used herein, unless specified otherwise the term "offshore drilling rig" is to be given its broadest possible meaning and would include fixed towers, tenders, platforms, barges, jack-ups, floating platforms, drill ships, dynamically positioned drill ships, semi-submersibles and dynamically positioned semi-submersibles. As used herein, unless specified otherwise the term "seafloor" is to be given its broadest possible meaning and would include any surface of the earth that lies under, or is at the bottom of, any body of water, whether fresh or salt water, whether manmade or naturally occurring.

As used herein, unless specified otherwise the term "fixed platform," would include any structure that has at least a portion of its weight supported by the seafloor. Fixed platforms would include structures such as: free-standing caissons, well-protector jackets, pylons, braced caissons, piled-jackets, skirted piled-jackets, compliant towers, gravity structures, gravity based structures, skirted gravity structures, concrete gravity structures, concrete deep water structures and other combinations and variations of these. Fixed platforms extend from at or below the seafloor to and above the surface of the body of water, e.g., sea level. Deck structures are positioned above the surface of the body of water a top of vertical support members that extend down in to the water to the seafloor.

Discussion of Related Art

Deep Water Drilling

Offshore hydrocarbon exploration and production has been moving to deeper and deeper waters. Today drilling activities at depths of 5000 ft, 10,000 ft and even greater depths are contemplated and carried out. For example, its has been reported by RIGZONE, www.rigzone.com, that there are over 330 rigs rated for drilling in water depths greater than 600 ft (feet), and of those rigs there are over 190 rigs rated for drilling in water depths greater than 5,000 ft, and of those rigs over 90 of them are rated for drilling in water depths of 10,000 ft. When drilling at these deep, very-deep and ultra-deep depths the drilling equipment is subject to the extreme conditions found in the depths of the ocean, including great pressures and low temperatures at the seafloor.

Further, these deep water drilling rigs are capable of advancing boreholes that can be 10,000 ft, 20,000 ft, 30,000 ft and even deeper below the sea floor. As such, the drilling equipment, such as drill pipe, casing, risers, and the BOP are subject to substantial forces and extreme conditions. To address these forces and conditions drilling equipment, for example, risers, drill pipe and drill strings, are designed to be stronger, more rugged, and in may cases heavier. Additionally, the metals that are used to make drill pipe and casing have become more ductile.

Typically, and by way of general illustration, in drilling a subsea well an initial borehole is made into the seabed and then subsequent and smaller diameter boreholes are drilled to extend the overall depth of the borehole. Thus, as the overall borehole gets deeper its diameter becomes smaller; resulting in what can be envisioned as a telescoping assembly of holes with the largest diameter hole being at the top of the borehole closest to the surface of the earth.

Thus, by way of example, the starting phases of a subsea drill process may be explained in general as follows. Once the drilling rig is positioned on the surface of the water over the area where drilling is to take place, an initial borehole is made by drilling a 36" hole in the earth to a depth of about 200-300 ft. below the seafloor. A 30" casing is inserted into this initial borehole. This 30" casing may also be called a conductor. The 30" conductor may or may not be cemented into place. During this drilling operation a riser is generally not used and the cuttings from the borehole, e.g., the earth and other material removed from the borehole by the drilling activity, are returned to the seafloor. Next, a 26" diameter borehole is drilled within the 30" casing, extending the depth of the borehole to about 1,000-1,500 ft. This drilling operation may also be conducted without using a riser. A 20" casing is then inserted into the 30" conductor and 26" borehole. This 20" casing is cemented into place. The 20" casing has a wellhead secured to it. (In other operations an additional smaller diameter borehole may be drilled, and a smaller diameter casing inserted into that borehole with the wellhead being secured to that smaller diameter casing.) A blowout preventer ("BOP") is then secured to a riser and lowered by the riser to the sea floor; where the BOP is secured to the wellhead. From this point forward, in general, all drilling activity in the borehole takes place through the riser and the BOP.

The BOP, along with other equipment and procedures, is used to control and manage pressures and flows in a well. In general, a BOP is a stack of several mechanical devices that have a connected inner cavity extending through these devices. BOP's can have cavities, e.g., bore diameters ranging from about 4⅛" to 26¾." Tubulars are advanced from the offshore drilling rig down the riser, through the BOP cavity and into the borehole. Returns, e.g., drilling mud and cuttings, are removed from the borehole and transmitted through the BOP cavity, up the riser, and to the offshore drilling rig. The BOP stack typically has an annular preventer, which is an expandable packer that functions like a giant sphincter muscle around a tubular. Some annular preventers may also be used or capable of sealing off the cavity when a tubular is not present. When activated, this packer seals against a tubular that is in the BOP cavity, preventing material from flowing through the annulus formed between the outside diameter of the tubular and the wall of the BOP cavity. The BOP stack also typically has ram preventers. As used herein, unless specified otherwise, the terms "ram preventer" and "ram" are to be given its broadest definition and would include any mechanical devices that clamp, grab, hold, cut, sever, crush, or combinations thereof, a tubular within a BOP stack, such as shear rams, blind rams, blind-shear rams, pipe rams, variable rams, variable pipe rams, casing shear rams, and preventers such as Hydril's HYDRIL PRESSURE CONTROL COMPACT Ram, Hydril Pressure Control Conventional Ram, HYDRIL PRESSURE CONTROL QUICK-LOG, and HYDRIL PRESSURE CONTROL SENTRY Workover, SHAFFER ram preventers, and ram preventers made by Cameron.

Thus, the BOP stack typically has a pipe ram preventer and my have more than one of these. Pipe ram preventers typically are two half-circle like clamping devices that are driven against the outside diameter of a tubular that is in the BOP cavity. Pipe ram preventers can be viewed as two giant hands that clamp against the tubular and seal-off the annulus between the tubular and the BOP cavity wall. Blind ram preventers may also be contained in the BOP stack, these rams can seal the cavity when no tubulars are present.

Pipe ram preventers and annular preventers typically can only seal the annulus between a tubular in the BOP and the BOP cavity; they cannot seal-off the tubular. Thus, in emergency situations, e.g., when a "kick" (a sudden influx of gas, fluid, or pressure into the borehole) occurs, or if a potential blowout situations arises, flows from high downhole pressures can come back up through the inside of the tubular, the annulus between the tubular and riser, and up the riser to the drilling rig. Additionally, in emergency situations, the pipe ram and annular preventers may not be able to form a strong enough seal around the tubular to prevent flow through the annulus between the tubular and the BOP cavity. Thus, BOP stacks include a mechanical shear ram assembly. Mechanical shear rams are typically the last line of defense for emergency situations, e.g., kicks or potential blowouts. (As used herein, unless specified otherwise, the term "shear ram" would include blind shear rams, shear sealing rams, shear seal rams, shear rams and any ram that is intended to, or capable of, cutting or shearing a tubular.) Mechanical shear rams function like giant gate valves that supposed to quickly close across the BOP cavity to seal it. They are intended to cut through any tubular that is in the BOP cavity that would potentially block the shear ram from completely sealing the BOP cavity.

BOP stacks can have many varied configurations, which are dependent upon the conditions and hazards that are expected during deployment and use. These components could include, for example, an annular type preventer, a rotating head, a single ram preventer with one set of rams (blind or pipe), a double ram preventer having two sets of rams, a triple ram type preventer having three sets of rams, and a spool with side outlet connections for choke and kill lines. Examples of existing configurations of these components could be: a BOP stack having a bore of 7 1/16" and from bottom to top a single ram, a spool, a single ram, a single ram and an annular preventer and having a rated working pressure of 5,000 psi; a BOP stack having a bore of 13⅝" and from bottom to top a spool, a single ram, a single ram, a single ram and an annular preventer and having a rated working pressure of 10,000 psi; and, a BOP stack having a bore of 18¾" and from bottom to top, a single ram, a single ram, a single ram, a single ram, an annular preventer and an annular preventer and having a rated working pressure of 15,000 psi. (As used herein the term "preventer" in the context of a BOP stack, would include all rams, shear rams, and annular preventers, as well as, any other mechanical valve like structure used to restrict, shut-off or control the flow within a BOP bore.)

BOPs need to contain the pressures that could be present in a well, which pressures could be as great as 15,000 psi or greater. Additionally, there is a need for shear rams that are capable of quickly and reliably cutting through any tubular, including drilling collars, pipe joints, and bottom hole assemblies that might be present in the BOP when an emergency situation arises or other situation where it is desirable to cut tubulars in the BOP and seal the well. With the increasing strength, thickness and ductility of tubulars, and in particular tubulars of deep, very-deep and ultra-deep water drilling, there has been an ever increasing need for stronger, more powerful, and better shear rams. This long standing need for such shear rams, as well as, other information about the physics and engineering principles underlying existing mechanical shear rams, is set forth in: West Engineering Services, Inc., "Mini Shear Study for U.S. Minerals Management Services" (Requisition No. 2-1011-1003, December 2002); West Engineering Services, Inc., "Shear Ram Capabilities Study for U.S. Minerals Management Services" (Requisition No. 3-4025-1001, September 2004); and, Barringer & Associates Inc., "Shear Ram Blowout Preventer Forces Required" (Jun. 6, 2010, revised Aug. 8, 2010).

In an attempt to meet these ongoing and increasingly important needs, BOPs have become larger, heavier and more complicated. Thus, BOP stacks having two annular preventers, two shear rams, and six pipe rams have been suggested. These BOPs can weigh many hundreds of tons and stand 50 feet tall, or taller. The ever-increasing size and weight of BOPs presents significant problems, however, for older drilling rigs. Many of the existing offshore rigs do not have the deck space, lifting capacity, or for other reasons, the ability to handle and use these larger more complicated BOP stacks.

As used herein the term "riser" is to be given its broadest possible meaning and would include any tubular that connects a platform at, on or above the surface of a body of water, including an offshore drilling rig, a floating production storage and offloading ("FPSO") vessel, and a floating gas storage and offloading ("FGSO") vessel, to a structure at, on, or near the seafloor for the purposes of activities such as drilling, production, workover, service, well service, intervention and completion.

Risers, which would include marine risers, subsea risers, and drilling risers, are essentially large tubulars that connect an offshore drilling rig, vessel or platform to a borehole. Typically a riser is connected to the rig above the water level and to a BOP on the seafloor. Risers can be viewed as essentially a very large pipe, that has an inner cavity through which the tools and materials needed to drill a well are sent down from the offshore drilling rig to the borehole in the seafloor and waste material and tools are brought out of the borehole and back up to the offshore drilling rig. Thus, the riser functions like an umbilical cord connecting the offshore rig to the wellbore through potentially many thousands of feet of water.

Risers can vary in size, type and configuration. All risers have a large central or center tube that can have an outer diameters ranging from about 13⅜" to about 24" and can have wall thickness from about ⅝" to ⅞" or greater. Risers come in sections that can range in length from about 49 feet to about 90 feet, and typically for ultra deep water applications, are about 75 feet long, or longer. Thus, to have a riser extend from the rig to a BOP on the seafloor the rise sections are connected together by the rig and lowered to the seafloor.

The ends of each riser section have riser couplings that enable the large central tube of the riser sections to be connected together. The term "riser coupling" should be given its broadest possible meaning and includes various types of coupling that use mechanical means, such as, flanges, bolts, clips, bowen, lubricated, dogs, keys, threads, pins and other means of attachment known to the art or later developed by the art. Thus, by way of example riser couplings would include flange-style couplings, which use flanges and bolts; dog-style couplings, which use dogs in a box that are driven into engagement by an actuating screw; and key-style couplings, which use a key mechanism that rotates into locking engagement. An example of a flange-style coupling would be the VetcoGray HMF. An example of a dog-style coupling would be the VetcoGray MR-10E. An example of a key-style coupling would be the VetcoGray MR-6H SE Each riser section also has external pipes associated with the large central tube. These pipes are attached to the outside of the large central tube, run down the length of the tube or riser section, and have their own connections that are associated with riser section connections. Typically, these pipes would include a choke line, kill line, booster line, hydraulic line and potentially other types of lines or cables. The choke, kill, booster and hydraulic lines can have inner diameters from about 3" (hydraulic lines may be as small as about 2.5") to about 6.5" or more and wall thicknesses from about ½" to about 1" or more.

Situations arise where it may be necessary to disconnect the riser from the offshore drilling rig, vessel or platform. In some of these situations, e.g., drive-off of a floating rig, there may be little or no time, to properly disconnect the riser. In others situations, such as weather related situations, there may be insufficient time to pull the riser string once sufficient weather information is obtained; thus forcing a decision to potentially unnecessarily pull the riser. Thus, and particularly for deep, very deep and ultra deep water drilling there has existed a need to be able to quickly and with minimal damage disconnect a riser from an offshore drilling rig.

In offshore drilling activities critical and often times emergency situations arise. These situations can occur quickly, unexpectedly and require prompt attention and remedial actions. Although these offshore emergency situations may have similar downhole causes to onshore drilling emergency situations, the offshore activities are much more difficult and complicated to manage and control. For example, it is generally more difficult to evacuate rig personnel to a location, away from the drilling rig, in an offshore environment. Environmentally, it is also substantially more difficult to mitigate and manage the inadvertent release of hydrocarbons, such as in an oil spill, or blowout, for an offshore situation than one that occurs onshore. The drilling rig, in an offshore environment, can be many tens of thousands of feet away from the wellhead. Moreover, the offshore drilling rig is fixed to the borehole by the riser and any tubulars that may be in the borehole. Such tubulars may also interfere with, inhibit, or otherwise prevent, well control equipment from functioning properly. These tubulars and the riser can act as a conduit bringing dangerous hydrocarbons and other materials into the very center of the rig and exposing the rig and its personnel to extreme dangers.

Thus, there has long been a need for systems that can quickly and reliably address, assist in the management of, and mitigate critical and emergency offshore drilling situations. This need has grown ever more important as offshore drilling activities have moved into deeper and deeper waters. In general, it is believed that the art has attempted to address this need by relying upon heavier and larger pieces of equipment; in essence by what could be described as using brute force in an attempt to meet this need. Such brute force methods, however, have failed to meet this long-standing and important need.

SUMMARY

There has been a long standing need for improved systems that can provide safe and effective control of well conditions, and in particular to do so at greater depths and under harsher conditions and under increased energy and force requirements. The present inventions, among other things, solve these and other needs by providing the articles of manufacture, devices and processes taught herein.

Thus, there is provided a well control system having a reduced potential mechanical energy requirement, the system having: a body defining a cavity; a mechanical device associated with the cavity; a source of directed energy, having the capability to deliver a directed energy to a location within the cavity, the directed energy having a first amount of energy; and, a source of potential mechanical energy associated with the mechanical device, and capable of delivering mechanical energy to a location within the cavity, the source of potential energy having a potential energy having a second amount of energy; wherein, the first amount of energy is at least as great as about 5% of the second amount of energy.

There is further provided a well control system or method of controlling a well having one or more of the following features including: wherein the body has a blowout preventer; wherein the mechanical device has a ram; wherein the mechanical device has a shear ram; wherein the ram is selected from the group consisting of a blind ram, a shear ram, a blind shear ram, a pipe ram and a casing shear ram; having a high power laser system, a riser and a blowout preventer stack; wherein the mechanical device is selected from the group consisting of a blind ram, a fixed pipe ram, a variable pipe ram, a shear ram, a blind shear ram, a pipe ram and a casing shear ram; wherein the source of potential mechanical energy has a charged accumulator; wherein the source of potential mechanical energy has a plurality of charged accumulators; wherein the source of potential mechanical energy has a charged accumulator bank; wherein the charged accumulator has a pressure of at least about 1,000 psi; wherein the charged accumulator has a pressure of at least about 3,000 psi; wherein the charged accumulator has a pressure of at least about 5,000 psi; wherein the charged accumulator has a pressure of at least about 5,000 psi; wherein the source of directed energy is a high power laser have a power of at least about 10 kW; wherein the source of directed energy is a high power laser have a power of at least about 15 kW; wherein the source of directed energy is a high power laser have a power of at least about 20 kW; wherein the source of directed energy is a high power laser have a power of at least about 40 kW; wherein the first amount of energy is at least about 150 kJ; wherein the first amount of energy is at least about 600 kJ; wherein the well control systems has a high power laser system; the body has a blowout preventer; the source of potential mechanical energy has a charged accumulator, having a pressure of at least about 1,000 psi; and the mechanical device is selected from the group consisting of a blind ram, a shear ram, a ram, a blind shear ram, a pipe ram and a casing shear ram; wherein the well control systems has a high power laser system; the body has a blowout preventer; the source of potential mechanical energy has a charged accumulator, having a pressure of at least about 1,000 psi; and the mechanical device is selected from the group consisting of a blind ram, a shear ram, a blind shear ram, a ram, a pipe ram and a casing shear ram; wherein the well control systems has a high power laser system; the body has a blowout preventer; the source of potential mechanical energy has a charged accumulator, having a pressure of at least about 1,000 psi; and the mechanical device is selected from the group consisting of a blind ram, a shear ram, a blind shear ram, a ram, a pipe ram and a casing shear ram; wherein the well control systems has a high power laser system; the body has a blowout preventer; the source of potential mechanical energy has a charged accumulator, having a pressure of at least about 1,000 psi; and the mechanical device is selected from the group consisting of a blind ram, a shear ram, a blind shear ram, a ram, a pipe ram and a casing shear ram; wherein the well control systems has a high power laser system; the body has a blowout preventer; the source of potential mechanical energy has a charged accumulator, having a pressure of at least about 1,000 psi; and the mechanical device is selected from the group consisting of a blind ram, a shear ram, a blind shear ram, a ram, a pipe ram and a casing shear ram; wherein the first amount of energy is greater than the second amount of energy energy; wherein the first amount of energy is at least as great as about 25% of the second amount of energy; wherein the first amount of energy is at least as great as about 50% of the second amount of energy; wherein the first amount of energy is at least as great as about 100% of the second amount of energy; and, wherein the first amount of energy is greater than the second amount of energy.

There is still further provided a well control system having a reduced potential mechanical energy requirement, the system having: a body defining a cavity; a mechanical device associated with the cavity; a source of directed energy, having the capability to deliver a directed energy to a location associated with the cavity, the directed energy having a first power; and, a source of potential mechanical energy associated with the mechanical device, and capable of delivering mechanical energy to a location within the cavity, the source of potential energy having a potential energy having a second power; wherein, the first power is at least as great as about 5% of the second power.

Moreover, there is provided a well control system having a reduced potential mechanical energy requirement, the system having: a high power laser system; a riser; a blowout preventer stack; the blowout preventer stack defining a cavity; a mechanical device for sealing a well associated with the cavity; a source of directed energy, having the capability to deliver a directed energy to a location associated with the cavity, the directed energy having a first amount of energy; and, a source of potential mechanical energy associated with the mechanical device, and capable of delivering mechanical energy to a location associated with the cavity, the source of potential energy having a potential energy having a second amount of energy energy; wherein, the first amount of energy is at least as great as about 5% of the second amount of energy.

There is further provided a well control system or method of controlling a well having one or more of the following features including: wherein in the source of directed energy is a high power laser have a power of at least about 15 kW, and the source of potential energy is a charged bank of accumulators having a pressure of at least about 1,000 psi; wherein in the source of directed energy is a high power laser of at least about 20 kW; wherein the source of potential energy is a charged bank of accumulators having a pressure of at least about 1,000 psi.

Additionally, there is provided a constant energy depth independent well control system, the system having: a device for delivering directed energy; a device for delivering mechanical energy associated with a potential energy source having an amount of potential energy; and, the device for delivering directed energy compensatively associated with the device for delivering mechanical energy, whereby the delivery of the directed energy compensates for losses in potential energy.

There is further provided a well control system or method of controlling a well having one or more of the following features including: a high power laser, a riser and a blowout preventer stack; wherein the losses of potential energy arise from the potential energy source being positioned under a surface of a body of water at a depth; wherein the depth is at least about 5,000 ft; and, wherein the source of potential energy has a bank of charged accumulators.

Yet further, there is provided a laser BOP having: a first and a second ram block; the first ram block having a first and a second laser device, the first laser device defining a first laser beam path for delivery of a laser beam, the second laser device defining a second beam path for delivery of a laser beam; the second ram block having a third and a fourth laser device, the third laser device defining a third laser beam path for delivery of a laser beam, the fourth laser device defining a fourth laser beam path for delivery of a laser beam; and, the ram blocks associated with an actuator center line; whereby the laser beam paths define beam path angles with respect to the actuator center line.

Still additionally, there is provided a laser BOP having: a first ram block; the first ram block having a first and a second laser device, the first laser device defining a first laser beam path for delivery of a laser beam, the second laser device defining a second beam path for delivery of a laser beam; and, the ram block associated with an actuator center line; whereby the laser beam paths define beam path angles with respect to the actuator center line.

There is further provided a well control system or method of controlling a well having one or more of the following features including: a laser BOP having a beam path angle for a first laser beam path of 90°; wherein the beam path angle for the first laser beam path is greater than 90°; wherein the beam path angle for the first laser beam path is less than 90°; wherein the beam path angles for the first and second beam paths are greater than 90°; wherein the beam path angles for the first and second beam paths are less than 90°; wherein the beam path angles for the first and second beam paths are about the same angle; wherein the beam path angles for the first and second beam paths are different angles; wherein the first laser beam has a power of at least about 10 kW; wherein the first and second laser beams each have a power of at least about 10 kW.

Yet still further, there is provided a laser BOP of having: a second ram block; the second ram block having a third and a fourth laser device, the third laser device defining a third laser beam path for delivery of a laser beam, the fourth laser device defining a fourth beam path for delivery of a laser beam; and, the second ram block associated with the actuator center line, and whereby the third and fourth laser beam paths define beam path angles with respect to the actuator center line.

Furthermore, there is provided a method of severing a tubular in a BOP cavity, having: delivering directed energy to a predetermined location on a tubular positioned in a cavity of a BOP; the directed energy damaging the tubular in a predetermined pattern; applying a mechanical force to the tubular in association with the damage pattern, whereby the tubular is severed.

There is further provided a well control system or method of controlling a well having one or more of the following features including: wherein the directed energy is a high power laser beam; wherein the directed energy is a high power laser beam having at least 10 kW of power; wherein the predetermined damage pattern is a slot; wherein the predetermined damage pattern is a slot having a length and a varying width; wherein the directed energy is a high power laser beam having at least about 5 kW of power, and having a focal length, wherein the damage pattern is a slot having a length and a varying width, whereby the width varies proportionally to the focal length of the laser beam.

Still further this is provided a method for closing a well having: a step for delivering a high power laser beam to a tubular in a cavity in a BOP; a step for removing material from the tubular with the delivered high power laser beam; a step for applying a mechanical force to the tubular; and, the step for mechanically closing the well.

Yet additionally, there is provided a laser ram BOP having: a means for providing a high power laser beam to a BOP stack, the BOP stack defining a cavity; a means for directing the high power laser beam to a tubular within the BOP cavity; and, a means for applying a mechanical force to the tubular.

There is further provided a well control system or method of controlling a well having one or more of the following features including: wherein the means for providing a high power laser beam has a battery powered 10 kW laser located subsea adjacent to the BOP stack; and wherein the means for directing the high power laser beam has a pressure compensated fluid laser jet; and wherein the pressure compensated fluid laser jet is a means for compensating pressure; wherein the means for compensating pressure is the embodiment shown in FIG. 20.

Still further there is provided a BOP package having: a lower marine rise package; a lower BOP stack; a connector releasable connecting the lower marine riser package and the lower BOP stack; and, the connector having a high power directed energy delivery device.

There is further provided a well control system or method of controlling a well having one or more of the following features including: wherein the connector is capable of being released at an angle, defined by a position of a rig associated with the BOP stack with respect to a vertical line from the BOP stack, that is greater than about 5°; wherein the releasable angle is greater than about 6°; wherein the releasable angle is greater than about 7°; wherein the releasable angle is greater than about 10°; and wherein the high power energy deliver device has a high power laser beam delivery device capable of delivering a high power laser beam having a power of at least about 5 kW.

DESCRIPTION OF THE PREFERRED EMBODIMENTS

Figure 1:
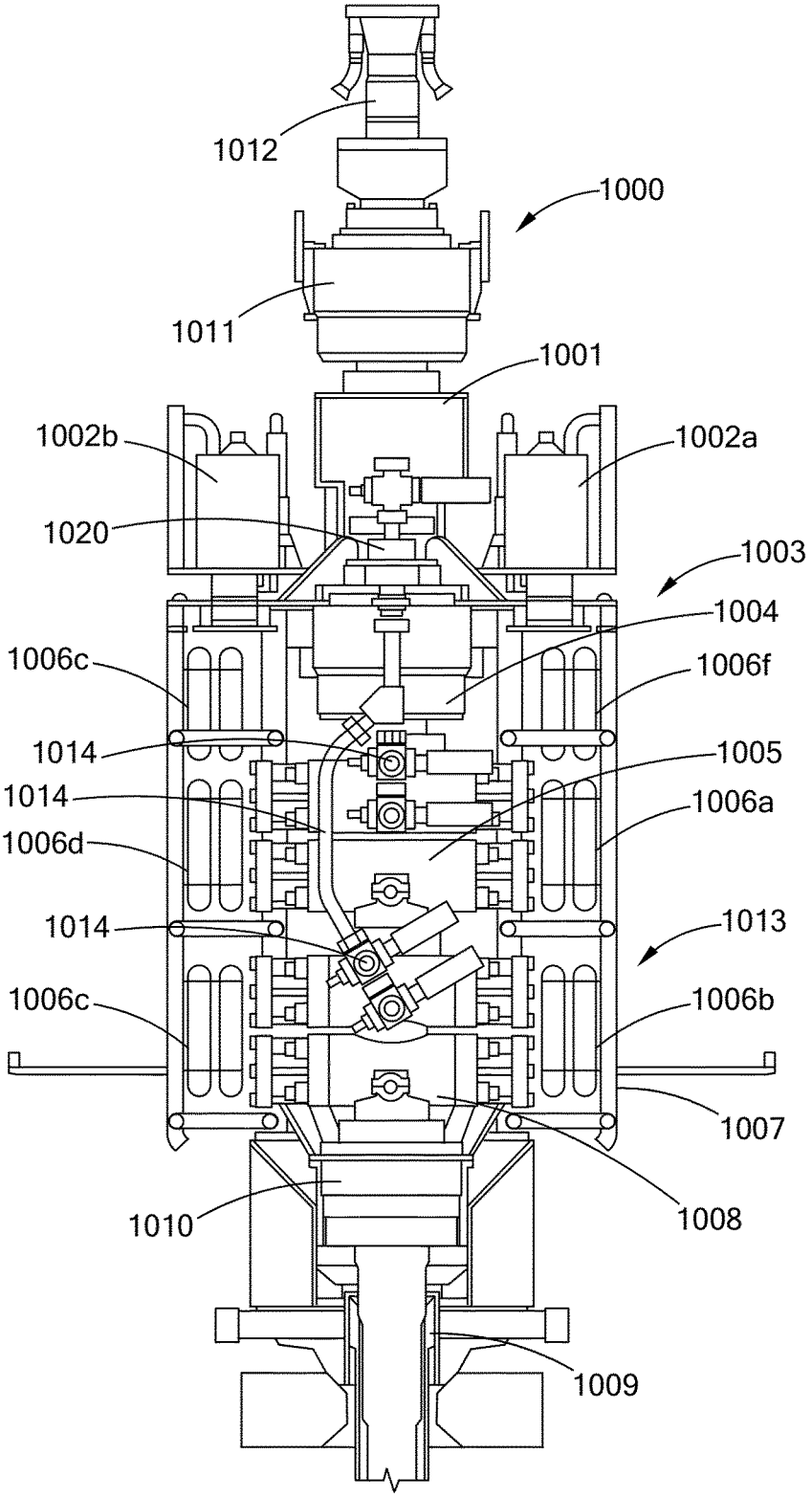
FIG. 1 is a schematic view of an embodiment of a laser BOP stack in accordance with the present invention.

The present inventions relate to the delivery and utilization of high power directed energy in well control systems and particularly to systems, methods and structures for utilizing high power directed energy, in conjunction with devices, that deliver mechanical energy, such as, for example, BOPs, BOP stacks, BOP-riser packages, ram assemblies, trees, sub-sea trees, and test trees.

Generally, well control systems and methods utilize various mechanical devices and techniques to control, manage and assure the proper flow of hydrocarbons, such as oil and natural gas, into a well and to the surface where the hydrocarbons may be collected, transported, processed and combinations and variations of these. Such systems perform many and varied activities. For example, and generally, one such application is the mechanical shutting in, shutting off, or otherwise closing, or partially closing, of a well to prevent, mitigate, or manage a leak, blowout, kick, or such type of uncontrolled, unanticipated, emergency, or in need of control, event. Thus, for example, a BOP, may be used to mechanically close a well; and in the process of closing the well, to the extent necessary, sever any tubulars that may be blocking, or would otherwise interfere with the closing of the mechanical devices, e.g., rams, used to close and seal the well. In other situations, such as a tree, there may be a valve that is closed to shut the well off. This valve is intended to upon closing, sever or cut an object, such a wireline, that may be present.

Generally, in such situations where the well is being closed, the associated well control devices are intended to close the well quickly and under any, and all, conditions. As exploration and product of hydrocarbons moves to more and more difficult to access locations, and in particular moves to deeper and deeper water depths, e.g., 1,000 ft, 5,000 ft, 10,000 ft, and deeper, the demands on BOPs and other such well control devices has become ever and ever more arduous.

At such depths the increased pressure from the water column reduces the capabilities of the potential energy storage devices, e.g., the accumulators, by reducing the amount of potential energy that can be stored by those devices. Similarly, as depth increases, the temperature of the water decreases, again reducing the amount of potential energy that can be stored by those devices. On the other hand, as depth increases, the strength, size and ductility, of the tubulars used for drilling increases, requiring greater potential energy, mechanical energy and force to assure that any, and all, tubulars present in the BOP will be cut, and not interfere with the closing off of the well.

Prior to the present inventions, to address these demands, e.g., the reduced ability to store potential energy and the increased need for greater mechanical energy, on BOPs and other similar devices, the art generally has taken a brute force approach to this problem. Thus, and in general, the size, weight, potential energy holding capabilities, and mechanical energy delivery capabilities, of such devices has been ever increasing. For example, current and planned BOP stacks can be over 60 feet tall, weigh over 350 tons, and have over one hundred accumulators, having sufficient potential energy when fully charged, to exert about 1.9 million pounds, about 2.0 million pounds, or more, of shear force at sea level.

Embodiments of the present inventions, in part, utilize directed energy to replace, reduce, compensate for, augment, and variations and combinations of these, potential energy requirements, mechanical power requirements, mechanical energy requirements, and shear force requirements of well control systems, such as BOPs. Thus, by using directed energy, to replace, reduce, compensate for, augment, and variations and combinations of these, mechanical energy, many benefits and advantages may be realized.

For example, among other things: smaller weight and size BOPs may be developed that have the same performance capabilities as much larger units; greater water depths of operation may be achieved without the expected increase in size, potential energy requirements and mechanical energy capabilities; in general, less potential energy may be required to be stored on the BOP to have the same efficacy, e.g., ability to cut and seal the well under various conditions; and, in general, less mechanical energy, and shear force, may be required to be delivered by the BOP to have the same efficacy, e.g., ability to cut and seal the well under various conditions.

These and other benefits from utilizing directed energy and the substation, augmentation, and general relationship of, directed energy to mechanical energy, including potential mechanical energy, will be recognized by those of skill in the art based upon the teachings and disclosure of this specification; and come within the scope of protection of the present inventions.

Thus, and in general, embodiments of the present systems and methods involve the application of directed energy and mechanical energy to structures, e.g., a tubular, a drill pipe, in a well control device, e.g., a BOP, a test-tree, and to close off the well associated with the well control device. For example, the directed energy may be applied to the structure in a manner to weaken, damage, cut, or otherwise destroy a part or all of the structure at a predetermined location, manner, position, and combinations and variations of these. A mechanical energy may be applied by a mechanical device having an amount of potential energy associated with the device, e.g., charged accumulators having over 5,000 psi pressure in association with a blind shear ram BOP, to force through what might remain of the structure and force the mechanical device into a sealing relationship with the well bore.

The directed energy and mechanical forces are preferably applied in the manner set forth in this specification, and by way of example, may be applied as taught and disclosed in US patent applications: Ser. No. 13/034,175; Ser. No. 13/034,183; Ser. No. 13/034,017; and, Ser. No. 13/034,037, the entire disclosures of each of which are incorporated herein by reference.

As used herein "directed energy" would include, for example, optical laser energy, non-optical laser energy, microwaves, sound waves, plasma, electric arcs, flame, flame jets, explosive blasts, exploded shaped charges, steam, neutral particle beam, or any beam, and combinations and variations of the foregoing, as well as, water jets and other forms of energy that are not "mechanical energy" as defined in these specifications. (Although a water jet, and some others, e.g., shaped charge explosions, and steam, may be viewed as having a mechanical interaction with the structure, for the purpose of this specification, unless expressly provided otherwise, will be characterized amongst the group of directed energies, based upon the following specific definition of mechanical energy). "Mechanical energy," as used herein, is limited to energy that is transferred to the structure by the interaction or contact of a solid object, e.g., a ram or valve edge, with that structure.

These methods provide for the application of unique combinations of directed energy and mechanical force to obtain a synergism. This synergism enables the combinations to obtain efficacious operations using, or requiring, less mechanical force, energy, and potential energy that would otherwise be expected, needed or required. This synergism, although beneficial in many applications, conditions and settings, is especially beneficial at increasing water depths.

Thus, for example the compression ratio ("CR") of a system, e.g., a BOP stack, is defined as the ratio of the maximum pressure ("$P_{max}$") the accumulator bank of the system can have and the minimum pressure ("$P_{min}$") needed for the system to perform the closing operation, e.g., shearing and closing. Thus, $CR=P_{max}/P_{min}$. For example, a system having a maximum pressure of 6,000 psi and a minimum pressure of 3,000 psi at sea level would have a $CR_{sea\ level}$ of 2. (Generally, the higher the CR, the better efficacy, or greater the shearing and sealing capabilities of the system.)

This same system, however, at a depth of 12,000 feet would have a $CR_{12,000}$ of 1.36. At a depth of 12,000 feet the pressure of the water column would be about 5,350 psi, which is additive to both $P_{max}$ and $P_{min}$. Thus, for this same system—$CR_{12,000}$=6000 $P_{max}$+5,350/3000 $P_{min}$+5,350=11,350/8,350=1.36. About a 32% decrease in CR (from a CR of 2 to a CR of 1.36).

However, utilizing embodiments of the present inventions, the $P_{min}$ of the system may be significantly reduced, because the directed energy weakens, damages, or partially cuts the structure, e.g., a tubular, a drill pipe, that is in the BOP cavity. Thus, less shear force is required to sever the structure and seal the well. For example, using an amount of directed energy, e.g., 10 kW (kilo Watts) for 30 seconds (300 kJ (kilo Joules)), the $P_{min}$ of the system may be reduced to 750 psi, resulting in a $CR_{12,000}$ of 1.86 for a directed energy-mechanical energy system. $CR_{12000}$–6000 $P_{max}$+5,350/750 $P_{min}$+5,350=11,350/6100=1.86. About a 36% increase in the CR at depth over the system that did not utilize directed energy (from a CR of 1.36 to a CR of 1.86). Thus, utilizing an embodiment of the present invention, the CR at depth of the system can be increased through the use of directed energy without increasing the $P_{max}$ of the system. Thus, avoiding the need to increase the size and weight of the system. The potential energy of the system having the 750 $P_{min}$ would be 604 kJ, while the system having 3,000 $P_{min}$ would be 2,426 kJ, as set forth in Table I (stroke is 9⅜ inched based upon 18¾ inch bore size, divided by two).

TABLE 1

| Piston Inch | Stroke Inch | Pistons Qty | Pressure psi | Force lbf | Energy ft-lb | Energy kJ |
|---|---|---|---|---|---|---|
| 22 | 9.375 | 2 | 750 | 285100 | 445468 | 604 |
| 22 | 9.375 | 2 | 3000 | 1140398 | 1781872 | 2416 |

The reduced temperature of the water at depth can have similar negative effects on CR. Thus, for example, a 6,000 psi charge $P_{max}$ at 80° F. would be 4,785 psi at 40° F. These and other negative effects on CR, or other measures of a well control systems efficacy, may be over come through the use of directed energy to weaken, damage, cut, partially cut, or otherwise make the ability of the ram to pass through the structure in the well control system cavity, e.g., a tubular, drill pipe, tool joint, drill collar, etc. in the BOP cavity, easier, e.g., requiring less mechanical energy.

The damaging, cutting, slotting, or weakening of a structure in a cavity of a well control device, such as for example a tubular such as a drill pipe in the cavity of a BOP may occur from the timed delivery, of a single from of directed energy or from the timed delivery of multiple forms of directed, and mechanical energy. Predetermined energy delivery patterns, from a shape, time, fluence, relative timing, and location standpoint, among others may be used. Thus, for example with laser energy the laser beam could be pulsed or continuous. Further the directed energy may be used to create weakening through thermal shock, thermal fatigue, thermal crack propagation, and other temperature change related damages or weakenings. Thus, differential expansion of the structure, e.g., tubular, may be used to weaken or crack the tubular. A mechanical wedge may then be driven into the weakened or cracked area driving the tubular apart. Hitting and rapid cooling may also be used to weaken the tubular, thus requiring less potential energy and mechanical force to separate the tubular. For example the tubular may be rapidly heated in a specific pattern with a laser beam, and then cooled in a specific pattern, with for example a low temperature gas or liquid, to create a weakening. The heating and cooling timing, patterns, and relative positions of those patterns may be optimized for particular tubulars and BOP configurations, or may further be optimized to effectively address anticipated situations within the BOP cavity when the well's flow needs to be restricted, controlled or stopped.

The ram block or other sealing device may further be shaped, e.g., have an edge, that exploits a directed energy weakened area of a structure, such as laser notched tubular in a BOP cavity. Thus, for example, the face of the ram block may be such that it enters the laser created notch and pry open the crack to separate the tubular, permitting the ram to pass through and seal the well bore. Thus, it may be preferable to have the face of the ram in a predetermined shape or configuration matched to, corresponding with, or based upon, the predetermined shape of the notch, cut or weakened area.

The laser cutting heads, or some other types of directed energy devices, may inject or create gases, liquids, plasma and combinations of these, in the BOP cavity during operations. Depending upon the circumstances, e.g., the configuration of the BOP stack, the closing sequence and open-closed status of the various preventers in the BOP stack, the well bore conditions, the directed energy delivery assembly, and potentially others, the injected or created materials may have to be managed and handled.

Thus, for example, it may be desirable to avoid having large volumes of undispersed gas, e.g., a big gas bubble, injected into the riser, or more specifically injected into the column of mud or returning fluids in the annulus between the inner side of the riser and the outer side of the drill pipe that is within the riser. Similarly, if large volumes of a fluid are injected into the BOP cavity, depending upon the circumstances, this introduced fluid may greatly increase the pressure within the BOP cavity making it more difficult to close the rams. Thus, this injected or created gases or fluids may be removed through the existing choke lines, kill lines, though modified ports and check valve systems, through other ports in the BOP, for example for the removal of spent hydraulic fluid. Generally, this injected or created gases or fluids, should be removed in a manner that accomplished the intended objective, e.g., avoiding an increase in pressure in the cavity, or avoiding large gas bubble formation in the rise fluid column, while maintaining and not compromising the integrity of the BOP stack to contain pressure and close off the well.

Turning to FIG. 1 there is provided a schematic side view of an embodiment of a directed energy-mechanical energy BOP stack. The BOP stack 1003 has an upper section 1000, and a lower section 1013. The upper section 1000 has a flex joint 1012 for connecting to the riser (not shown in this figure), an annular preventer 1011, a collet connector 1001, a first control pod 1002*a*, a second control pod 1002*b*, and a choke and kill line connector 1020 (a second choke and kill line connector associated with the second control pod 1002*b* is on the back side of BOP stack 1003, and is thus not shown in this figure). The first choke and kill lines 1014 extend from the connector 1020 in to the lower section 1013. The lower section 1013 has an annular preventer 1004, double ram 1005 BOP, and a laser double ram BOP 1008. The lower section 1013 also has 100 accumulators, schematically shown in the drawing as two accumulators each in several accumulator banks, e.g., 1006*a*, 1006*b*, 1006*c*, 1006*d*, 1006*e*, 1006*f*. The lower section 1013 also has a wellhead connector 1010 that is shown attached to the wellhead 1009. The accumulator banks, e.g., 1006*a*, 1006*b*, 1006*c*, 1006*d*, 1006*e*, 1006*f*, are positioned on a frame 1007 that is associated with the lower section 1013. The laser ram may be located at other positions in the BOP stack, including either or both of the top two positions in the stack, and additional laser BOPs may also be utilized.

In an example of a closing and venting operation for the BOP of the embodiment of FIG. 1, the annular preventer 1004 may be closed around the drill pipe or other tubular located within the BOP cavity. The laser shear ram may be operated and closed cutting and then severing the drill pipe and sealing the well. During the laser cutting operation fluid from the laser cutting jet may be vented through the choke line, which is then closed upon, or after the sealing, of the shear ram blocks.

Figure 2:
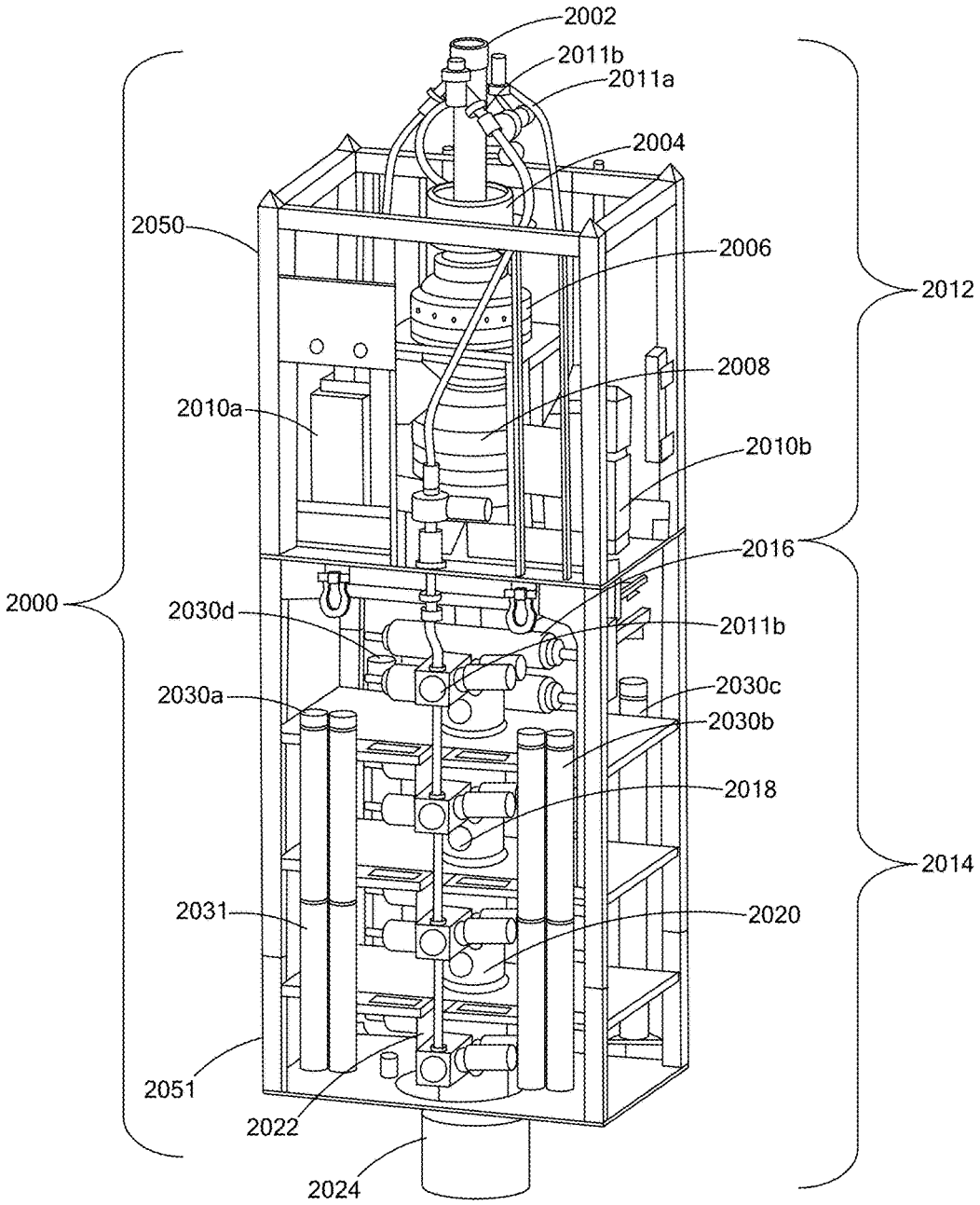
FIG. 2 is a schematic view of an embodiment of a laser BOP stack in accordance with the present invention.

Turning to FIG. 2 there is shown a perspective view of an embodiment of a laser BOP stack. The laser BOP stack 2000 has a lower marine riser package (("LMRP") 2012 that has a frame 2050 and a lower BOP section 2014 having a frame 2051. The LMRP 2012 has a riser adapter 2002, a flex joint 2004, an upper annular preventer 2006, and a lower annular preventer 2008. The frame 2050 of the LMRP 2012 supports a first control module or pod 2010*a* and a second control module or pod 2010*b*.

When deployed sub-sea, e.g., on the floor of the sea bead, each pod would be connected to, or a part of, a multiplexed electro-hydraulic (MUX) control system. An umbilical, not shown would transmit for example, control signals, electronic power, hydraulics, fluids for laser jets and high power laser beams from the surface to the BOP stack 2000. The pods control (independently, in conjunction with control signals from the surface and combinations thereof) among other things, the operation of the various rams, and the valves in the choke and kill lines.

The choke and kill lines provide, among other things, the ability to add fluid, at high pressure and volume if need, such as heavy drilling mud, and to do so in relation to specific locations with respect to ram placement in the stack. These lines also provide the ability to bleed off or otherwise manage extra pressure that may be present in the well. They may also be utilized to handle any excess pressure or fluid volume that is associated with the use of a directed energy delivery device, such as a laser jet, a water jet, or a shaped explosive charge.

The lower BOP section 2014 of the BOP stack 2000 has a double ram BOP 2016, a laser double ram BOP 2018, a double ram BOP 2020, a single ram BOP 2022, and a wellhead connector 2024. The lower BOP section 2014 has associated with its frame 2051 four banks of accumulators 2030*a*, 2030*b*, 2030*c*, 2030*d*, with each bank having two depth compensated accumulators, e.g., 2031. The depth compensated accumulators, and the accumulator banks, may be pressurized to a $P_{max}$ of at least about 1,000 psi, at least about 3,000 psi, at least about 5,000 psi, and at least about 6,000 psi, about 7,500 psi and more. The pressurized, or charged as they may then be referred to, accumulators provide a source of stored energy, i.e., potential energy, that is converted into mechanical energy upon their discharge to, for example, close the rams in a BOP. The laser ram may be located at other positions in the BOP stack, including either or both of the top two positions in the stack, and additional laser BOPs may also be utilized.

Figures 3A, 3B:
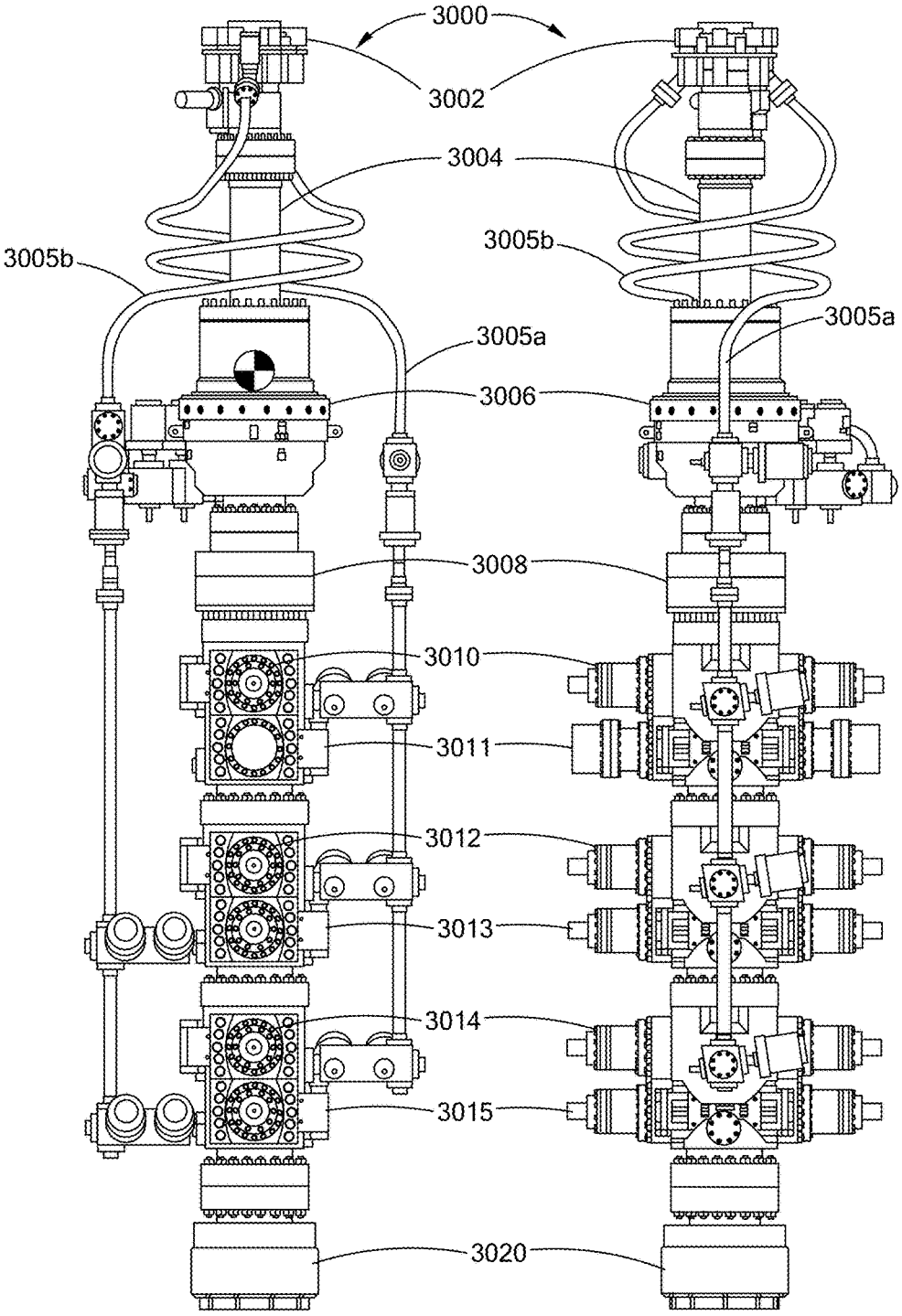
FIG. 3A is a side perspective view of an embodiment of a laser BOP stack in accordance with the present invention.
FIG. 3B is a front perspective view of the embodiment of FIG. 3A.

Turning to FIGS. 3A and 3B there is shown an embodiment of a BOP stack, with a front perspective view shown in FIG. 3B and a side perspective view shown in FIG. 3A. The BOP stack 3000 has a riser adapter 3002, a flex joint 3004, an annular preventer 3006, a LMRP connector 3008, a laser blind shear ram 3010, a laser casing shear ram 3011, a first, second, third, fourth pipe rams, 3012, 3013, 3014, 3015 and a wellhead connector 3020. There is a first choke and kill line 3005*a* and a second choke and kill line 3005*b*. The laser beam for the laser casing shear ram is delivered from a subsea fiber laser having 20 kW of power and a battery power supply (for example batteries currently used for powering electric automobiles, could be used to power the laser to deliver sufficient directed energy through the laser beam to make the necessary weakening cuts), which may be located on the frame (not shown) for the BOP stack. A second battery powered 20 kW laser may also be associated with this BOP stack and serve as a back up laser beam supply should the optical fiber(s) to the surface laser become come damaged or broken. It should be noted that although the batteries in these systems represent potential energy, they would be potential energy that is converted into directed energy, and would not be considered a source of potential mechanical energy or as providing mechanical energy or power.

Embodiments of topside choke and kill system of the type generally known to those of skill in the art may be used with embodiments of the present BOPs. Thus, for example, embodiments of a fluid laser jet is used, it conjunction with, these choke and kill systems, while preferably not affecting the choke and kill lines and the performance of those lines. In an embodiment, the hydraulic lines on the drilling riser that can be generally used to supplement the fluid side of the BOP accumulators from the surface, may be used to provide the fluid for the laser fluid jet. Thus these lines may also be used, reconfigured, or additional lines added to the drilling riser, to transport the laser media, e.g., the fluid used in a laser fluid jet, down to the jet when it is deployed below sea level. Generally, there may be a hydraulic line for the subsea control pods. Further, there may be one or two boost lines present on the riser.

These and other such lines may be modified, added or reconfigured, to provide a way for the laser jet fluid to be transported down to the laser jet. For example, a tube (for the laser jet fluid) may run inside of the boost line, with an appropriate exit, and valving at the bottom of the boost line, for the tube to be connected to the laser jet assembly and nozzle. This tube may also be run down the outside of the riser.

Table 2 shows the expansion of a gas that is injected into a BOP cavity as the gas rises up through the riser column fluid, e.g., the drilling mud. The values presented in the Table 2 are based upon a wellbore temperature of 100° F., and gas discharge conditions at the surface of 115 psia and 60° F.

TABLE 2

| Water Depth | 5,000 ft | 10,000 ft | 5,000 ft | 10,000 ft |
|---|---|---|---|---|
| Mud density ppg(pounds per gallon) | 15 | 15 | 17 | 17 |
| N2 volume (gal.) | 28.2 | 44.9 | 30.9 | 47.9 |
| N2 volume BBL (barrels) | 0.67 | 1.07 | 0.74 | 1.14 |

As can be seen from Table 2 a gallon of gas, for example at 10,000 feet depth, in a riser having mud having a density of 15 ppg will occupy a volume of 44.9 gallons at the surface. For example, even if this gas reaches the surface as one monolithic bubble, the top side diverter, which would be closed and holding 100 psig should be able to handle this influx of gas from the laser cutting, and divert this gas to the gas handler system of the rig. This influx of gas from the laser cutting may be diverted to the sea, buy way of the annular vent line, which may be positioned in the BOP stack; it may be handled by the choke and kill system by venting into either existing valving or modified valving. Preferably, this influx of gas from the laser jet fluid may be vented into the choke lines and bled off in a manner similar to the management of a kick. Further, this influx of laser jet fluid my be handled through the drilling riser to either the topside gas handling system or through a topside vent line to the flare boom. If a disconnect occurs, the entire contents of the drilling riser will be dumped to the sea, and this influx will be vented to the sea. Preferably, if a laser fluid jet is used, the laser media, e.g., the fluid, ($N_2$, water, brine, silicon oil, $D_2O$) is vented subsea prior to disconnect as a preferred option to entry into the drilling riser.

In some situations gas from the laser jet may also enter into the drilling pipe as the slots are cut in the pipe. In this situation the gas should be vented, or otherwise managed, e.g., bled off from the top of the drilling pipe before connections are broken.

If laser fluid jets of the type disclosed and taught in US Patent Application Publication No. 2012/0074110, and U.S. Patent Application Ser. Nos. 61/1605,429 and 61/605,434, the entire disclosure of each of which are incorporated herein by reference, are used, the source of fluid (gas, e.g., nitrogen ($N_2$), or liquid, e.g., "hydraulic," e.g., liquid, oil, aqueous, etc.) for the jet may come from accumulators located at, near or on the BOP stack, e.g., mounted on the BOP stack frame. Table 3 sets forth examples of some operating parameters that may be utilized with such an accumulator system.

TABLE 3

| Accumulator Drivers | | | | | | | | | | | | | |
|---|---|---|---|---|---|---|---|---|---|---|---|---|---|
| Input Data | | | | | | | | Analysis Results | | | | | |
| # | Water Depth ft | Sea Head press. psig | Well-bore press. psig | Laser differ-ential press. | Total laser press. MOP psia | Jet fluid Media | Time sec. | Avg. flow rate gpm | Total flow vol. gal | Surf. pre-charge temp F. | Surf. pre-charge press. psig | Sub-sea charge press. Pisg | Accum Vol gal |
| 1 | 1,000 | 445 | 45 | 125 | 585 | nitro. | 45 | 45 | 33.8 | 70 | 10,912 | 11,104 | 20 |
| 2 | 1,000 | 445 | 5,000 | 125 | 5,140 | nitro. | 45 | 45 | 33.8 | 70 | 10,912 | 11,104 | 170 |
| 3 | 1,000 | 445 | 10,000 | 125 | 10,140 | nitro. | 45 | 45 | 33.8 | 70 | 10,912 | 11,104 | 1,400 |
| 4 | 1,000 | 445 | 15,000 | 125 | 15,140 | nitro. | 45 | 45 | 33.8 | | | | |
| 5 | 1,000 | 445 | 445 | 1,000 | 1,460 | hydra. | 45 | 8 | 6.0 | 70 | 4.890 | 11,230 | 20 |
| 6 | 1,000 | 445 | 5,000 | 1,000 | 6,015 | hydra. | 45 | 8 | 6.0 | 70 | 8,935 | 11,230 | 50 |
| 7 | 1,000 | 445 | 10,000 | 1,000 | 11,015 | hydra. | 45 | 8 | 6.0 | 70 | 10,912 | 11,230 | 480 |
| 8 | 1,000 | 445 | 15,000 | 1,000 | 16,015 | hydra. | 45 | 8 | 6.0 | | | | |
| 9 | 5,000 | 2,226 | 2,226 | 125 | 2,366 | nitro. | 45 | 45 | 33.8 | 70 | 10,912 | 10,068 | 70 |
| 10 | 5,000 | 2.226 | 5,000 | 125 | 5,140 | nitro. | 45 | 45 | 33.8 | 70 | 10,912 | 10,068 | 170 |
| 11 | 5,000 | 2,226 | 10,000 | 125 | 10,140 | nitro. | 45 | 45 | 33.8 | 70 | 10,912 | 10,068 | 1,410 |
| 12 | 5,000 | 2,226 | 15,000 | 125 | 15,140 | nitro. | 45 | 45 | 33.8 | | | | |
| 13 | 5,000 | 2,226 | 2,226 | 1,000 | 3,241 | hydra. | 45 | 8 | 6.0 | 70 | 6,905 | 11,152 | 30 |
| 14 | 5,000 | 2,226 | 5,000 | 1,000 | 6,015 | hydra. | 45 | 8 | 6.0 | 70 | 9,486 | 11,152 | 40 |
| 15 | 5,000 | 2,226 | 10,000 | 1,000 | 11,015 | hydra. | 45 | 8 | 6.0 | 70 | 10,917 | 11,152 | 160 |
| 16 | 5,000 | 2,226 | 15,000 | 1,000 | 16,015 | hydra. | 45 | 8 | 6.0 | | | | |
| 17 | 10,000 | 4,452 | 4,452 | 125 | 4,592 | nitro. | 45 | 45 | 33.8 | 70 | 10,912 | 8,885 | 140 |
| 18 | 10,000 | 4,452 | 5,000 | 125 | 5,140 | nitro. | 45 | 45 | 33.8 | 70 | 10,912 | 8,885 | 170 |
| 19 | 10,000 | 4,452 | 10,000 | 125 | 10,140 | nitro. | 45 | 45 | 33.8 | 70 | 10,912 | 8,885 | 1,410 |
| 20 | 10,000 | 4,452 | 15,000 | 125 | 15,140 | nitro. | 45 | 45 | 33.8 | | | | |
| 21 | 10.000 | 4,452 | 4,452 | 1,000 | 5,467 | hydra. | 45 | 8 | 6.0 | 70 | 9,635 | 11,055 | 40 |
| 22 | 10,000 | 4,452 | 5,000 | 1,000 | 8,015 | hydra. | 45 | 8 | 6.0 | 70 | 10,121 | 11,055 | 40 |
| 23 | 10,000 | 4.452 | 10,000 | 1,000 | 11,015 | hydra. | 45 | 8 | 6.0 | 70 | 10,912 | 11,055 | 100 |
| 24 | 10.000 | 4,452 | 15,000 | 1,000 | 18,016 | hydra. | 45 | 8 | 6.0 | | | | |

Existing accumulators have a gas side and a fluid side. In general only the fluid side can be recharged via the riser hydraulic lines. This is how the higher ambient pressure (as the operating depth of the BOP increases) decreases the volume subsea as the gas side becomes compressed due to ideal gas laws. To charge the gas side subsea an ROV is employed, which maybe cumbersome and requires venting the pressure upon retrieval. In embodiments using a laser fluid jet, where the fluid is a gas, e.g., $N_2$, a gas source may be by accumulation subsea, scavenging an existing line, adding a new line, and combinations and variations of these. In embodiments using a laser fluid jet where the fluid is a liquid, a source for this liquid may be to provide accumulation subsea, scavenge an existing line to the surface, or add a line to the surface, or install a pump, e.g., an electrically driven pump. In embodiments where a compound liquid and gas laser jet is utilized sources for both the gas and liquid will be provided. The source of fluid for the laser jet may be sea water, in which case for example the sea water may be pumped from the sea to form the jet, or used to fill an accumulator for discharge to form the jet. For example, seawater may be used with the laser and laser systems disclosed and taught in Ser. Nos. 61/734,809 and 61/786,763 the entire disclosures of each of which are incorporated herein by reference.

Figure 20:
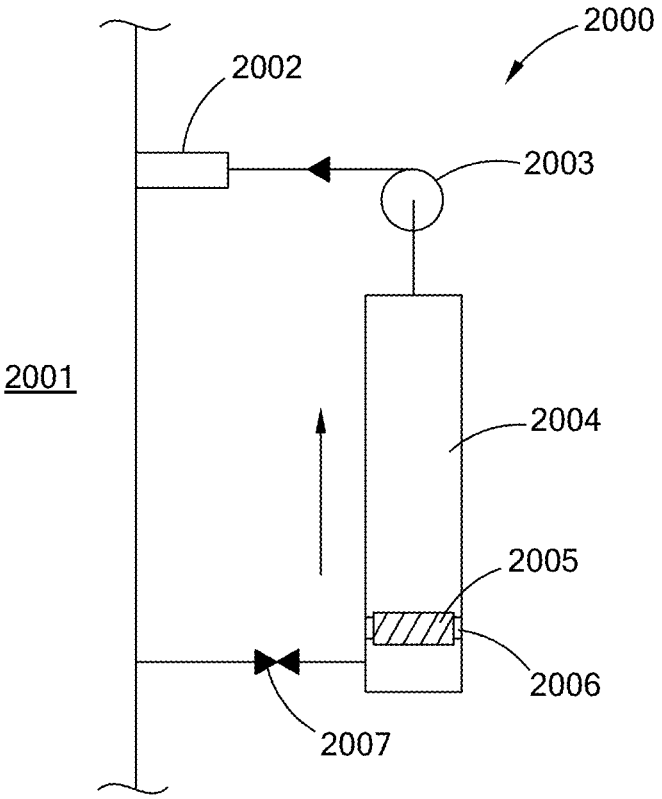
FIG. 20 is a schematic view of an embodiment of a laser fluid jet assembly in accordance with the present invention.

Generally, if a subsea tank is used to hold the fluid for the laser jet, it may be desirable for that tank to be pressure compensated to the well bore pressure. In this manner a pump or an accumulator would not have to overcome the well bore pressure (or at least would not have to overcome the amount of well bore pressure that is compensated for). For example, turning to FIG. 20 there is provided an embodiment of a well bore pressure compensated system 2000 for a laser jet 2002. Upon activation the valve 2007 would be opened causing the fluid in the BOP cavity 2001 to flow in and against the piston 2005, having seals 2006. Thus, the pressure from the BOP cavity is exerted against the bottom of the piston 2005, which pressurizes the laser jet fluid in the tank 2004 to the same pressure as is present in the BOP cavity 2001. In this manner the booster pump 2003, which preferably is a piston type pump, would not have to over come the BOP cavity pressure to create, e.g., shoot, launch, the fluid jet into the BOP cavity. A pressure intensifier may be used, and thus create the fluid jet without the need for a booster pump. If seawater is used for the laser jet fluid, it could be sucked through a filter into the pump for forming the jet.

Figure 8:
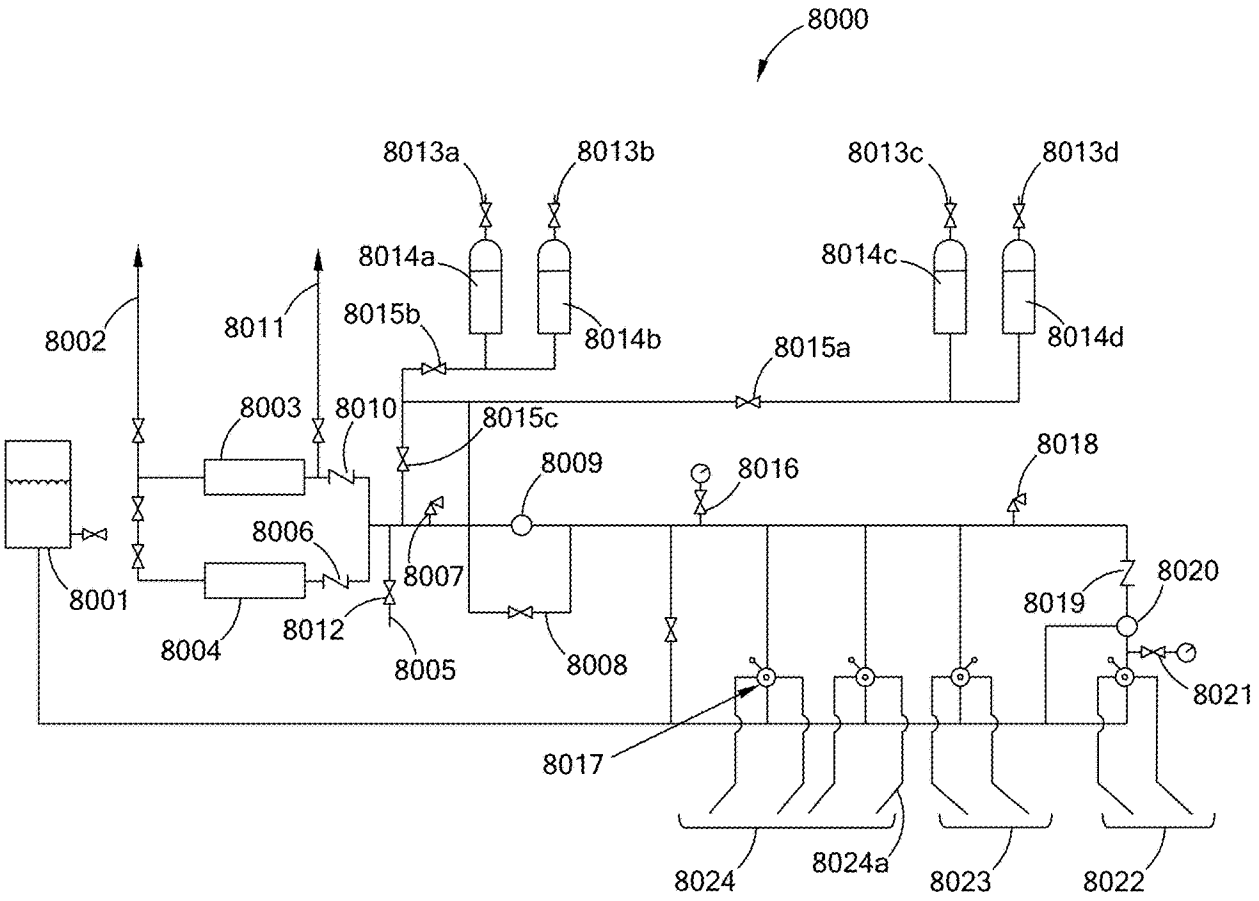
FIG. 8 is a schematic diagram of an accumulator system in accordance with the present invention.

Turning to FIG. 8 there is provided a schematic diagram of an embodiment of an accumulator system 8000 for providing potential energy to a BOP stack for use as, conversion into, mechanical energy, through the actuation of rams, in conjunction with a laser ram BOP system. Thus, in this embodiment the system 8000 has accumulator banks 8014*a*, 8104*b*, 8014*c*, 8014*d*, which have pre-charge valves 8013*a*, 8013*b*, 8013*c*, 8013*d* respectively associated with the accumulator banks. The accumulator banks are connected through tubing having full open valves 8015*a*, 8015*b*, 8015*c*, which in turn are in fluid communication through tubing with relief valve 8007, pressure regulator 8009 (e.g., 1,800-3,000 psi), and a regulator by-pass 8008. There is then a valve and gauge 8016, and a relief value 8018, which are located along the tubing which connects to the BOP rams 8024, to the laser shear ram 8024*a*, to the choke 8023, and to the annular BOP 8022. Four way valves, e.g., 8017, are associated with the rams, choke and annular. There is also associated and in fluid communication via tubing and valves in the system a check valve 8019, a pressure regulator (e.g., 0-1,500 psi, 0-10.3 Mpa), and a valve and gauge 8021. The system 8000 also has a fluid reservoir 8001; two pumps 8003, 8004, which are associated via tubing with a test fluid line 8002, a BOP test line or connection for another pump 8011, a check valve 8010, a check valve 8012, a connector for another pump 8005. Table 4 sets forth examples of powers and energy values that may be present and utilized in embodiments of such systems.

TABLE 4

| Example No. | Power in kW of delivered mechanical energy (based upon 15 second shear time) | Potential Energy kJ of Charged accumulator | Mechanical energy delivered by shear ram to laser effected area in kJ | Laser power in kW | Time of laser pattern delivery in seconds | Directed Energy delivered in kJ |
|---|---|---|---|---|---|---|
| 1 | 60 | >893 | 893 | 10 | 30 | 300 |
| 2 | 87 | >1,305 | 1,305 | 20 | 30 | 600 |
| 3 | 67 | >1,003 | 1,003 | 40 | 15 | 600 |
| 4 | 73 | >1,091 | 1,091 | 40 | 30 | 1,200 |
| 5 | 30 | >447 | 447 | 10 | 30 | 300 |
| 6 | 44 | >657 | 657 | 20 | 30 | 600 |
| 7 | 33 | >502 | 502 | 40 | 15 | 600 |
| 8 | 36 | >546 | 546 | 40 | 30 | 1,200 |
| 9 | 89 | >1340 | 1340 | 10 | 30 | 300 |
| 10 | 131 | >1958 | 1958 | 20 | 30 | 600 |
| 11 | 100 | >1505 | 1505 | 40 | 15 | 600 |
| 12 | 109 | >1637 | 1637 | 40 | 30 | 1,200 |
| 13 | 15 | >223 | 223 | 10 | 30 | 300 |
| 14 | 22 | >326 | 326 | 20 | 30 | 600 |
| 15 | 17 | >251 | 251 | 40 | 15 | 600 |
| 16 | 18 | >273 | 273 | 40 | 30 | 1,200 |
| 17 | 119 | >1786 | 1786 | 10 | 30 | 300 |
| 18 | 174 | >2610 | 2610 | 20 | 30 | 600 |
| 19 | 134 | >2006 | 2006 | 40 | 15 | 600 |
| 20 | 145 | >2182 | 2182 | 40 | 30 | 1,200 |

The use of a laser mechanical shear rams further provides the ability to use, require, the same amount of mechanical energy for shearing different sizes and types of tubulars. Because the laser can cut or weaken, these different size tubulars down to a structure that can be cut by the same mechanical ram, one laser shear ram may be configured to handle all of the different types of tubulars intended to be used in a drilling plan for a well. Thus, a further advantage that may be seen with a laser shear ram BOP stack is that the stack does not have to be changed, or reconfigured, or swapped out, to accommodate different sizes and types of tubulars that are being used during the advancement of a well. Thus, the BOP would not have to be pulled from the bottom to have rams changed for example to accommodate casing verse drill pipe. The elimination of such pulling and replacement activities can provide substantial cost savings, and avoids risks to personnel and equipment that are associated with pulling and rerunning the riser and BOP.

Figure 6:
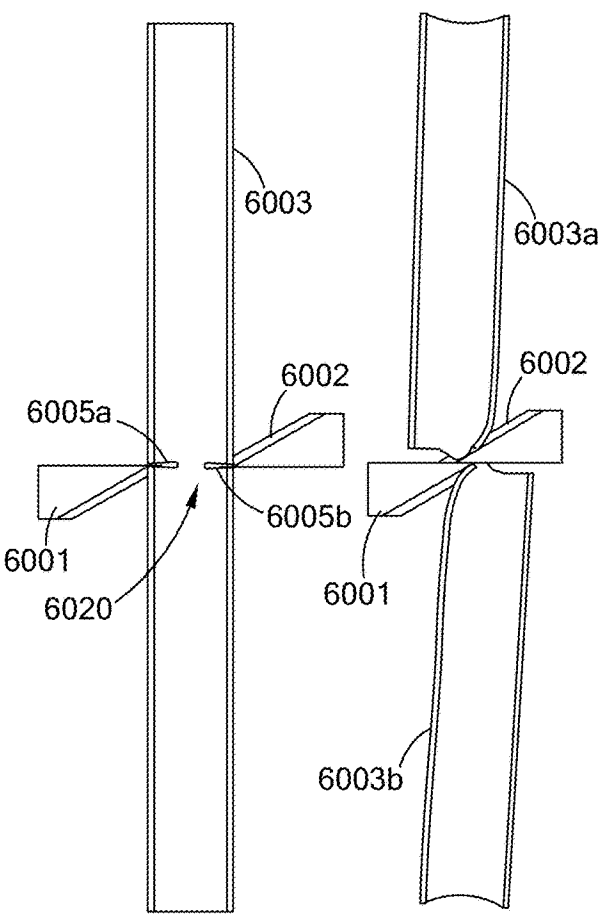
FIG. 6 is a schematic showing an embodiment of a pipe being sheared in accordance with the present invention.
Figure 5:
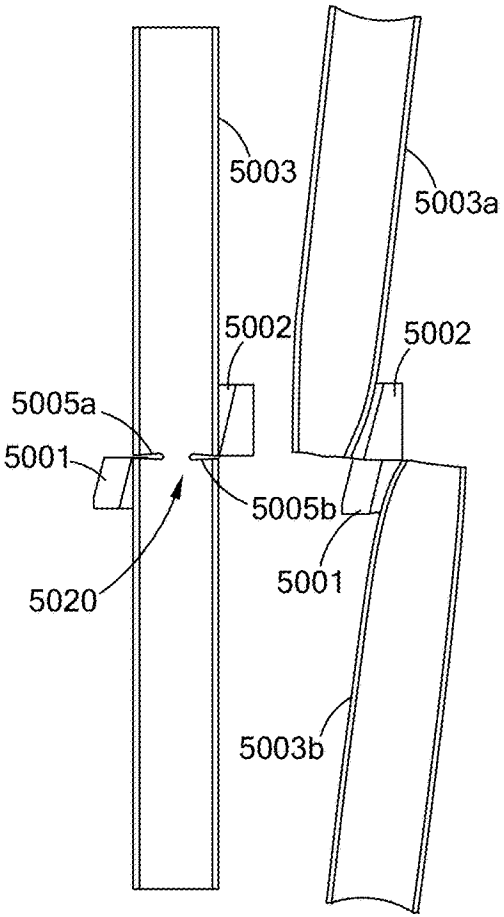
FIG. 5 is a schematic of an embodiment of a pipe being sheared in accordance with the present invention.
Figure 4:
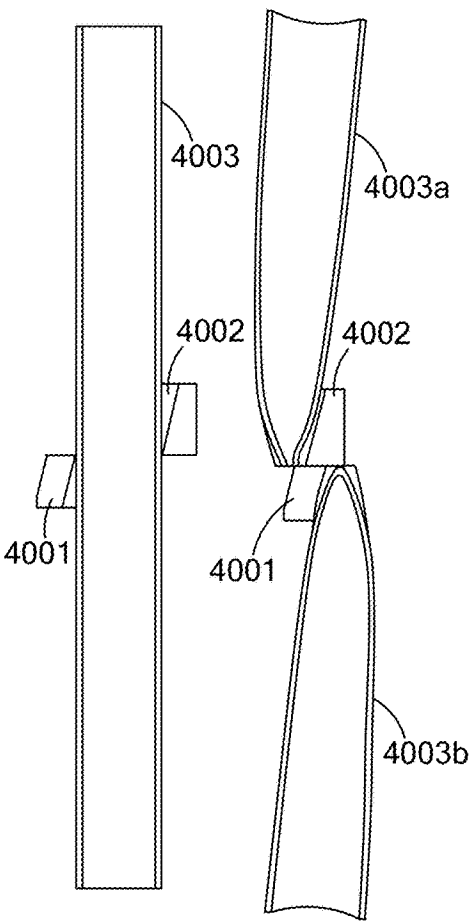
FIG. 4 is a schematic of an embodiment of a pipe being sheared.

FIG. 4, FIG. 5, and FIG. 6 schematically showing three examples of approaches to shearing a pipe located in a BOP cavity. In FIG. 8, there is shown the brute force solely mechanical manner of using the potential energy in the accumulators to force standard shape rams 4001, 4002 through the tubular 4003, creating two sections 4003*a*, 4003*b*, In FIG. 5, there is shown a tubular 5003 that has two laser cuts 5005*a*, 5005*b*, removing about 80% of is cross sectional area. Standard shear rams 5001, 5002 are then forced into and through the cut, e.g., weakened area 5020 of the tubular, severing it into two sections 5003*a*, 5003*b*. In FIG. 6, there is shown a tubular 6003 that has two laser cuts 6005*a*, 6005*b*, removing about 80% of is cross sectional area. Tapered shear rams 6001, 6002, e.g., ram wedges, are then forced into the cuts 6005*a*, 6005*b* forcing the tubular apart, along its longitudinal axis. The ram wedges 6001, 6002 move into and through the cut, e.g., weakened area of the tubular 6020, severing it into two section 6003*a*, 6003*b*.

Figure 7:
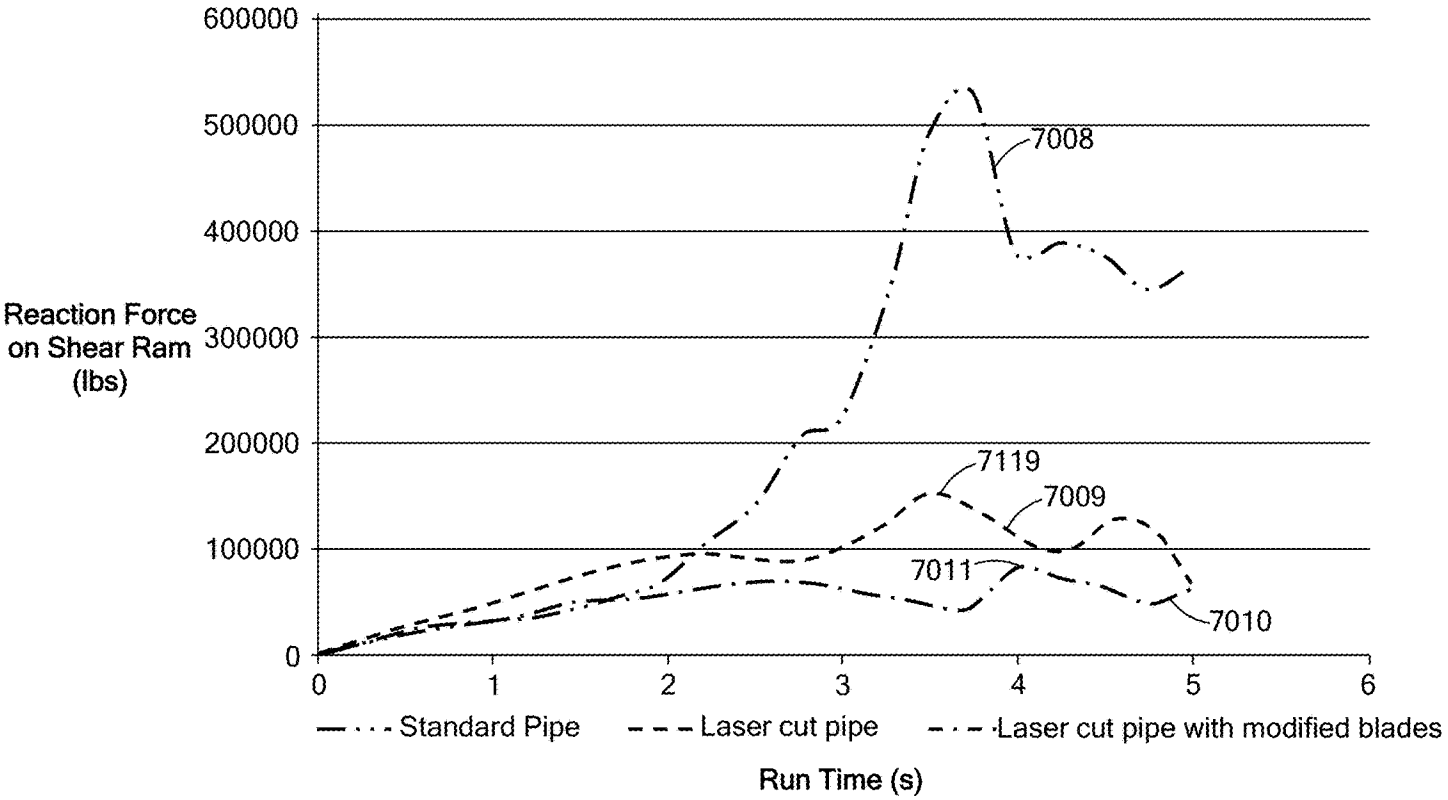
FIG. 7 is a chart providing computer simulation modeling data for the embodiments of FIGS. 4, 5, and 6.
Figure 9:
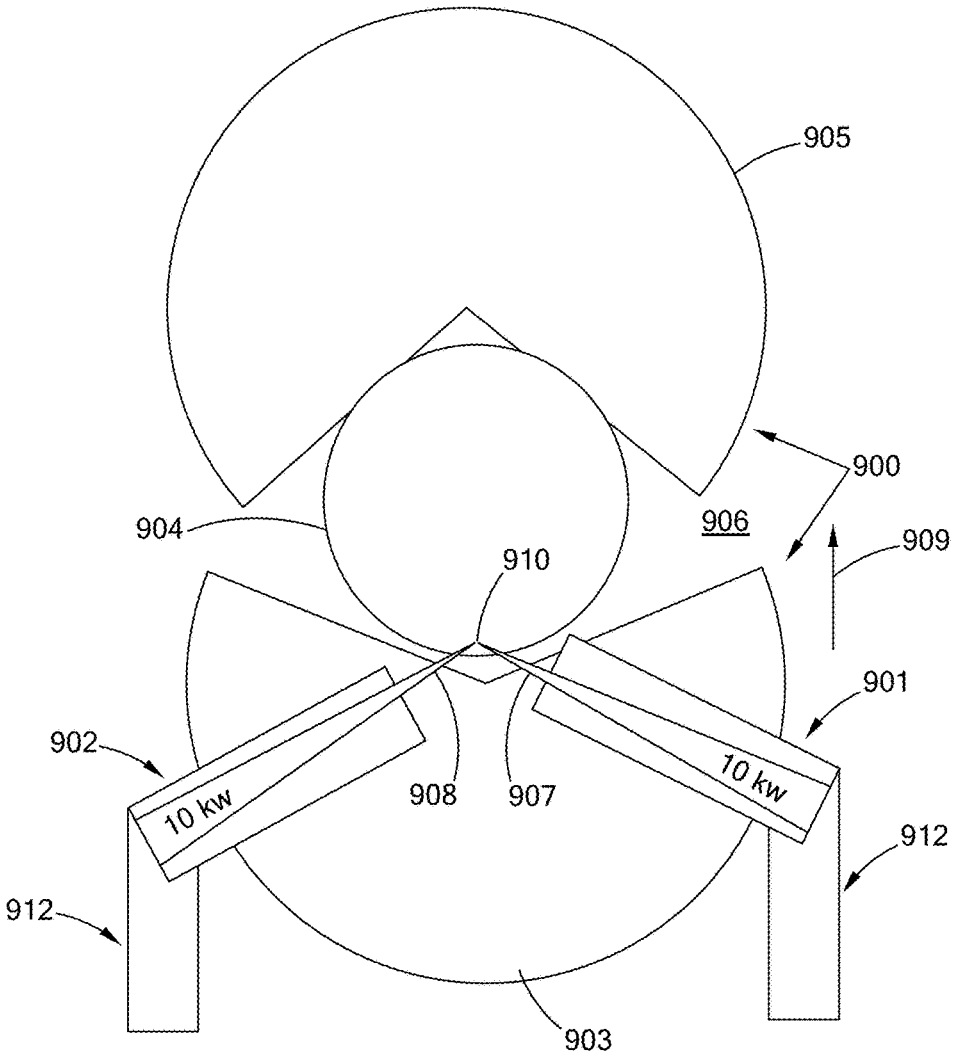
FIG. 9 is a schematic of an embodiment of a laser shear ram in accordance with the present invention.

In FIG. 7, there are provided computer simulation modeling of the three approaches shown in FIGS. 4, 5, and 6. Where line 7008 represents the approach of FIG. 4, line 7009 represents the approach of FIG. 5, and line 7010 represent the approach of FIG. 6. A comparison of these lines shows the considerable reduction in the force needed to sever the tubular after the tubular has been weakened by the laser cuts. Additionally, the peak force required to sever the cut tubulars, 7011 is reduced by about 75,000 lbs when the wedge rams 6001, 6002, are used, compared to the peak force 7019 for convention rams 901, 902 (both still being significantly reduced by the laser cuts, when compared with the non-laser cut 7008). In the simulation of FIG. 7 the pipe cross-section area reduction along shearing plane due to the laser cut is 80% laser cut. For the standard pipe simulation Ram Max. force (klbs) is 530.78 and Ram Avg. force (klbs) is 199.16. For the laser cut pipe simulation Ram Max. force (klbs) is 152.51 (a 71% reduction) and the Ram Avg. force (klbs) is 83.61 (a 58% reduction). For the laser cut pipe with modified blades simulation the Ram Max. force (klbs) is 82.33 (a 84% reduction) and the Ram Avg. force (klbs) is 49.08 (a 75% reduction). Turning to FIG. 9 there is provided a schematic representation of an embodiment of a laser shear ram. The laser shear ram configuration 900 has a moving block 903 and a stationary block 905. It being understood that a second moving block may be used. The moving block 905 has two laser delivery assemblies, 902, 903 associated with it. Each laser delivery assembly 901,902 is optically associated with a source of a high power laser beam to provide the delivery of a 10 kW, or greater, laser beam to the tubular 904, which is located between the blocks 903, 905 in the BOP cavity 906. In this embodiment each laser delivery assembly will deliver the laser beam to the pipe 904 in the BOP cavity. If a second moving block is used, that moving block may also have two laser delivery assemblies configured in a similar manner to delivery assemblies 901, 902. In operation the laser beams are fired, i.e., the laser beams are propagated from the laser delivery assemblies 901, 902 and travel along their respective beam paths 907, 908 to strike and cut the tubular 904. As block 903 moves forward, further into the cavity 906, along the direction of arrow 909, the laser beams are moved along, and through, the side of the tubular 904, cutting a slot in the tubular 904. In this embodiment the laser beams' focal points are located at an area 910, which is about where the beams first strike the tubular 904, and preferably slightly behind the inside wall of the tubular. Thus, as the bock 903 moves forward the laser beams will be striking the tubular at locations along the beam paths that are progressively further removed from the beams focal points, providing for a slot that increases in width from its starting point to its endpoint. This increase in width is proportional to the focal length of the laser beams.

Figure 13:
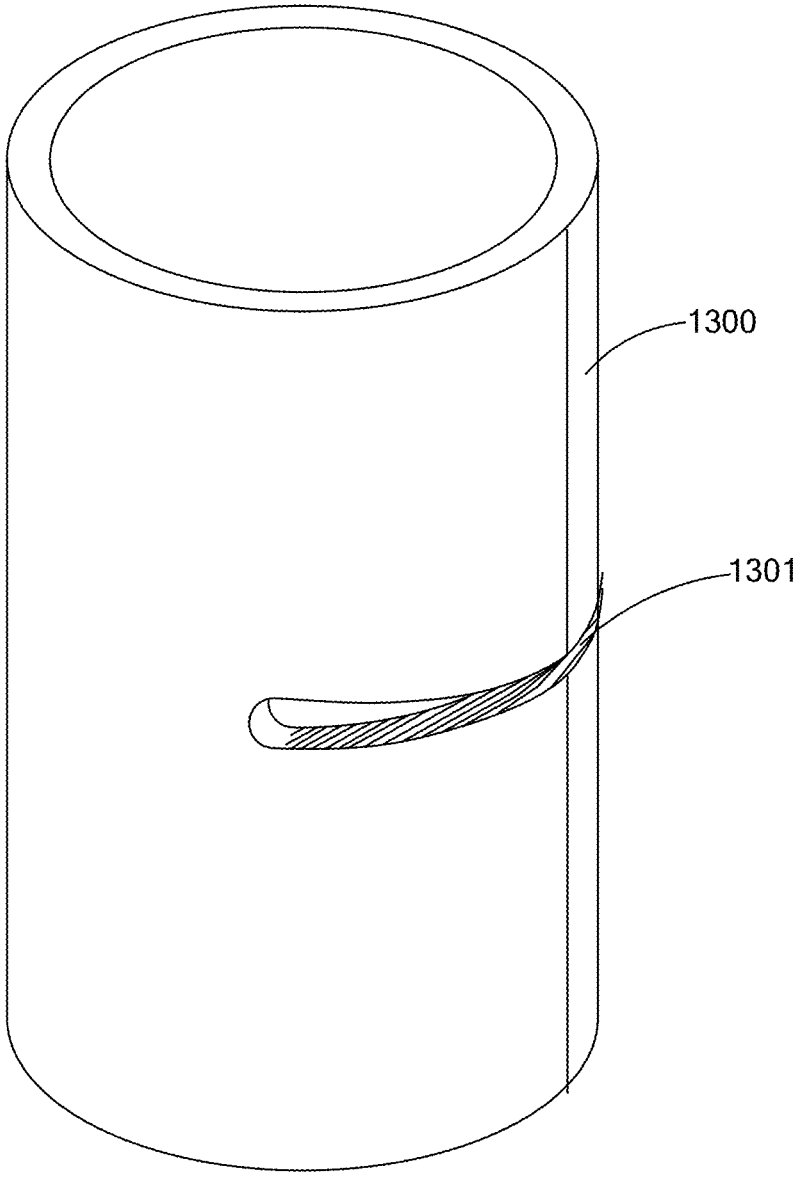
FIG. 13 is a perspective view of an embodiment of a slot in a tubular in accordance with the present invention.
Figure 14:
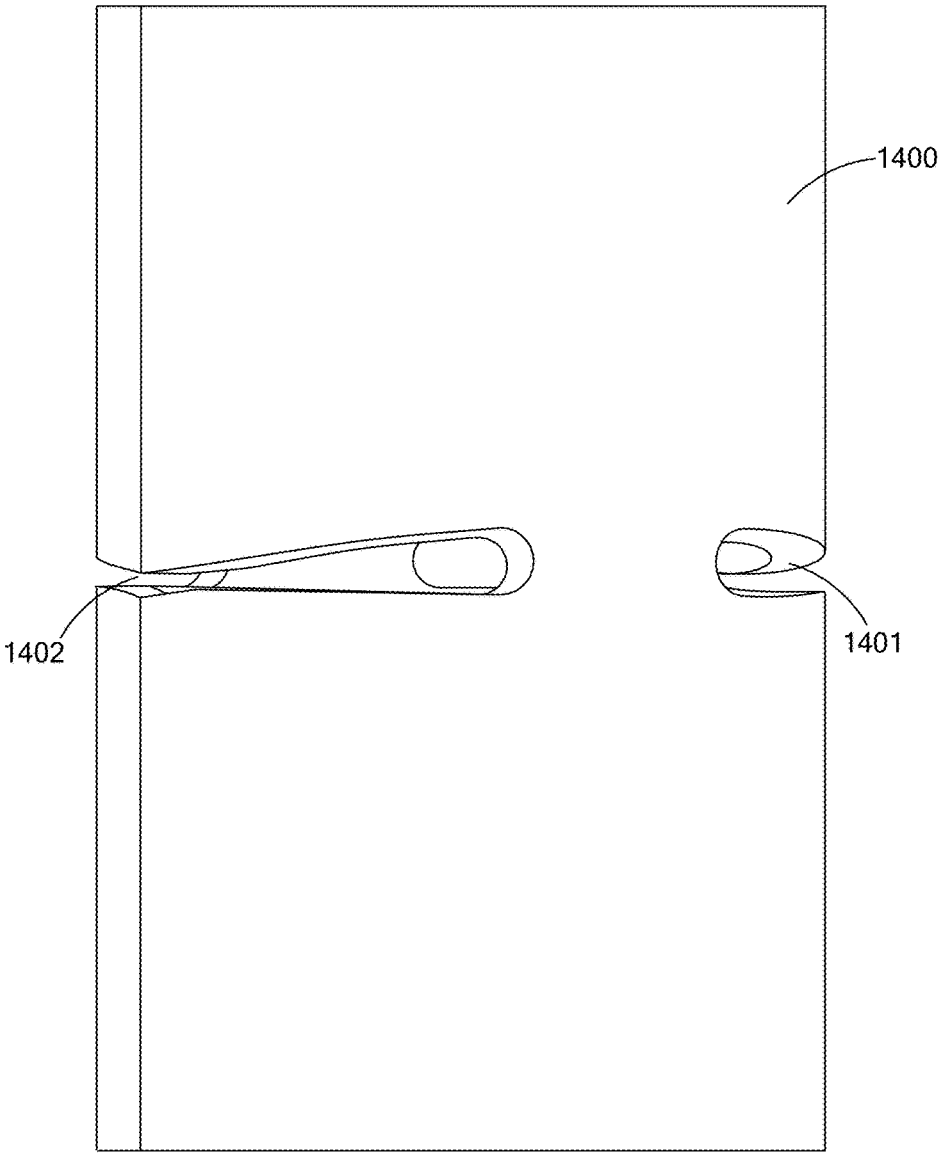
FIG. 14 is a perspective view of an embodiment of a slot in a tubular in accordance with the present invention.
Figure 15A:
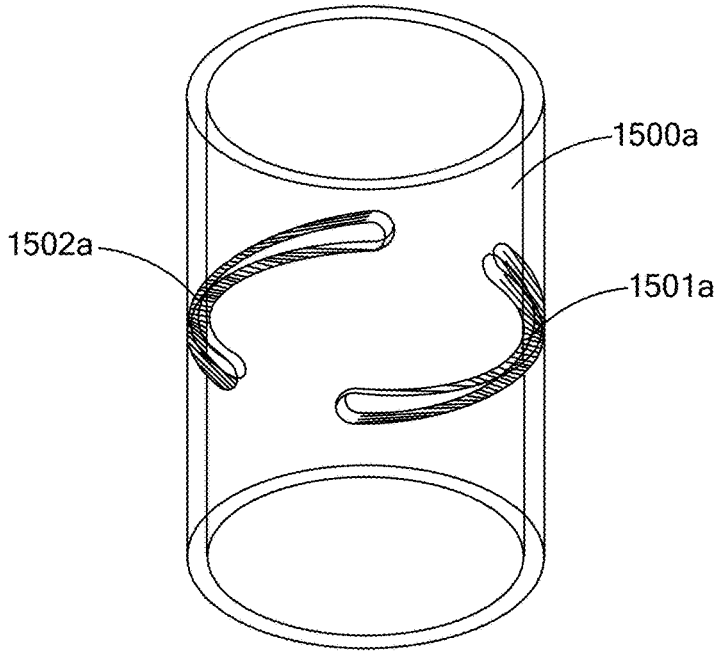
FIG. 15A is a perspective view of an embodiment of a slot in a tubular in accordance with the present invention.
Figure 15B:
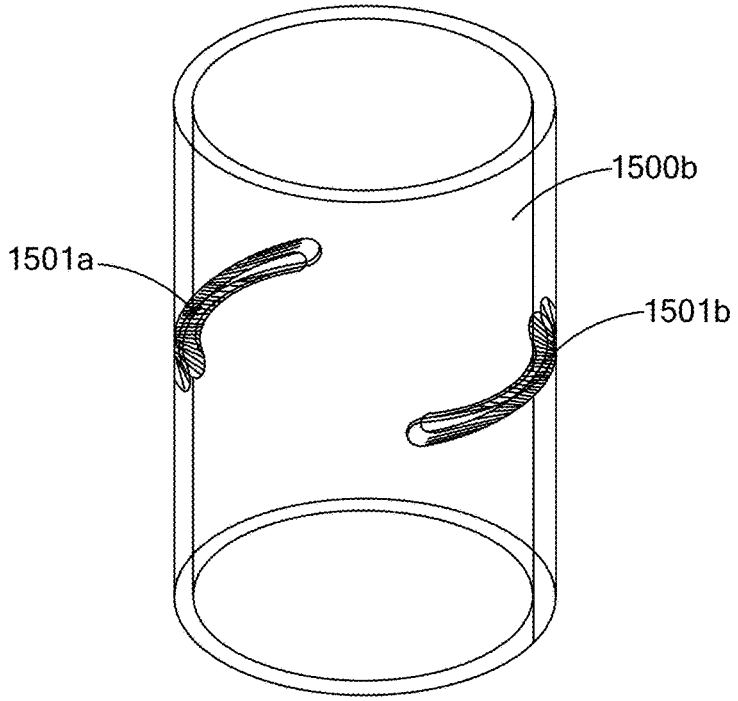
FIG. 15B is a perspective view of an embodiment of a slot in a tubular in accordance with the present invention.
Figure 21:
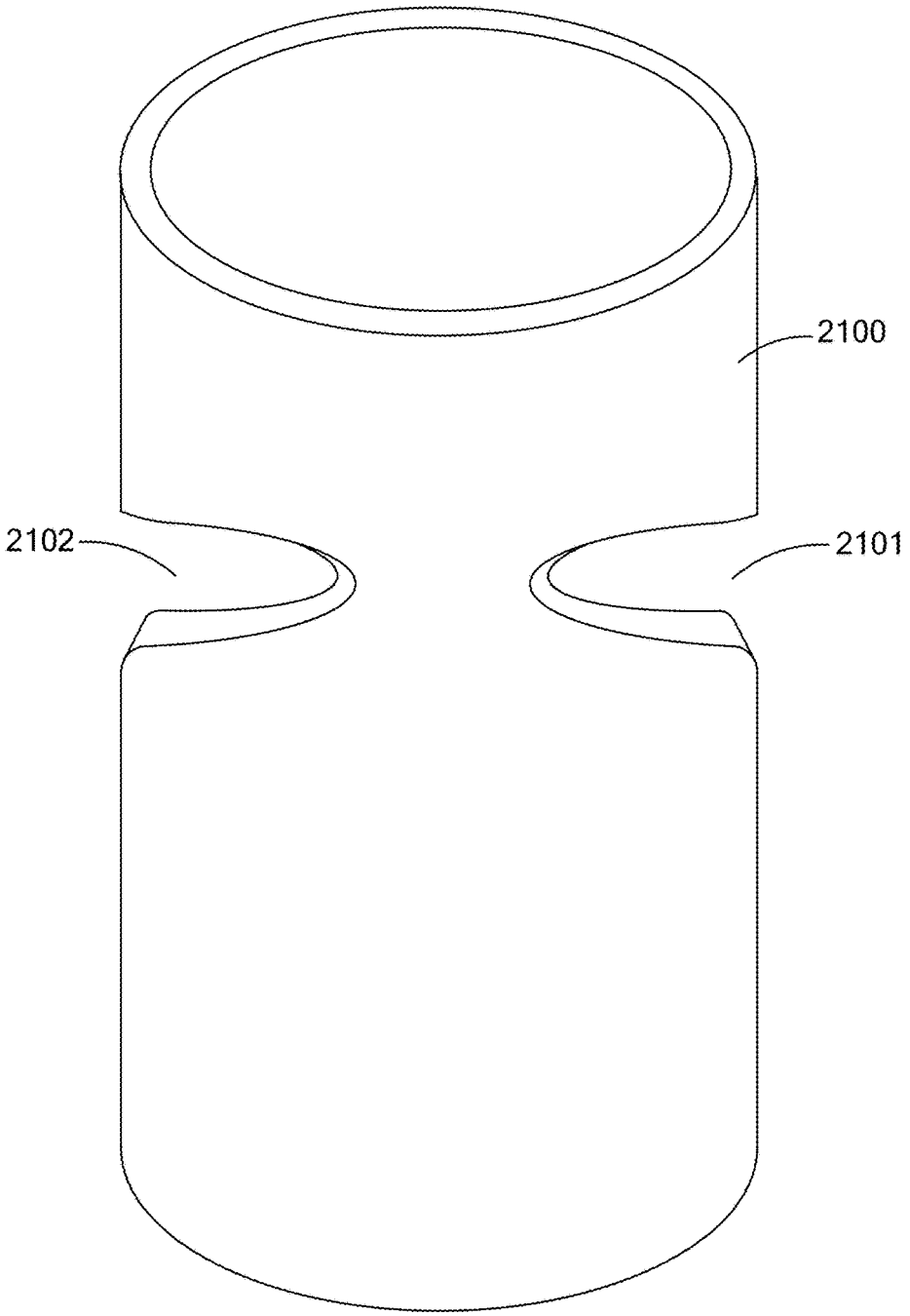
FIG. 21 is a perspective view of an embodiment of a slot in accordance with the present invention.
Figure 22:
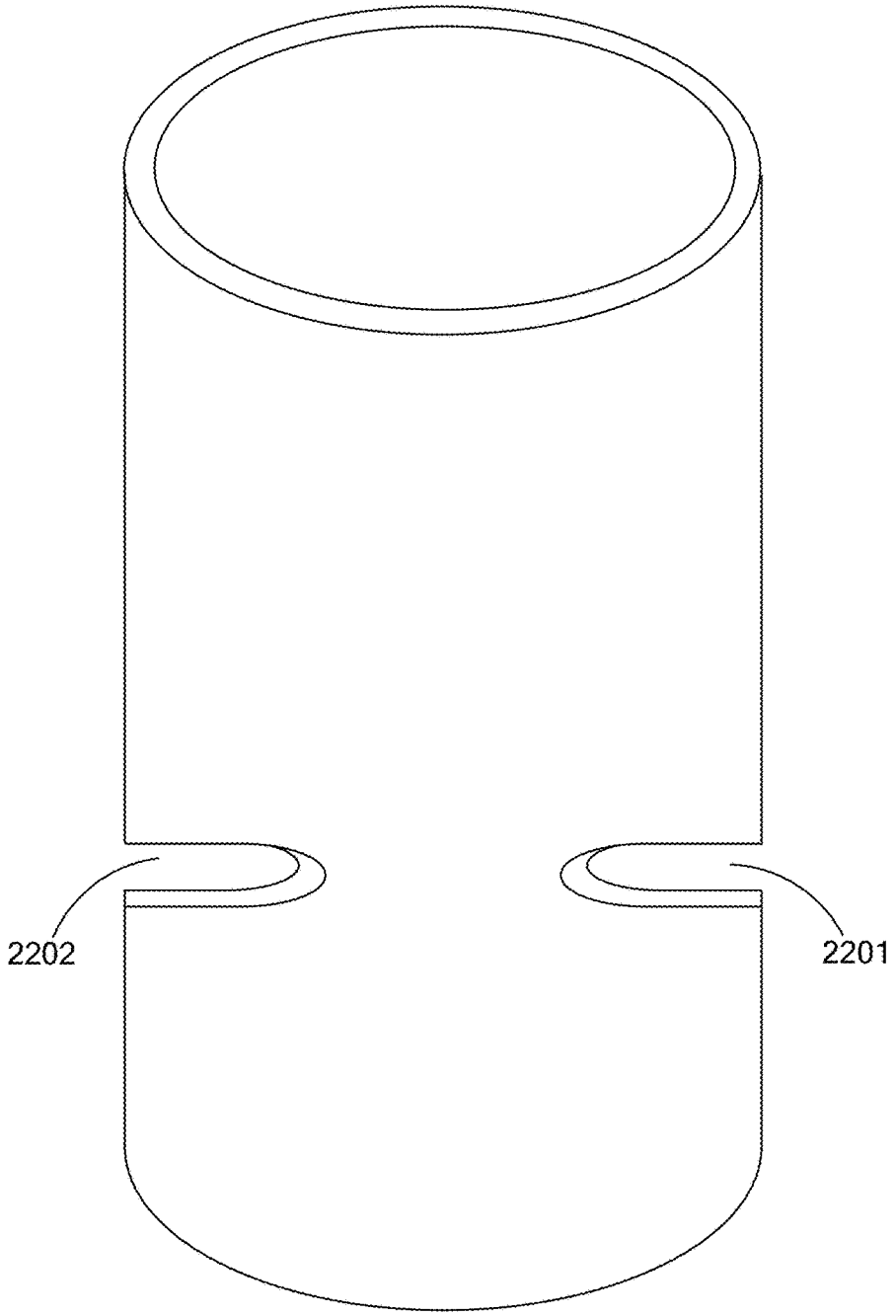
FIG. 22 is an embodiment of a slot in accordance with the present invention.

Examples of such varying width cuts are shown in FIGS. 12, 13, 14, 15A, 15B, and 21; and examples of a uniform width cut is shown in FIG. 21. Thus, in FIG. 12 there is shown a single cut 1201, in tubular 1200. The cut 1201 has a length shown by arrow 1210, and a width. The width changes from narrow 1220 to wide 1221. The wide end of the cut is essentially circular, but could be other shapes, e.g., oval, diamond, square, keyed, etc., based upon the shape and position of the laser beam. In FIG. 13 there is shown a single cut, which may be viewed as two of the cuts of FIG. 12 joined at their narrow ends. This type of cut may be formed by the embodiment of the laser shear ram of FIG. 10. FIG. 14 is a view of a similar type of cut to the embodiment shown in FIG. 13. In the embodiment of FIG. 14, there are two cuts 1402, 1403 each having a narrow or neck center section and wider rounded ends. FIGS. 15A and 15B show that different cross-sectional areas of the tubular may be removed, e.g., cut out, by the laser, with a greater cross-sectional area being removed in FIG. 15A as compared to FIG. 15B. Thus, at least about 10%, at least about 25%, at least about 50%, at least about 75%, at least about 80% and at least about 90%, or more, of the cross-sectional area may be removed by the laser cut (or slot). Viewing the same property in a different manner, the length of the laser slot or cut in the tubular may be about 10%, at least about 25%, at least about 50%, at least about 75%, at least about 80%, and at least about 90%, or more, of the outside circumference of the tubular. It being understood that less than 10%, e.g., a small penetrating shot, and 100%, i.e., the laser completely severing the tubular, may employed.

Figure 10:
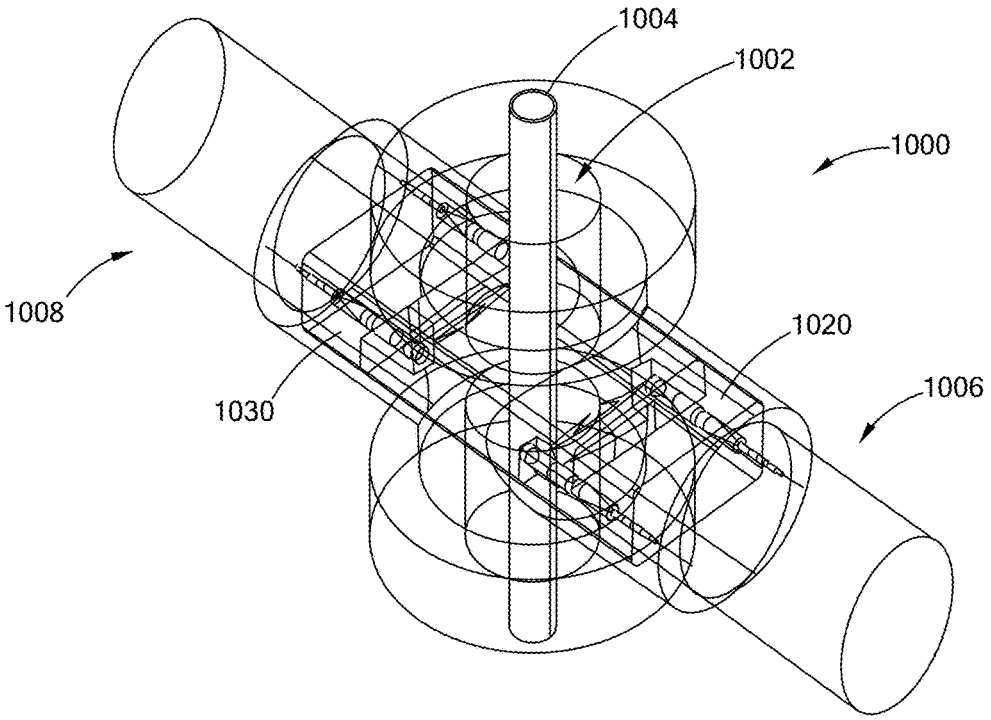
FIG. 10 is a perspective view of an embodiment of a laser shear ram in accordance with the present invention.
Figure 10A:
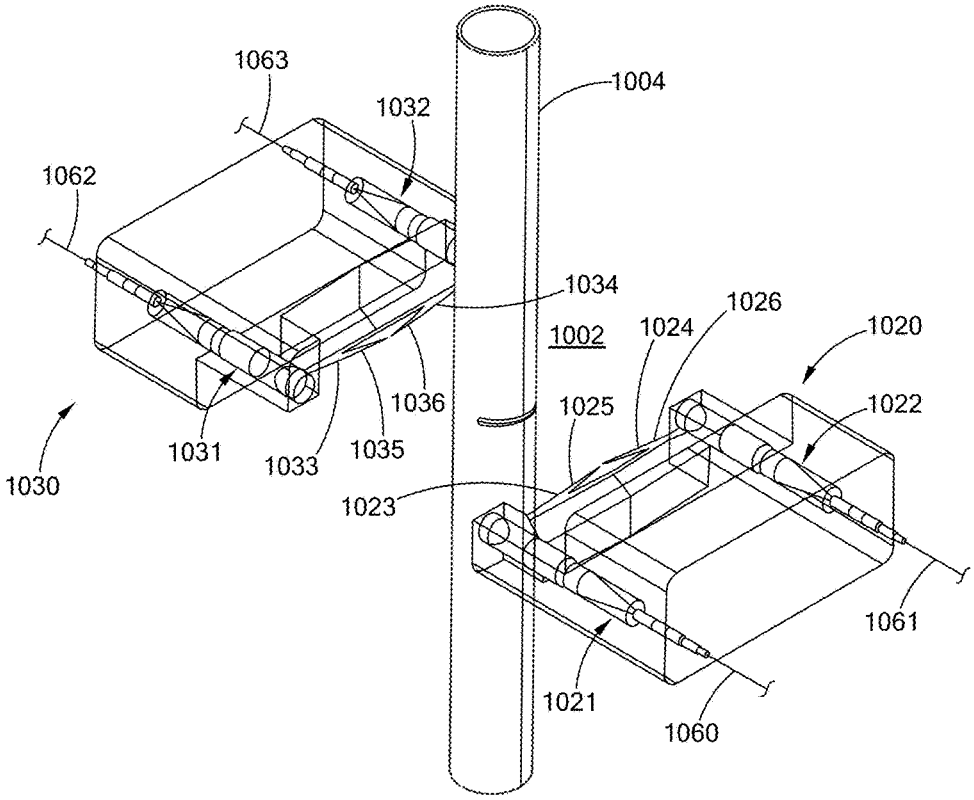
FIG. 10A is a perspective view of components of the embodiment of FIG. 10.
Figure 10B:
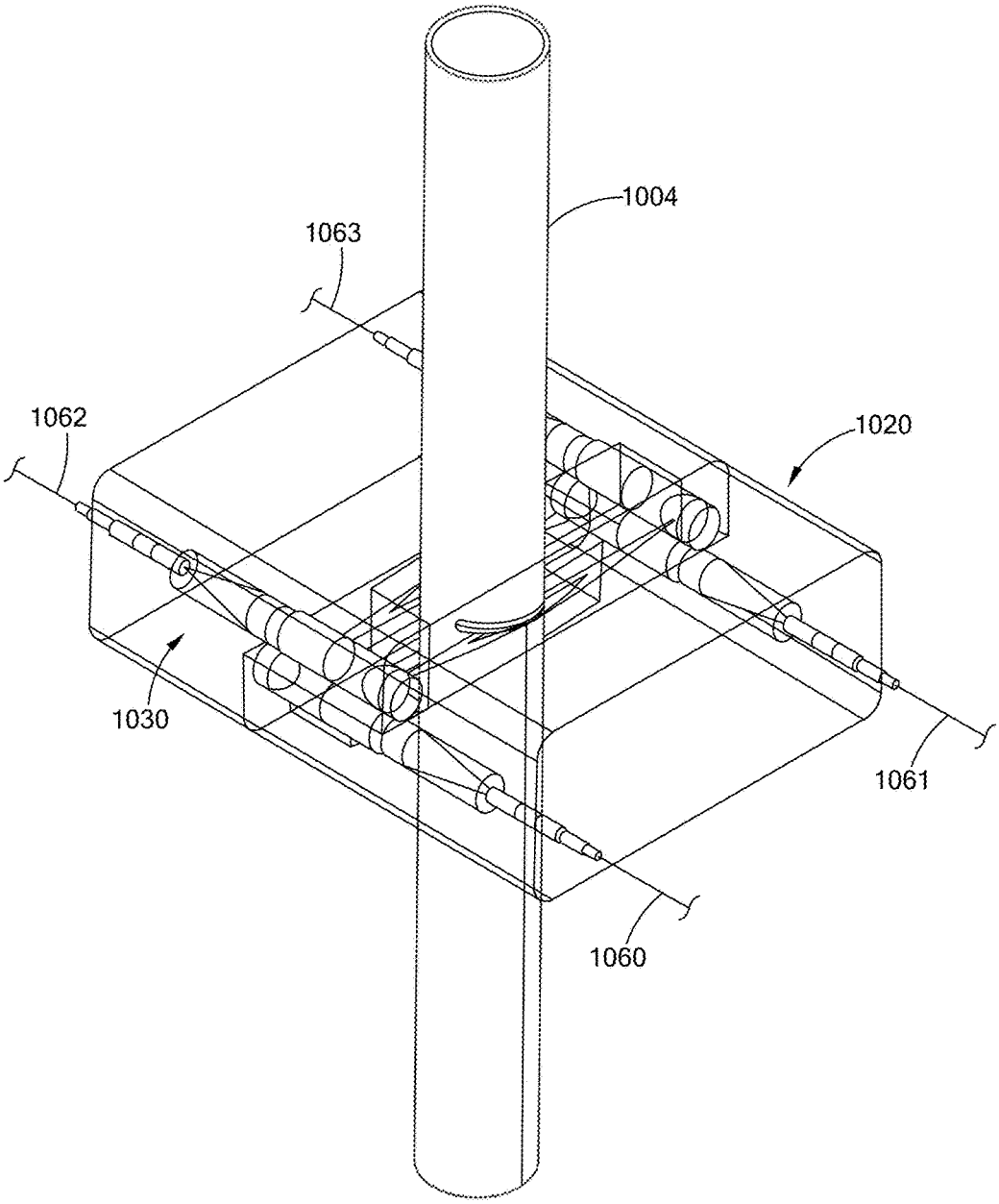
FIG. 10B is a perspective view of components of the embodiment of FIG. 10.

FIG. 10 is a perspective schematic view of an embodiment of a laser shear ram BOP, and FIGS. 10A and 10B are components of that shear ram BOP, which are all shown in ghost or phantom lines to illustrate both outer and inner components of the assembly. The laser shear ram BOP 1000 has a cavity 1002 that has a tubular, e.g., drill pipe 1004, in the cavity. (The total length of the drill pipe is not shown in this drawing, and may be hundreds, thousands, and tens-of-thousands of feet.) The laser shear ram BOP 1000 has two piston assemblies 1006, 1008 that drive, e.g., move, laser shear rams 1020, 1030 respectively into and out of the BOP cavity 1002. The pistons may be driven, for example, by an accumulator system, such as shown in the embodiment of FIG. 8. Turning to FIG. 10A there is shown, in ghost or phantom lines, the internal laser delivery assemblies for the rams 1020, 1030. (which may also be referred to as ram blades, ram blocks, blades or blocks). Ram 1020 has a first laser delivery assembly 1021, and a second laser delivery assembly 1022. Each laser delivery assembly 1021, 1022, is capable of, and propagates a laser beam 1023, 1023 respectively along laser beam paths 1024, 1026. The laser beam and beam path may be along a fluid jet. Ram 1030 has a first laser delivery assembly 1031, and a second laser delivery assembly 1032. Each laser delivery assembly 1031, 1032, is capable of, and propagates a laser beam 1033, 1033 respectively along laser beam paths 1034, 1036. The laser beam and beam path may be along a fluid jet. High power optical cables, 1060, 1061, 1062, 1063 are shown and provide high power laser energy from a high power laser, and may also transport the fluid(s), for the formation of a fluid laser jet.

By way of example, the laser delivery assemblies and optical cables may be of the type disclosed and taught in the following US patent application publications and US patent applications: Publication Number 2010/0044106; Publication Number 2010/0044105; Publication Number 2010/0044103; Publication Number 2010/0215326; Publication Number 2012/0020631; Publication Number 2012/0074110; Publication No. 2012/0068086; Ser. No. 13/403,509; Ser. No. 13/486,795; Ser. No. 13/565,345; Ser. No. 61/605,429; and Ser. No. 61/605,434 the entire disclosures of each of which are incorporated herein by reference.

The laser beams in the embodiment of FIG. 10, preferably are each about 10 kW. The laser beams may have different powers, e.g., one beam at 10 kW, two beams at 20 kW and a fourth beam at 5 kW, they may all have the same power, e.g., each having 10 kW, each having 15 kW, each having 20 kW. Greater and lower powers, and variations and combinations of the forgoing beam power combinations may be used. FIG. 10B shows the laser rams of FIG. 10A in the completely closed and sealing position after the pipe has been severed.

Figure 11:
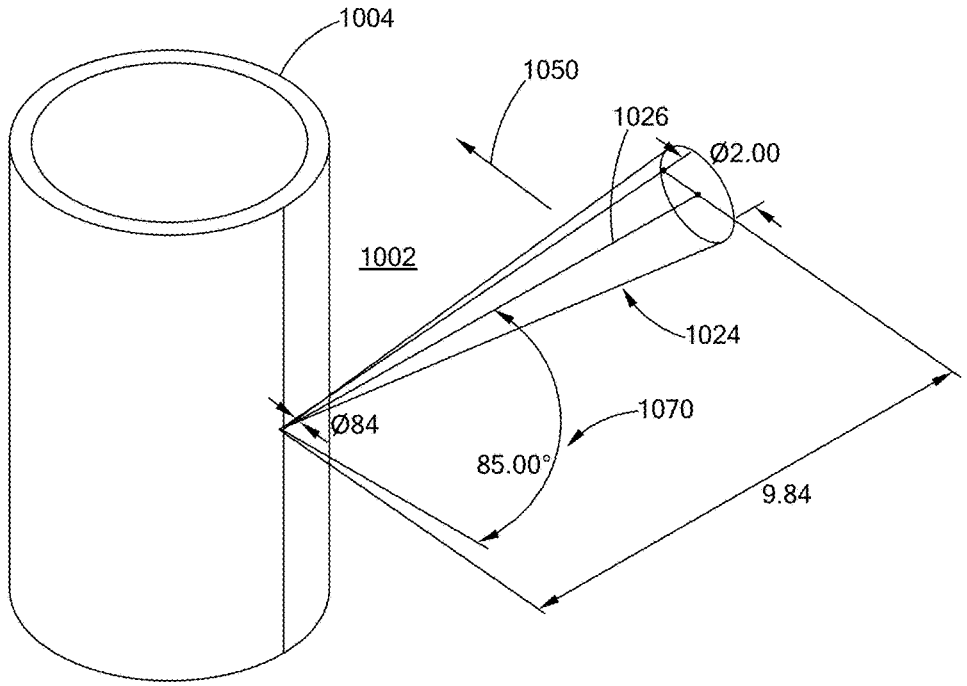
FIG. 11 is a illustration of an embodiment of laser beam path and laser beam positioning in accordance with the present invention.
Figure 12:
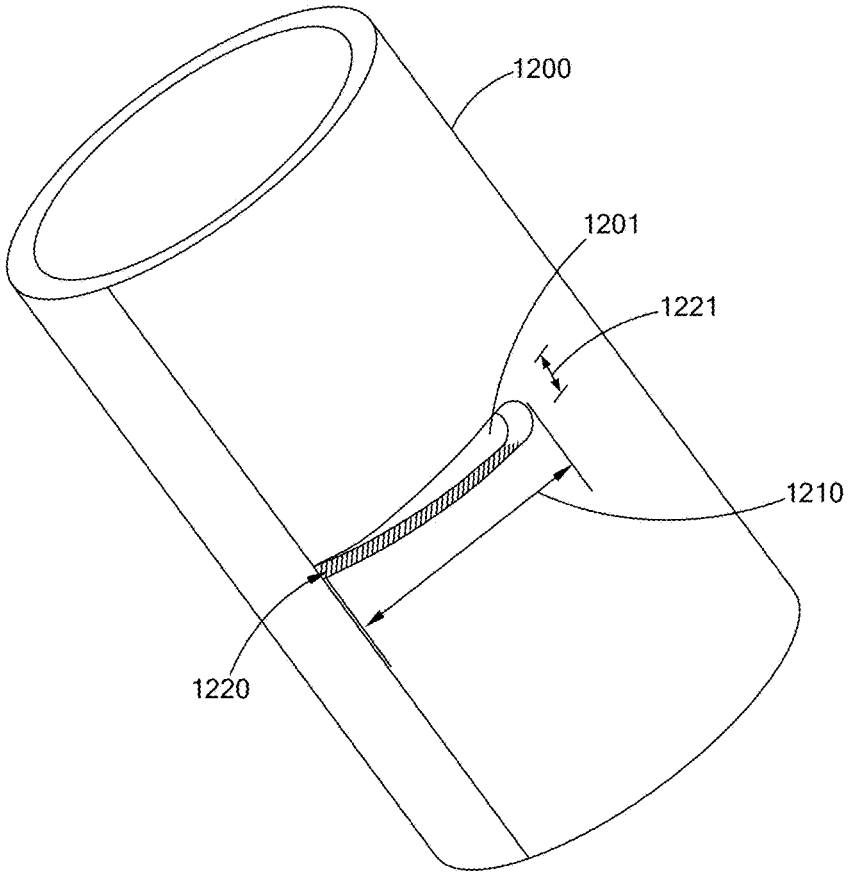
FIG. 12 is a perspective view of an embodiment of a slot in a tubular in accordance with the present invention.

FIG. 11 is a schematic perspective view of the relative position and characteristics of the laser beam path 1026 and laser beam 1024 with respect to the pipe 1004 in the BOP cavity 1002. For clarity, only one of the four laser beam paths and laser beams of the embodiment of FIG. 10 is shown in FIG. 11. It being understood that for this embodiment the other three beam paths, 1025, 1035, 1036, and the other three laser beams 1023, 1033, 1034 are the same. In other embodiments the beam paths and beams may be different, and more or less beams and beam paths my be utilized. The arrow showing 9.84 inches is the distance from the center of the BOP cavity (18¾ inch diameter) to the face of the laser jet. Which in this embodiment is about ½ inch removed from the cavity. The beam path angle 1070, which in this embodiment is 85.00°, is the angle of the beam path with respect to the ram actuator centerline.

The beam path angle may be greater than and smaller than 85°. Thus, for example, it may be about 70°, about 75°, about 80°, about 90°, about 95°, and about 100°. The beam path angle is, in part, based upon the position of the laser beam device's launch point for the laser beam, the desired shape of the cut(s) in the tubular, and the angle of the leading face of the block (to preferably prevent the laser beam from striking or being directed into that face of the block). In laser shear rams having multiple laser beams and laser beam paths, the beam path angles may be the same or different.

The position of the laser induced flaws, e.g., slots, cuts, etc., may be normal to, parallel to, or some other angle with respect to the ram actuator centerline.

Figure 16A:
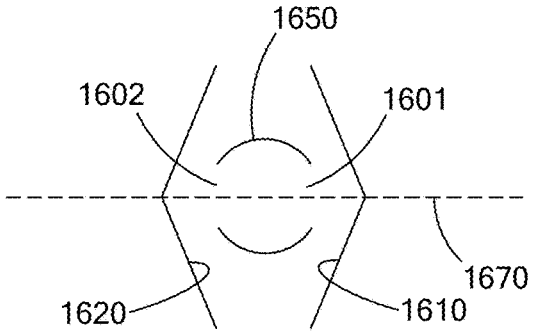
FIG. 16A is a schematic view of an embodiment of a slot position relative to laser rams in accordance with the present invention.
Figure 16B:
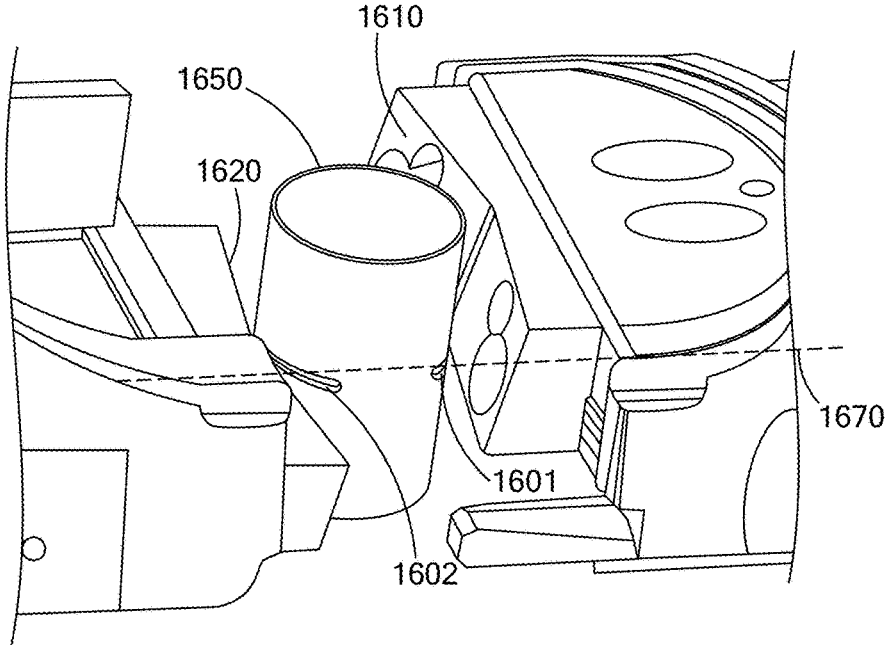
FIG. 16B is a perspective view of an embodiment of a slot position relative to laser rams in accordance with the present invention.

In FIG. 16B there is provided a perspective view of rams engaging a cut tubular and in FIG. 16A a top view schematic of this configuration. Thus, Ram faces 1610, 1620 are engaging the tubular 1650 that has cuts 1601, 1602, which are positioned normal to the ram actuator centerline 1670. (It being noted that the remaining tubular cross sectional material, i.e., uncut material, is parallel to the ram actuator centerline.)

Figure 17A:
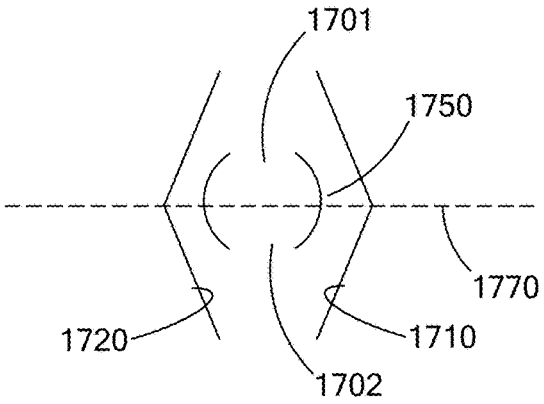
FIG. 17A is a schematic view of an embodiment of a slot position relative to laser rams in accordance with the present invention.
Figure 17B:
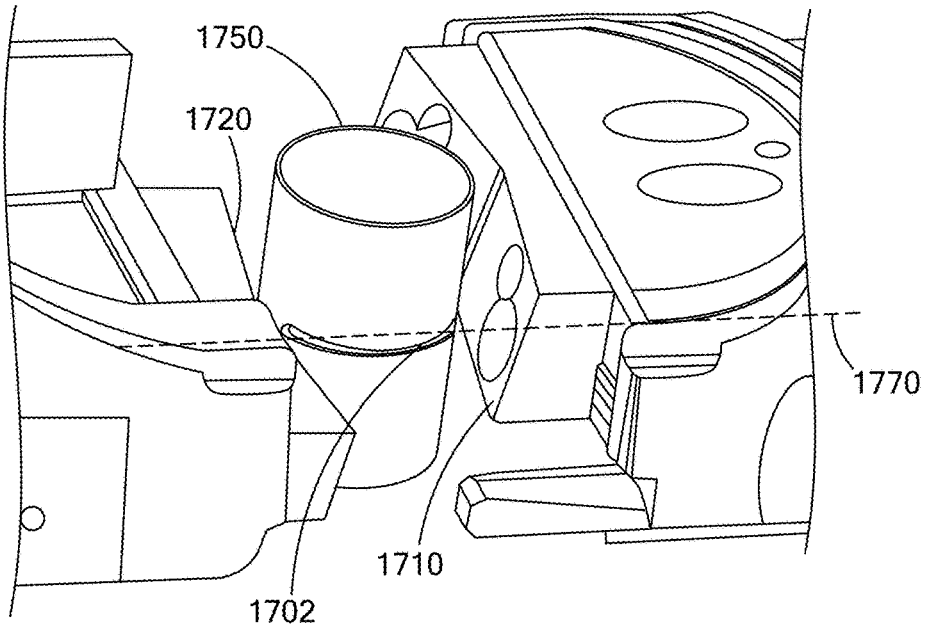
FIG. 17B is a perspective view of an embodiment of a slot position relative to laser rams in accordance with the present invention.

In FIG. 17B there is provided a perspective view of rams engaging a cut tubular and in FIG. 17A a top view schematic of this configuration. Thus, Ram faces 1710, 1720 are engaging the tubular 1750 that has cuts 1701, 1702, which are positioned parallel to the ram actuator centerline 1770, (It being noted that the remaining tubular cross sectional material, i.e., uncut material, is normal to the ram actuator centerline.)

Figure 18:
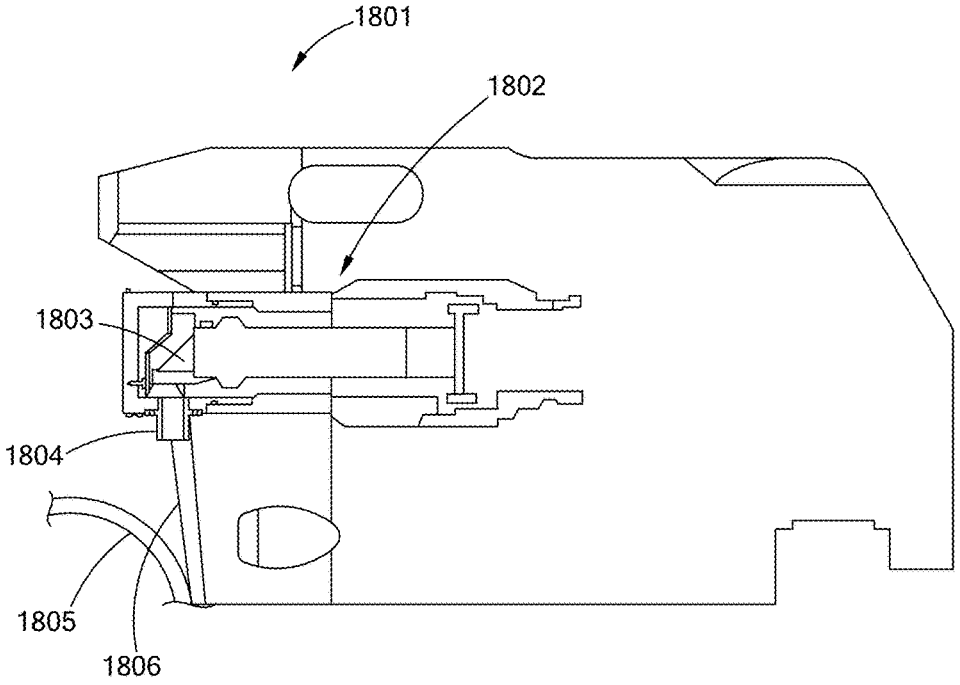
FIG. 18 is a cross sectional view of an embodiment of a laser delivery assembly in an embodiment of a laser ram shear in accordance with the present invention.

FIG. 18 is an illustrated diagram of an embodiment of a section of a ram block 1801, having a laser delivery device 1802 integrated into the block. The laser delivery device 1802 has a prism 1803, a laser jet nozzle 1804 that is directed toward the pipe 1805 to be cut by blade face 1806.

Laser delivery devices may be used for emergency disconnection of any of the components along a deployed riser BOP package to enable the drilling rig to move away from (either intentionally, or unintentionally such as in a drift-off) the well and lower BOP stack. The laser delivery devices may be placed at any point, but preferably where mechanical disconnects are utilized, and should the mechanical disconnect become inoperable, jammed, or otherwise not disconnect, the laser device can be fired cutting though preselected materials or structures, such as the connector, bolts, flanges, locking dogs, etc. to cause a disconnection.

Figure 23:
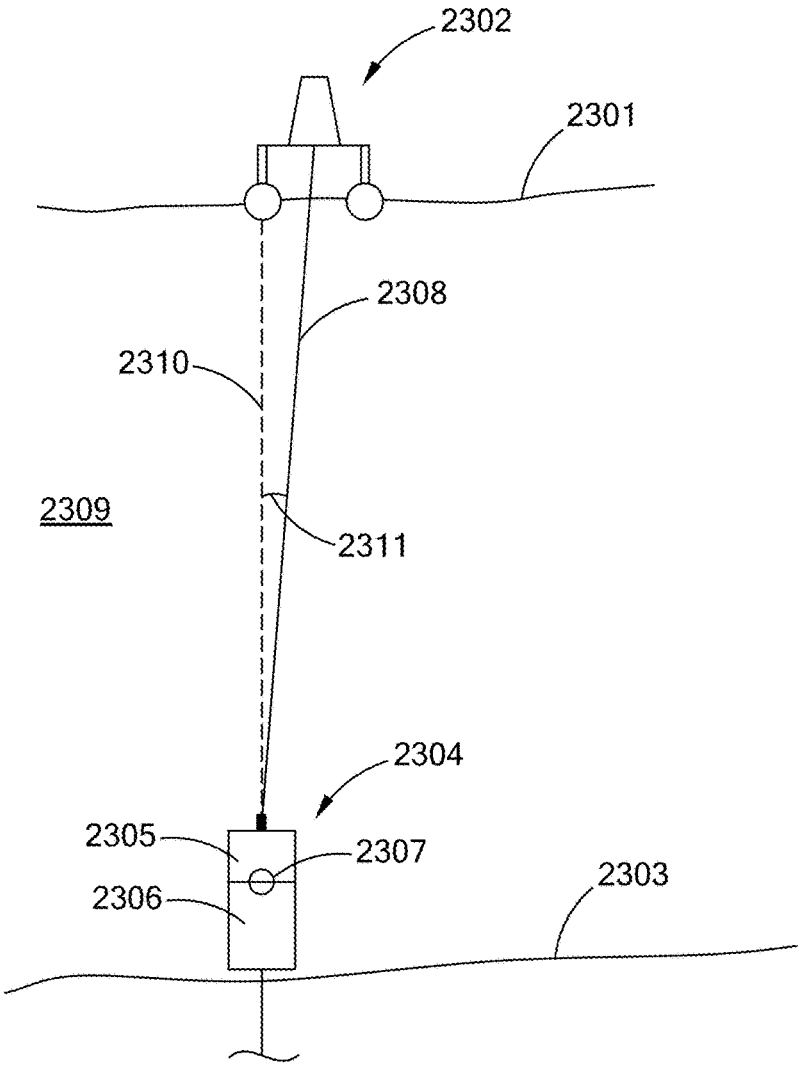
FIG. 23 is a schematic of a LMRP connector ESD (Emergency System Disconnect) in accordance with the present invention.
Figure 23A:
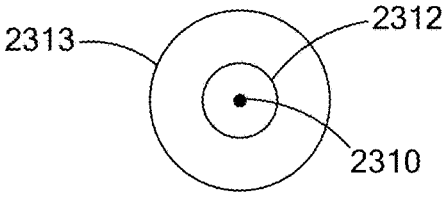
FIG. 23A is an illustration of rig position for an LMRP connector ESD in accordance with the present invention.

Turning to there is shown a schematic of a rig 2301 on a surface 2301 of a body of water 2309 that is connected to a BOP stack 2304 on the sea floor 2303 by way of a riser 2308. The BOP stack 2304 has a LMPR 2305 that is attached to the lower BOP stack 2306 by way of a connector 2307. The connector may be, for example, a VETCOGRAY H-4® Connector. When the drilling rig moves a certain distance away from being directly above the well and BOP, i.e., moves away from the vertical axis or centering line 2311, the connector 2307 may be come jammed. When the angle 2311 formed between the centering line 2311 and the riser, (or the line between the top of the BOP and the rotary table of the drill ship) becomes large enough, at times around 2-4°, generally around 5°, and in some cases slightly more, the connector 2907 engagement-disengagement mechanism can become inoperable, jamming the connector and thus preventing it from being unlocked, and preventing the LMRP from being able to be disconnected from the lower stack. This distance that the rig 2902 is from the centerline 2310 can also be viewed, as shown in FIG. 23A, as a series of circles showing the distance of the rig form the centerline. Thus, the inner circle 2312 may correspond to a distance where the angle 2311 is not larger enough to prevent the connector from disconnecting and the outer circle 2313 is the farthest away from centerline where the connector can be safely and reliably disconnected.

To increase the angle at which the rig can be off the centerline, i.e., increase the size of the area, e.g., the diameter of the outer sage circle in FIG. 23A, laser devices may be associated with the connector 2307. In this manner the laser beam may be directed to a specific component of the connector, severing that component, freeing the mechanical comments to then operate and disengage. In this manner the operating angle can be increased, and any damage to the connector from the laser minimized. The laser device, or a second laser device, may also be associated with the connector in a manner that completely cuts the connection, should the mechanical components fail to operate properly.

Figure 24:
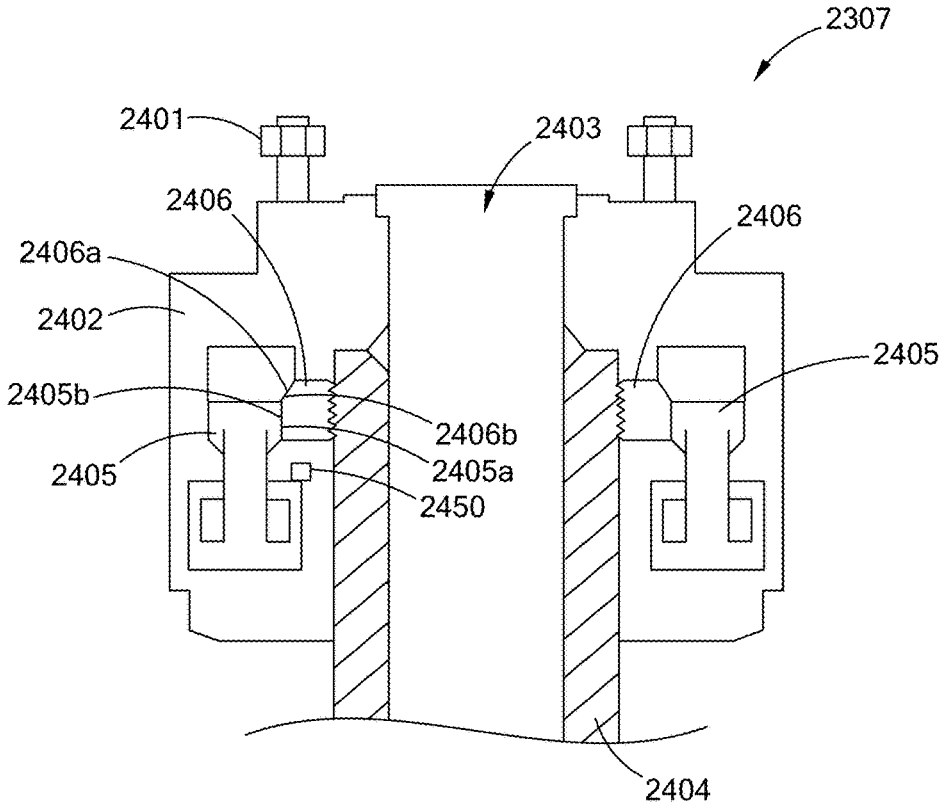
FIG. 24 is a cross sectional view of the LMRP connector of the embodiment of FIG. 23.
Figure 24A:
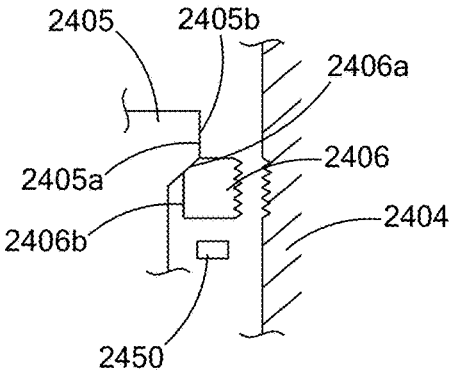
FIG. 24A is a cross sectional view of components of the embodiment of FIG. 24 is an unlocked position.
Figure 24B:
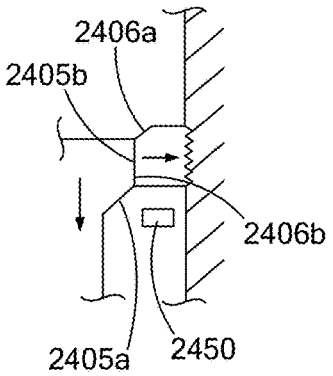
FIG. 24B is a cross sectional view of components of the embodiment of FIG. 24 in a locked position.

For example, turning to FIGS. 24, 24A, 24B, there is shown cross section of connector 2307, and detailed enlargements of the locking components of that connector in a locked position, FIG. 24B, and an unlocked position, FIG. 24A. The connector 2307 has attachment bolts 2401 positioned on a body 2402 that forms a cavity 2403. The body 2402 engages a member 2404 from the lower BOP stack 2306. The locking, engagement, mechanism, in general, has an engagement member 2405 that has an engagement surface 2405*a* and a locking surface 2405*b*. As the engagement member 2405 is moved downwardly, engagement surface 2405*a* engage engagement surface 2406*a* on locking member 2406, moving locking member 2406 into locking engagement with member 2404. As engagement member 2405 moves further down locking surface 2405*b* is positioned adjacent locking surface 2406*b*, holding locking member 2406 into locked engagement with member 2404. A laser delivery device 2450 may be placed inside of the body 2402, and a laser beam path provided in the body, such that the laser beam can be delivered to the internal locking and engagement components of the connector. Thus, for example the laser beam could be direct to the locking surfaces, to the locking member, to the engagement member, to the means to move the engagement member, to other components or structures associated therewith, and combinations and variations of these. The laser device may also be located, or a second laser device may be employed to cut other structures of the connector assembly to effect a disconnect, such as the bolts 2401, the body 2402, the member 2404, or the member attached to bolts 2404 (but which is not shown in the figures), and combinations and variations of these. Preferably the laser beam device, laser beam path and intended target for the laser beam is a component, structure or area that causes minimal damage, is easily reparable or replaceable, but at the same, time provides a high likelihood of effecting a disconnect.

Figure 19:
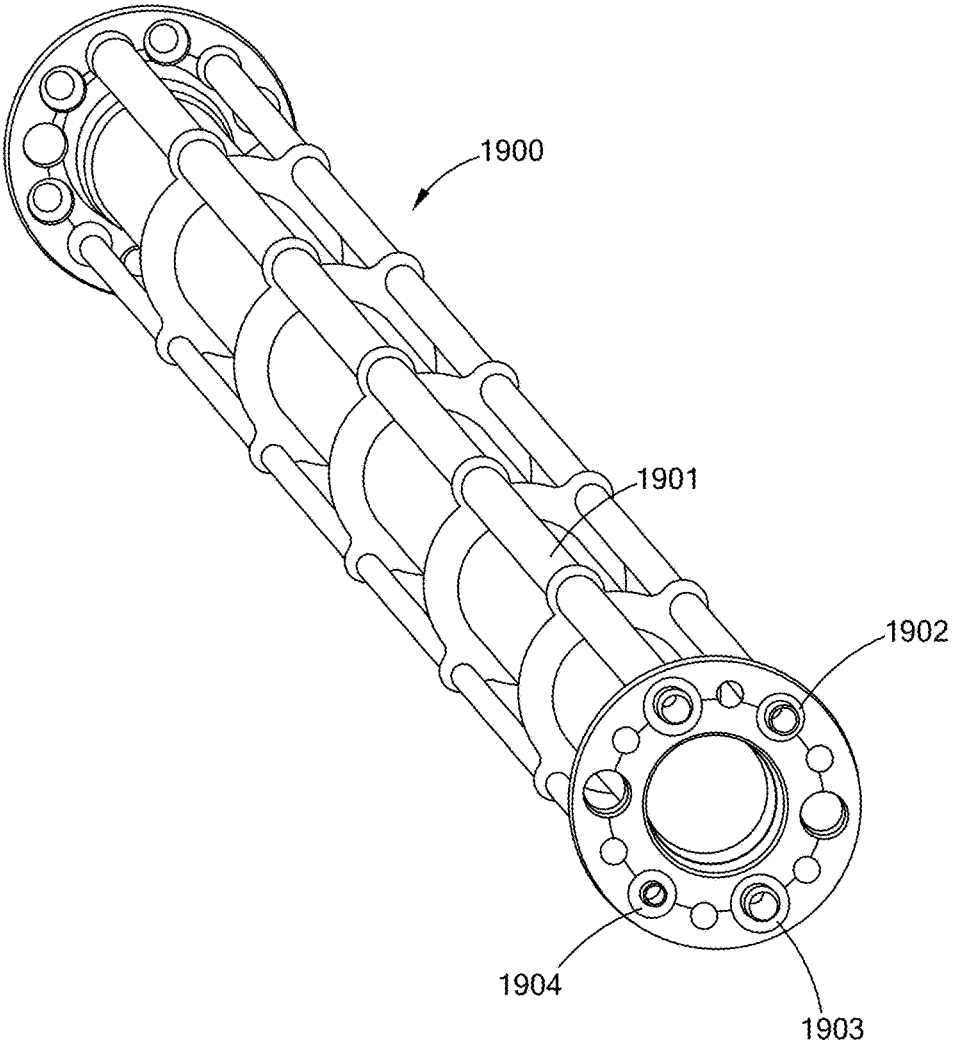
FIG. 19 is a perspective view of an embodiment of a riser section in accordance with the present invention.

FIG. 19 is a perspective view of a riser section 1900 having a choke line 1901, a boost line 1902, a kill line 1903, and a BOP hydraulics line 1904. As discussed in these specifications these lines, or additional lines, could be used to carry or contain the high power laser fiber, the laser conduct, the fluid conveyance tubes, and in general the components and materials needed to operate the fluid laser jet(s).

Figure 25A:
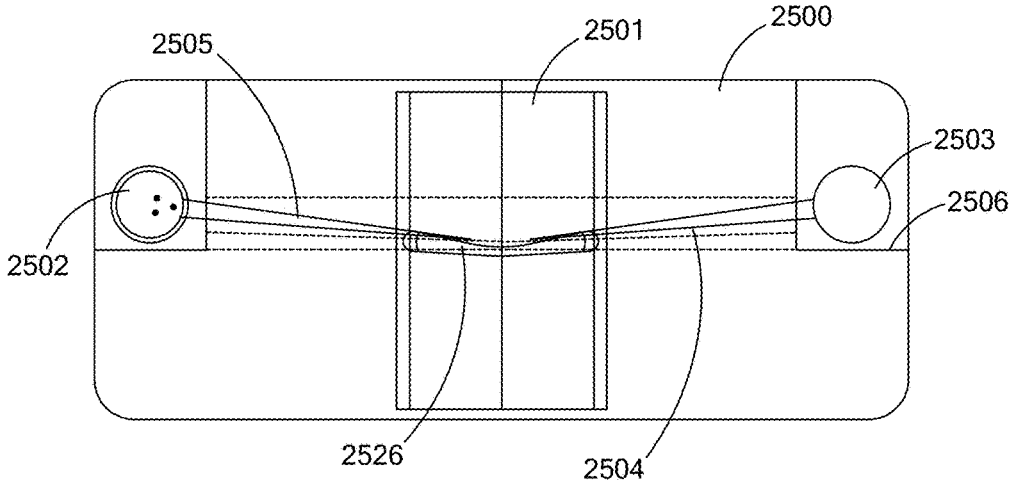
FIG. 25A is a face on illustration of an embodiment of a laser ram block in accordance with the present invention.
Figure 25B:
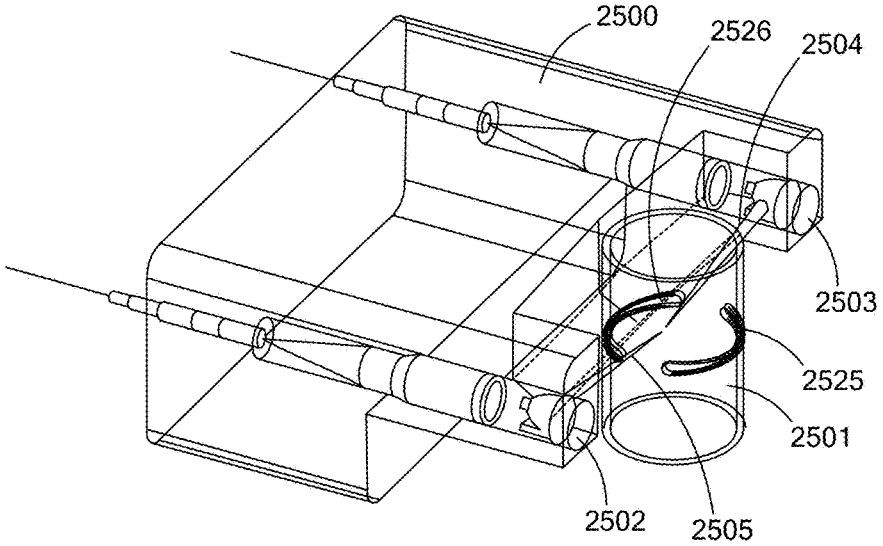
FIG. 25B is a perspective view of the embodiment of FIG. 25A.

Turning to FIGS. 25A and 25B there are face on view and a perspective view of a laser ram block in relations to a pipe. The ram block 2500 has two laser delivery assemblies 2502, 2503 are positioned in the block 2500 and deliver laser beams 2505, 2504 to pipe 2501. The angle of the laser beams with respect to he longitudinal axis of the pipe (and in the illustration the cavity axis) can be seen. The laser beams 2505, 2504 have a slight downward angle, that may be at least about 2° below horizontal, at least about 5°, and at least about 10°. The laser beams make cuts 2525, 2526 in pipe 2501.

is a schematic view of an embodiment of a surface system that may be used with a drilling rig, e.g., a drill ship, semi-submersible, jack-up, etc., and a laser BOP system. The surface system 2600 may have a diverter 2601, a flex joint 2602, a space out joint 2603, an inner barrel telescopic joint 2604, a dynamic seal telescope joint 2605, tensioners 2606, a tension ring 2607, an outer barrel telescopic joint (tension joint) 2608, and a riser joint 2609. The laser conveyance and laser fluid conveyance structures could be located at or near position 2626*a*, e.g., near the diverter 2601; at or near position 2626*b*, e.g., below the space out joint 2603; at or near position 2626*c*, e.g., below the tensioners 2606; or at or near position 2626*d*, near the riser joint 2609. The high power laser fiber, the high power laser fluid jet conduits, or conveyance structures, may enter into the riser system at these positions or other locations in, or associated with, the surface system 2600.

Figure 26:
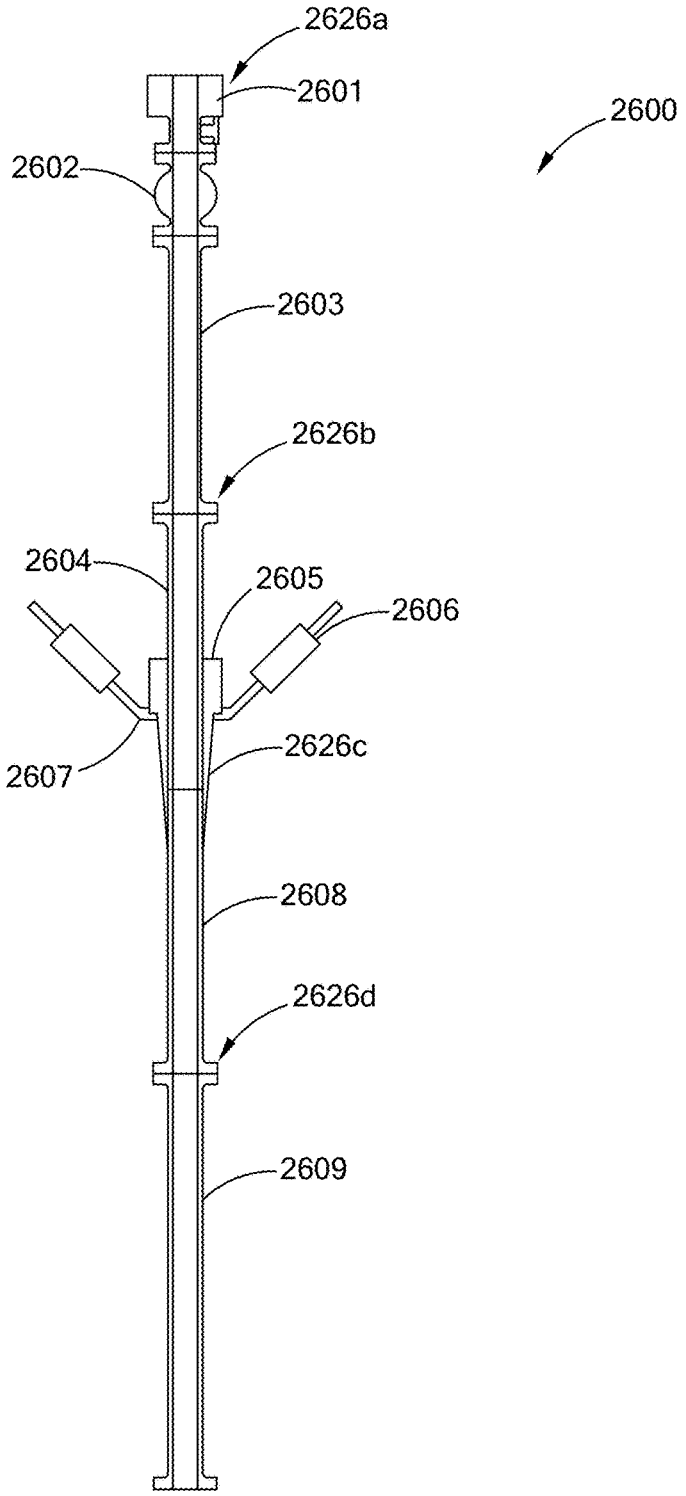
FIG. 26 is perspective view of embodiments of positions and paths for the topside location and placement of the high power laser optical fiber cable in accordance with the present invention.
Figure 27:
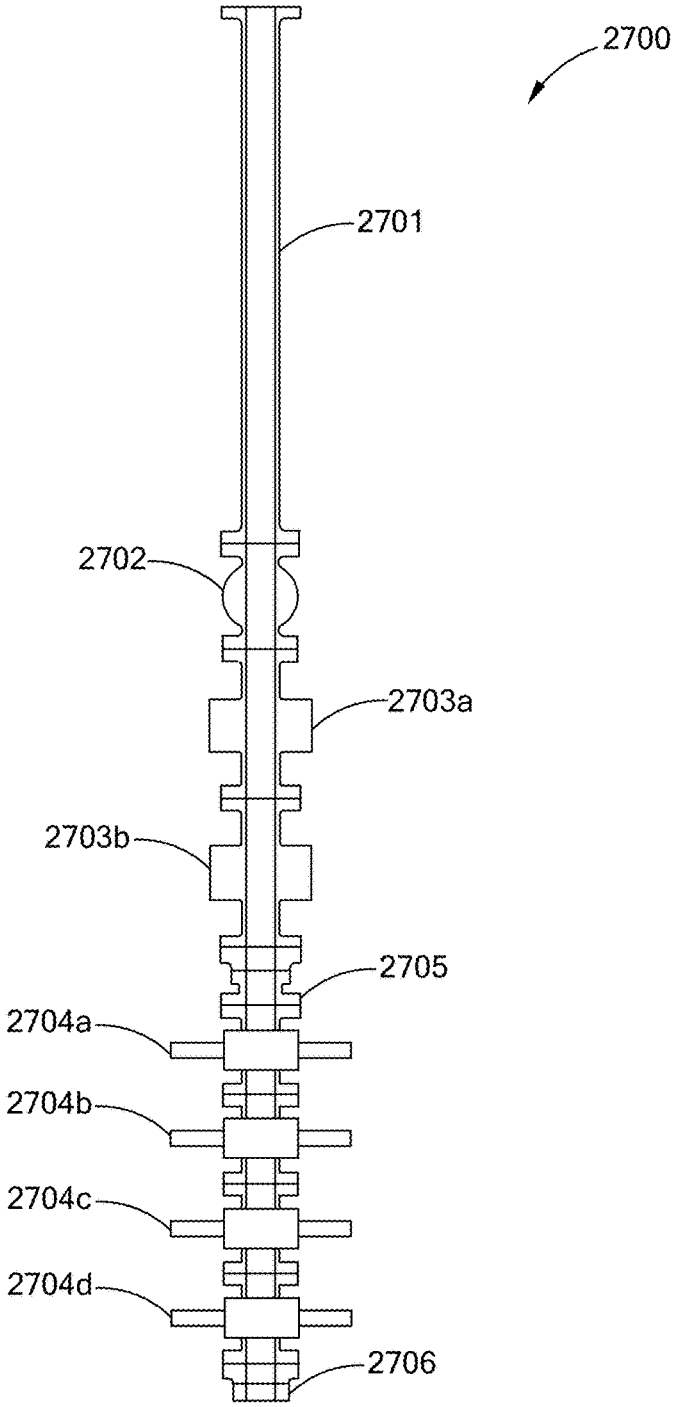
FIG. 27 is a perspective view of embodiments of positions and paths for the subsea location and placement of the high power optical fiber cable in accordance with the present invention.

FIG. 27 is a schematic view of an embodiment of a subsea system that may be used with a drilling rig, e.g., a drill ship, semi-submersible, jack-up, etc., and a laser BOP system, and may be used with the surface system of the embodiment of FIG. 26. The subsea system 2700 may have a riser joint 2701, a flex joint 2702, an annular preventer 2703*a*, and an annular preventer 2703*b*, an EDP hydraulic connector 2705, BOP rams 2704*a*, 2704*b*, 2704*c*, 2704*d*, and a hydraulic connector or a wellhead 2706. The high power laser fiber, the high power laser fluid jet conduits, or conveyance structures, may enter into the subsea system 2700 at many points. One or more of the BOP rams and annular preventers may be laser rams and laser preventers. Thus, the laser fiber, fluid conveyance system and fluid laser jet conduit above the annular preventer, below the flex joint, below the annular preventer, between the annular preventer, at the annular preventer, at, above or below the EDP connector, and at or in the area of the BOP rams.

Figure 28:
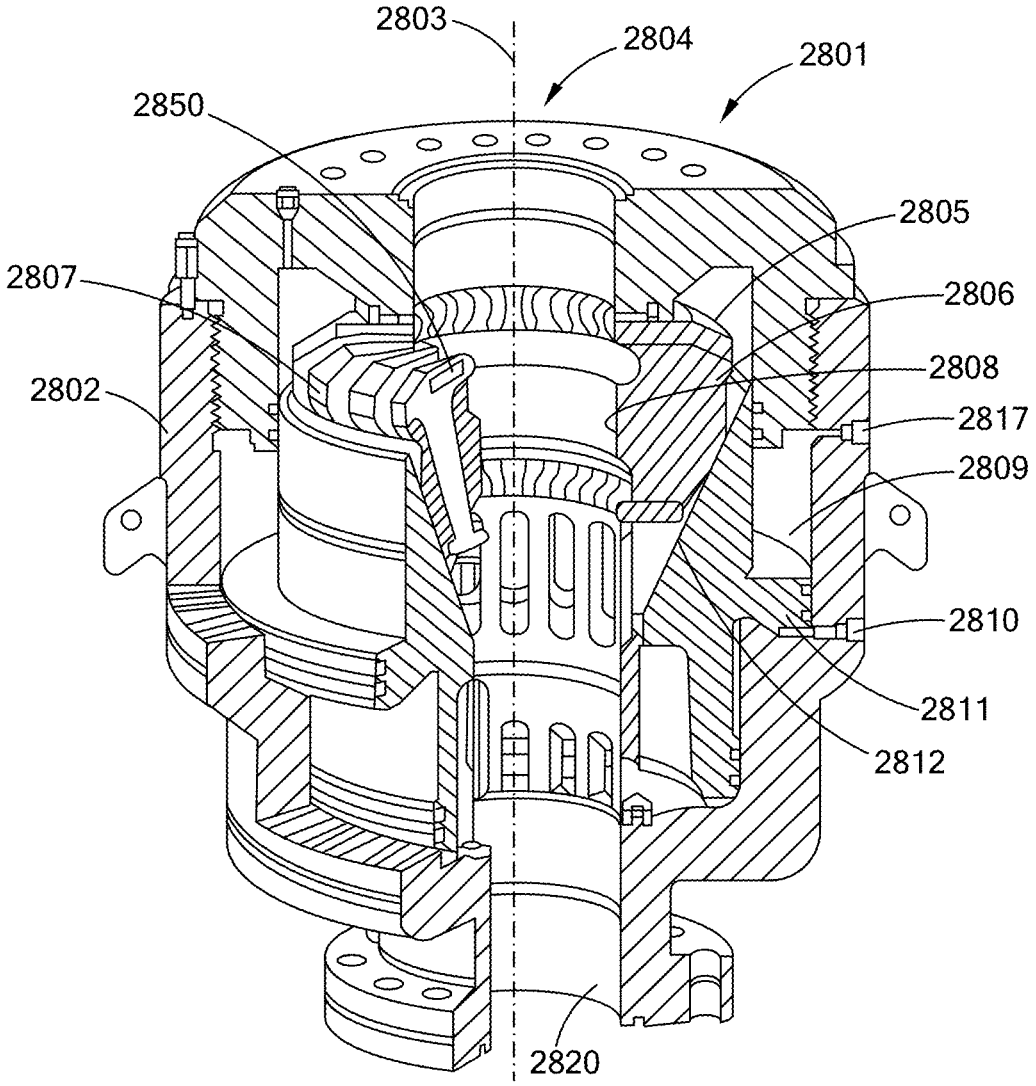
FIG. 28 is a perspective cutaway view of an embodiment of a laser annular preventer.

Turning to FIG. 28 there is provided a cutaway perspective view of an embodiment of a laser annular preventer 2801. The laser annular preventer 2801 may have an outer housing 2802, a central axis 2803, a cavity 2804, an annular assembly 2805. The annular assembly 2805 has an elastomeric body 2806, which has several metal inserts, e.g., 2807, which are positioned in the elastomeric body 2806 and around that body. The assembly 2805 has a cavity 2808 that is connected to, and forms a part of cavity 2804. A piston chamber 2809 is has a piston 2811, and an external port 2810. The piston 2811 drives wedges, e.g., 2812 against the elastomeric body 2806 forcing it and the metal inserts, e.g., 2807, into cavity 2808. There is also a retract port 2817 and a cavity 2820 that will be associated with the BOP cavity. Within the metal inserts 2807 that is a laser delivery assembly 2850, which provides a laser beam path and delivers a high power laser beam into the cavity 2808. Thus, as the wedge 2812 is driven up the elastomeric body 2806, which carries the metal inserts moves into the cavity 2808 and movers closer to and seals against any tubular in the cavity 2808. One metal insert may have a laser device, two metal inserts may each have a laser device, and three or more metal inserts may each have laser devices. The laser devices may be positioned around the cavity, opposite to each other, at thirds, quarters or other arrangements. More than one laser delivery device may be located in a metal insert. As the metal inserts are moved into the cavity the distance of the beam free path, the distance from when the laser beam leaves the laser device and strikes the pipe, is reduced and potentially reduced to essentially zero, as the metal insert mores toward and potentially contacts the pipe. Preferably the metal inserts are spaced a slight distance away from the pipe with the elastomer member forming a seal against the pipe and thus shielding the laser beam path to the pipe from the formation fluids, drilling fluids and pressures that are below the annular. Further, a second annular, or other type of sealing member may be located above the metal inserts. This second or upper sealing member can then be sealed against the pipe creating a sealed cavity that essentially isolates the laser beam path from conditions both above and below the cavity. A vent or relief valve preferably can be located in, or associated, with the upper sealing member to provide a relief port for the laser jet fluid that is used, added into the sealed cavity, during the laser cutting process.

Figure 29:
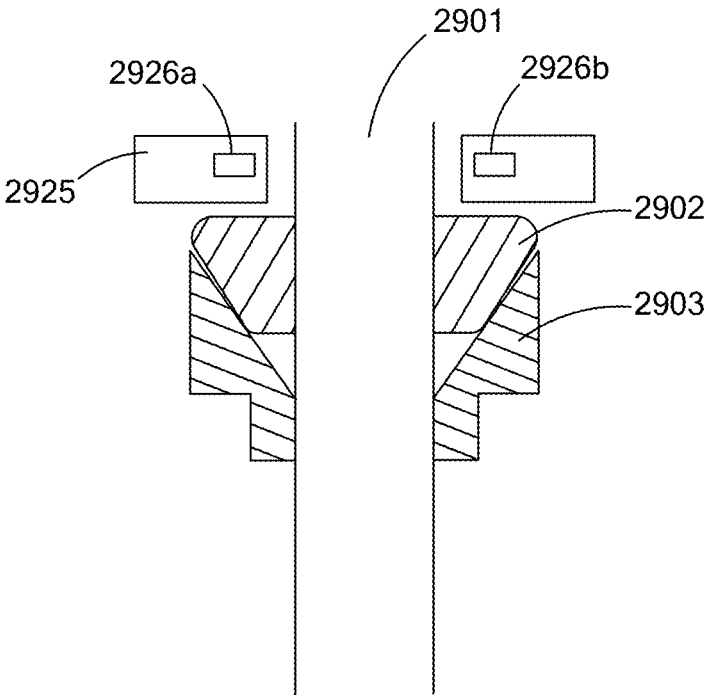
FIG. 29 is a cross sectional schematic view of an embodiment of a laser annular preventer.

Turning to FIG. 29 is a cross section of an embodiment of a laser module an annular preventer. The laser modules 2926*a*, 2926*b* are located above the annular prevent elastomeric body 2902 and wedge 2993. As the elastomeric body grabs and holds a pipe in the cavity 2901 it will center the pipe providing a constant distance for the laser beam path from the laser module to the pipe. The laser modules may rotate around the pipe providing for a complete cut.

Laser cutters, laser devices and laser delivery assemblies can be used in, or in conjunction with commercially available annular preventers, rotating heads, spherical BOPs, and other sealing type well control devices. Thus, they may be used in, or with, for example, NOV (National Oilwell Varco) preventer, GE HYDRIL pressure control devices, SHAFFER pressure control devices, spherical preventers, tapered rubber core preventers, CAMERON TYPE D preventers, and CAMERON TYPE DL preventers.

Table 5 set forth examples of operating conditions for a laser module using a rotating cutting type laser delivery device.

TABLE 5

| Sample | Power | Offset | Time | Beam Size | Focal Length | Nozzle Diameter | Angular Offset | Warm Up Time | % Cross Section |
|---|---|---|---|---|---|---|---|---|---|
| 1 | 10 kW | .5"-2" | 10 | 0.18 | 500 MM | 0.325 | 10 Deg | 2 s | 50 |
| 2 | 10 kW | .5"-2" | 10 | 0.18 | 500 MM | 0.325 | 10 Deg | 2 s | 50 |
| 3 | 10 kW | .5"-2" | 5 | 0.18 | 500 MM | 0.325 | 10 Deg | 2 s | 25 |
| 4 | 10 kW | .5"-2" | 5 | 0.18 | 500 MM | 0.325 | 10 Deg | 2 s | 25 |
| 5 | 10 kW | .5"-2" | 3 | 0.18 | 500 MM | 0.325 | 10 Deg | 2 s | 12.5 |
| 6 | 10 kW | .5"-2" | 3 | 0.18 | 500 MM | 0.325 | 10 Deg | 2 s | 12.5 |
| 7 | 10 kW | .5"-2" | 1.5 | 0.18 | 500 MM | 0.325 | 10 Deg | 2 s | 6.25 |
| 8 | 10 kW | .5"-2" | 1.5 | 0.18 | 500 MM | 0.325 | 10 Deg | 2 s | 6.25 |
| 9 | TBD | TBD | TBD | TBD | TBD | TBD | TBD | TBD | TBD |
| 10 | TBD | TBD | TBD | TBD | TBD | TBD | TBD | TBD | TBD |
| 11 | TBD | TBD | TBD | TBD | TBD | TBD | TBD | TBD | TBD |
| Rotary | 17.3 Kw | .030" | 7.5 | 0.04 | 250 MM | 0.06 | 0 Deg | 5s | 100% |
| Axial | 20 Kw | .060" | 40 | 0.18 | 500 MM | 0.325 | 1 Deg | 5s | 100% |

High power laser systems, which may include, conveyance structures for use in delivering high power laser energy over great distances and to work areas where the high power laser energy may be utilized, or they may have a battery operated, or locally powered laser, by other means. Preferably, the system may include one or more high power lasers, which are capable of providing: one high power laser beam, a single combined high power laser beam, multiple high power laser beams, which may or may not be combined at various point or locations in the system, or combinations and variations of these.

A single high power laser may be utilized in the system, or the system may have two or three high power lasers, or more. High power solid-state lasers, specifically semiconductor lasers and fiber lasers are preferred, because of their short start up time and essentially instant-on capabilities. The high power lasers for example may be fiber lasers or semiconductor lasers having 10 kW, 20 kW, 50 kW or more power and, which emit laser beams with wavelengths in the range from about 455 nm (nanometers) to about 2100 nm, preferably in the range about 800 nm to about 1600 nm, about 1060 nm to 1080 nm, 1530 nm to 1600 nm, 1800 nm to 2100 nm, and more preferably about 1064 nm, about 1070-1080 nm, about 1360 nm, about 1455 nm, 1490 nm, or about 1550 nm, or about 1900 nm (wavelengths in the range of 1900 nm may be provided by Thulium lasers).

An example of this general type of fiber laser is the IPG YLS-20000. The detailed properties of which are disclosed in US patent application Publication Number 2010/0044106.

Examples of lasers, conveyance structures, high power laser fibers, high power laser systems, optics, connectors, cutters, and other laser related devices, systems and methods that may be used with, or in conjunction with, the present inventions are disclosed and taught in the following US patent application publications and US patent applications: Publication Number 2010/0044106; Publication Number 2010/0044105; Publication Number 2010/0044103; Publication Number 2010/0215326; Publication Number 2012/0020631; Publication Number 2012/0074110; Publication No. 2012/0068086; Ser. No. 13/403,509; Ser. No. 13/486,795; Ser. No. 13/565,345; Ser. No. 61/605,429; Ser. No. 61/605,434; Ser. No. 61/734,809; Ser. No. 61/786,763; and Ser. No. 61/98,597, the entire disclosures of each of which are incorporated herein by reference.

These various embodiments of conveyance structures may be used with these various high power laser systems. The various embodiments of systems and methods set forth in this specification may be used with other high power laser systems that may be developed in the future, or with existing non-high power laser systems, which may be modified in-part based on the teachings of this specification, to create a laser system. These various embodiments of high power laser systems may also be used with other conveyance structures that may be developed in the future, or with existing structures, which may be modified in-part based on the teachings of this specification to provide for the utilization of directed energy as provided for in this specification. Further the various apparatus, configurations, and other equipment set forth in this specification may be used with these conveyance structures, high power laser systems, laser delivery assemblies, connectors, optics and combinations and variations of these, as well as, future structures and systems, and modifications to existing structures and systems based in-part upon the teachings of this specification. Thus, for example, the structures, equipment, apparatus, and systems provided in the various Figures and Examples of this specification may be used with each other and the scope of protection afforded the present inventions should not be limited to a particular embodiment, configuration or arrangement that is set forth in a particular embodiment in a particular Figure.

Many other uses for the present inventions may be developed or realized and thus the scope of the present inventions is not limited to the foregoing examples of uses and applications. The present inventions may be embodied in other forms than those specifically disclosed herein without departing from their spirit or essential characteristics. The described embodiments are to be considered in all respects only as illustrative and not restrictive.

What is claimed:

1. A well control system having a reduced potential mechanical energy requirement, the system comprising:

a. a body defining a pressure containment cavity, wherein the body comprises a blowout preventer;

b. a mechanical device associated with the pressure containment cavity, wherein the mechanical device comprises a ram;

c. a source of directed energy, wherein the source of directed energy is a high power laser, has a power greater than about 1 kW; and, has the capability to deliver a directed energy to a location within the pressure containment cavity, the directed energy having a first amount of energy having a power great than about 1 kW; and, d. a source of potential mechanical energy associated with the mechanical device, and capable of delivering mechanical energy to a location within the pressure containment cavity, the source of potential energy having a potential energy having a second amount of energy;

e. wherein, the first amount of energy is at least as great as about 5% of the second amount of energy.

2. The well control system of claim 1, wherein the mechanical device comprises a shear ram.

3. The well control system of claim 1, wherein the ram is selected from the group consisting of a blind ram, a shear ram, a blind shear ram, a pipe ram and a casing shear ram.

4. The well control system of claim 1, comprising a a riser and a blowout preventer stack.

5. The well control system of claim 4, wherein the mechanical device is selected from the group consisting of a blind ram, a fixed pipe ram, a variable pipe ram, a shear ram, a blind shear ram, a pipe ram and a casing shear ram.

6. The well control system of claim 1, wherein the source of potential mechanical energy comprises a charged accumulator.

7. The well control system of claim 1, wherein the source of potential mechanical energy comprises a plurality of charged accumulators.

8. The well control system of claim 1, wherein the source of potential mechanical energy comprises a charged accumulator bank.

9. The well control system of claim 6, wherein the charged accumulator has a pressure of at least about 1,000 psi.

10. The well control system of claim 6, wherein the charged accumulator has a pressure of at least about 3,000 psi.

11. The well control system of claim 6, wherein the charged accumulator has a pressure of at least about 5,000 psi.

12. The well control system of claim 1, wherein the source of directed energy is a high power laser have a power of at least about 10 kW.

13. The well control system of claim 1, wherein the source of directed energy is a high power laser have a power of at least about 15 kW.

14. The well control system of claim 1, wherein the source of directed energy is a high power laser have a power of at least about 20 kW.

15. The well control system of claim 1, wherein the source of directed energy is a high power laser have a power of at least about 40 kW.

16. The well control system of claim 1, wherein the first amount of energy is at least about 150 kJ.

17. The well control system of claim 1, wherein the first amount of energy is at least about 600 kJ.

18. The well control system of claim 12, wherein the well control systems comprises a high power laser system; the body comprises a blowout preventer; the source of potential mechanical energy comprises a charged accumulator, having a pressure of at least about 1,000 psi; and the mechanical device is selected from the group consisting of a blind ram, a shear ram, a ram, a blind shear ram, a pipe ram and a casing shear ram.

19. The well control system of claim 14, wherein the well control systems comprises a high power laser system; the body comprises a blowout preventer; the source of potential mechanical energy comprises a charged accumulator, having a pressure of at least about 1,000 psi; and the mechanical device is selected from the group consisting of a blind ram, a shear ram, a blind shear ram, a ram, a pipe ram and a casing shear ram.

20. The well control system of claim 15, wherein the well control systems comprises a high power laser system; the body comprises a blowout preventer; the source of potential mechanical energy comprises a charged accumulator, having a pressure of at least about 1,000 psi; and the mechanical device is selected from the group consisting of a blind ram, a shear ram, a blind shear ram, a pipe ram, a ram and a casing shear ram.

21. The well control system of claim 16, wherein the well control systems comprises a high power laser system; the body comprises a blowout preventer; the source of potential mechanical energy comprises a charged accumulator, having a pressure of at least about 1,000 psi; and the mechanical device is selected from the group consisting of a blind ram, a shear ram, a blind shear ram, a ram, a pipe ram and a casing shear ram.

22. The well control system of claim 17, wherein the well control systems comprises a high power laser system; the body comprises a blowout preventer; the source of potential mechanical energy comprises a charged accumulator, having a pressure of at least about 1,000 psi; and the mechanical device is selected from the group consisting of a blind ram, a shear ram, a blind shear ram, a ram, a pipe ram and a casing shear ram.

23. The well control system of claim 1, wherein the first amount of energy is greater than the second amount of energy energy.

24. The well control system of claim 1, wherein the first amount of energy is at least as great as about 25% of the second amount of energy.

25. The well control system of claim 1, wherein the first amount of energy is at least as great as about 50% of the second amount of energy.

26. The well control system of claim 1, wherein the first amount of energy is at least as great as about 100% of the second amount of energy.

27. The well control system of claim 1, wherein the first amount of energy is greater than the second amount of energy.

28. The well control system of claim 1, wherein the first amount of energy is at least as great as about 25% of the second amount of energy.

29. The well control system of claim 1, wherein the first amount of energy is at least as great as about 50% of the second amount of energy.

30. The well control system of claim 1, wherein the first amount of energy is at least as great as about 100% of the second amount of energy.

31. The well control system of claim 5, wherein the first amount of energy is greater than the second amount of energy.

32. The well control system of claim 5, wherein the first amount of energy is at least as great as about 25% of the second amount of energy.

33. The well control system of claim 5, wherein the first amount of energy is at least as great as about 50% of the second amount of energy.

34. The well control system of claim 5, wherein the first amount of energy is at least as great as about 100% of the second amount of energy.

35. The well control system of claim 2, wherein the first amount of energy is greater than the second amount of energy.

36. The well control system of claim 4, wherein the first amount of energy is at least as great as about 25% of the second amount of energy.

37. The well control system of claim 9, wherein the first amount of energy is at least as great as about 50% of the second amount of energy.

38. The well control system of claim 12, wherein the first amount of energy is at least as great as about 100% of the second amount of energy.

39. A well control system having a reduced potential mechanical energy requirement, the system comprising:

a. a body defining a pressure containment cavity, wherein the body comprises a blowout preventer;

b. a mechanical device associated with the pressure containment cavity, wherein the mechanical device comprises a ram;

c. a source of directed energy, wherein the source of directed energy is a high power laser, has a power of at least about 1 kW; and, has the capability to deliver a directed energy to a location associated with the pressure containment cavity, the directed energy having a first power of at least about 1 kW; and, d. a source of potential mechanical energy associated with the mechanical device, and capable of delivering mechanical energy to a location within the pressure containment cavity, the source of potential energy having a potential energy having a second power;

e. wherein, the first power is at least as great as about 5% of the second power.

40. The well control system of claim 39, wherein the ram is selected from the group consisting of a blind ram, a shear ram, a blind shear ram, a pipe ram and a casing shear ram.

41. The well control system of claim 39, comprising a riser and a blowout preventer stack.

42. The well control system of claim 39, wherein the source of potential mechanical energy comprises a bank of charged accumulators.

43. The well control system of claim 42, wherein the charged accumulators has a pressure of at least about 3,000 psi.

44. The well control system of claim 39, wherein the source of directed energy is a high power laser have a power of at least about 10 kW.

45. The well control system of claim 39, wherein the source of directed energy is a high power laser have a power of at least about 20 kW.

46. The well control system of claim 39, wherein the first amount of energy is at least about 150 kJ.

47. The well control system of claim 39, wherein the first amount of energy is at least about 600 kJ.

48. The well control system of claim 44, wherein the well control systems comprises a high power laser system; the body comprises a blowout preventer; the source of potential mechanical energy comprises a charged accumulator, having a pressure of at least about 1,000 psi; and the mechanical device is selected from the group consisting of a blind ram, a shear ram, a ram, a blind shear ram, a pipe ram and a casing shear ram.

49. The well control system of claim 46, wherein the well control systems comprises a high power laser system; the body comprises a blowout preventer; the source of potential mechanical energy comprises a charged accumulator, having a pressure of at least about 1,000 psi; and the mechanical device is selected from the group consisting of a blind ram, a shear ram, a blind shear ram, a ram, a pipe ram and a casing shear ram.

50. The well control system of claim 39, wherein the first power is greater than the second power.

51. The well control system of claim 39, wherein the first power is at least as great as about 25% of the second power.

52. The well control system of claim 39, wherein the first power is at least as great as about 100% of the second power.

53. The well control system of claim 40, wherein the first power is greater than the second power.

54. The well control system of claim 40, wherein the first power is at least as great as about 25% of the second power.

55. The well control system of claim 44, wherein the first power is at least as great as about 50% of the second power.

56. The well control system of claim 44, wherein the first power is greater than the second power.

57. The well control system of claim 47, wherein the first power is at least as great as about 25% of the second power.

58. The well control system of claim 47, wherein the first power is at least as great as about 100% of the second power.

59. The well control system of claim 47, wherein the first power is greater than the second power.

60. The well control system of claim 48, wherein the first power is at least as great as about 25% of the second power.

61. The well control system of claim 48, wherein the first power is at least as great as about 50% of the second power.

62. A well control system having a reduced potential mechanical energy requirement, the system comprising:

a. a high power laser system;
b. a riser;
c. a blowout preventer stack;
d. the blowout preventer stack defining a cavity;
e. a mechanical device for sealing a well associated with the cavity;
f. a source of directed energy, wherein the source of directed energy is a high power laser, has a power of at least about 1 kW, and has the capability to deliver a directed energy to a location associated with the cavity, the directed energy having a first amount of energy of at least about 1 kW; and,
g. a source of potential mechanical energy associated with the mechanical device, and capable of delivering mechanical energy to a location associated with the cavity, the source of potential energy having a potential energy having a second amount of energy energy;
h. wherein, the first amount of energy is at least as great as about 5% of the second amount of energy, and
i. wherein, the source of directed energy and the source of potential mechanical energy are within the cavity of the blowout preventer stack.

63. The well control system of claim 62, wherein in the source of directed energy is a high power laser have a power of at least about 15 kW, and the source of potential energy is a charged bank of accumulators having a pressure of at least about 1,000 psi.

64. The well control system of claim 62, wherein in the source of directed energy is a high power laser of at least about 20 kW.

65. The well control system of claim 62, wherein the source of potential energy is a charged bank of accumulators having a pressure of at least about 1,000 psi.

66. A constant energy depth independent well control system, the system comprising:

a. a device for delivering directed energy subsea, the directed energy having a power of at least about 1 kW;
b. a device for delivering mechanical energy associated with a potential energy source having an amount of potential energy; and,
c. the device for delivering directed energy subsea compensatively associated with the device for delivering mechanical energy, whereby the delivery of the directed energy compensates for losses in potential energy;
d. a high power laser, a riser and a blowout preventer stack,
e. wherein the device for delivering directed energy and the device for delivering mechanical energy are located within a cavity in the blowout preventer stack.

67. The well control system of claim 66, wherein the losses of potential energy arise from the potential energy source being positioned under a surface of a body of water at a depth.

68. The well control system of claim 67, wherein the depth is at least about 5,000 ft.

69. The well control system of claim 66, wherein the source of potential energy comprises a bank of charged accumulators.

70. A laser BOP comprising:

a. a first and a second ram block;
b. the first ram block of the laser BOP having within a first and a second laser device, the first laser device defining a first laser beam path for delivery of a laser beam, the second laser device defining a second beam path for delivery of a laser beam;
c. the second ram block of the laser BOP having within a third and a fourth laser device, the third laser device defining a third laser beam path for delivery of a laser beam, the fourth laser device defining a fourth laser beam path for delivery of a laser beam; and,
d. the ram blocks associated with an actuator center line;
e. whereby the laser beam paths define beam path angles with respect to the actuator center line; and wherein the laser beam has a power of at least about 5 kW; and
f. wherein the laser is for damaging or cutting a tubular within the laser BOP.

71. A laser BOP comprising:

a. a first ram block;
b. the first ram block of the laser BOP having within a first and a second laser device, the first laser device defining a first laser beam path for delivery of a laser beam, the second laser device defining a second beam path for delivery of a laser beam; and,
c. the ram block associated with an actuator center line;
d. whereby the laser beam paths define beam path angles with respect to the actuator center line; and wherein the laser beam has a power of at least about 5 kW; and
e. wherein the laser is for damaging or cutting a tubular within the laser BOP.

72. The laser BOP of claim 71, wherein the beam path angle for the first laser beam path is 900.

73. The laser BOP of claim 71, wherein the beam path angle for the first laser beam path is greater than 90°.

74. The laser BOP of claim 71, wherein the beam path angle for the first laser beam path is less than 90°.

75. The laser BOP of claim 71, wherein the beam path angles for the first and second beam paths are greater than 90°.

76. The laser BOP of claim 71, wherein the beam path angles for the first and second beam paths are less than 90°.

77. The laser BOP of claim 71, wherein the beam path angles for the first and second beam paths are about the same angle.

78. The laser BOP of claim 71, wherein the beam path angles for the first and second beam paths are different angles.

79. The laser BOP of claim 71, wherein the first laser beam has a power of at least about 10 kW.

80. The laser BOP of claim 71, wherein the first and second laser beams each have a power of at least about 10 kW.

81. The laser BOP of claim 71, comprising:

a. a second ram block;

b. the second ram block having a third and a fourth laser device, the third laser device defining a third laser beam path for delivery of a laser beam, the fourth laser device defining a fourth beam path for delivery of a laser beam; and, c. the second ram block associated with the actuator center line;

d. whereby the third and fourth laser beam paths define beam path angles with respect to the actuator center line.

82. A method of severing a tubular in a BOP cavity, comprising:

a. delivering directed energy, having a power of at least about 5 kW, to a predetermined location on a tubular positioned in a cavity of a BOP;

b. the directed energy damaging the tubular in a predetermined pattern; and, c. applying a mechanical force to the tubular in association with the damage pattern, whereby the tubular is severed, d. wherein the directed energy is a high power laser beam having at least about 5 kW of power, and having a focal length, wherein the damage pattern is a slot having a length and a varying width, whereby the width varies proportionally to the focal length of the laser beam, e. wherein a source of the directed energy is within the BOP cavity.

83. The method of claim 82, wherein the directed energy is a high power laser beam.

84. The method of claim 82, wherein the directed energy is a high power laser beam having at least 10 kW of power.

85. The method of claim 82, wherein the predetermined damage pattern is a slot.

86. The method of claim 82, wherein the predetermined damage pattern is a slot having a length and a varying width.

87. A method for closing a well comprising:

a. a step for delivering a high power laser beam, having a power greater than about 1 kW, to a tubular in a cavity in a BOP, wherein the high power laser beam is within the cavity of the BOP;

b. a step for removing material from the tubular with the delivered high power laser beam;

c. a step for applying a mechanical force to the tubular, wherein the mechanical force is provided by a ram; and, d. the step for mechanically closing the well.

88. A laser ram BOP comprising:

a. a means for providing a high power laser beam to a BOP stack, the BOP stack defining a cavity, wherein the means for providing a high power laser beam is within the cavity of the BOP;

b. a means for directing the high power laser beam, having a power greater than 1 kW, to a tubular within the BOP cavity; and, c. a means for applying a mechanical force to the tubular, wherein the mechanical force is provided by a ram.

89. The laser ram BOP of claim 88, wherein the means for providing a high power laser beam comprises a battery powered 10 kW laser located subsea adjacent to the BOP stack.

90. The laser ram BOP of claim 88, wherein the means for directing the high power laser beam comprises a pressure compensated fluid laser jet.

91. The laser ram BOP of claim 90, wherein the pressure compensated fluid laser jet comprises a means for pressure compensation.

92. A BOP package comprising:

a. a lower marine rise package;

b. a lower BOP stack;

c. a connector releasable connecting the lower marine riser package and the lower BOP stack; and, d. the connector comprising a high power directed energy delivery device, having a power greater than 1 kW, wherein the high power directed energy delivery device is within the connector, e. wherein the high power energy deliver device comprises a high power laser beam delivery device capable of delivering a high power laser beam having a power of at least about 5 kW.

93. The BOP of claim 92, wherein the connector is capable of being released at an angle, defined by a position of a rig associated with the BOP stack with respect to a vertical line from the BOP stack, that is greater than about 5°.

94. The BOP of claim 93, wherein the releasable angle is greater than about 6°.

95. The BOP of claim 93, wherein the releasable angle is greater than about 7°.

96. The BOP of claim 93, wherein the releasable angle is greater than about 10°.

97. The well control system of claim 6, wherein the charged accumulator has a pressure of at least about 7,500 psi.

* * * * *